US005218153A

United States Patent [19]

Minamitaka

[11] Patent Number: 5,218,153

[45] Date of Patent: Jun. 8, 1993

[54] TECHNIQUE FOR SELECTING A CHORD PROGRESSION FOR A MELODY

[75] Inventor: Junichi Minamitaka, Fussa, Japan

[73] Assignee: Casio Computer Co., Ltd., Tokyo, Japan

[21] Appl. No.: 749,899

[22] Filed: Aug. 26, 1991

[30] Foreign Application Priority Data

Aug. 30, 1990 [JP] Japan ..... 2-229426
Aug. 30, 1990 [JP] Japan ..... 2-229428
Aug. 30, 1990 [JP] Japan ..... 2-229429

[51] Int. Cl.[5] ..... G10H 7/00; G10H 1/38

[52] U.S. Cl. ..... 84/613; 84/637; 84/669

[58] Field of Search ..... 84/600-602, 84/609-615, 618, 647, 634-638, 649, -653, 666-669

[56] References Cited

U.S. PATENT DOCUMENTS 4,539,882 9/1985 Yuzawa .
4,951,544 8/1990 Minamitaka .
4,982,643 1/1991 Minamitaka ..... 84/613
5,003,860 4/1991 Minamitaka ..... 84/609
5,052,267 10/1991 Ino ..... 84/613
5,085,118 2/1992 Sekizuka ..... 84/635
5,088,390 2/1992 Minamitaka ..... 84/637

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A microcomputer based music apparatus allows a user to gain efficient access to a desired chord progression (CP). To this end, the apparatus includes a chord progression database (CPDB) containing a large collection of practical CPs with various kinds of style and harmonic rhythm. A database localizing manager provides a localized virtual space of CPs preselected from CPDB in accordance with the user's musical tastes and intentions. To help the user think of a melody and its harmonization in an integrated mental process, a suitability testing feature evaluates suitability between a CP (from CPDB) and a melody (supplied from the user) based on stored melody pattern rules. A music editor electronically manages (edits) structures of an intended music piece and provides a desired chain of phrases (each including attributes, CP and melody) in accordance with user's commands to construct a desired music piece, thus aiding the user's music composing activities.

25 Claims, 65 Drawing Sheets cpdb[ ] : CHAIN TABLE HEADER cpdb [0] ; FIRST (HEAD) CP
cpdb [1] ; CURRENT CP
cpdb [2] ; LAST (TAIL) CP chain[ ] : CHAIN TABLE range : SELECTED STYLE cpAdr[ ] : CP POINTER & STYLE INDEX TABLE choP[ ] : CP DATABASE cpAtt [ ] : CP ATTRIBUTE MEMORY
cpAtt [ix2+0] : LENGTH
cpAtt[ix2+1] : RHYTHM INDEX bar Length [ ] : LENGTH MEMORY

| ADDRESS | DATA | COMMENTS |
|---|---|---|
| 0 | 1 | 1 BAR |
| 1 | 2 | 2 BARS |
| 2 | 4 | 4 BARS |
| 3 | 8 | 8 BARS |
| 4 | 16 | 16 BARS |
| 5 | 0 | END MARK |

maxRhythm : TOTAL NUMBER OF RHYTHMS piece[ ] : PIECE MANAGEMENT PTRS

| HEAD | CUR | TAIL | NEW | OBJ |
|---|---|---|---|---|
| 0 | 1 | 2 | 3 | 4 |

piece[HEAD] : FIRST PHRASE PTR piece[CUR] : CURRENT PHRASE PTR piece[TAIL] : LAST PHRASE PTR piece[NEW] : NEW PHRASE PTR piece[OBJ] : OBJECT PHRASE PTR sent[ ] : PHRASE DATA

| KEY | LENGTH | CHOPTR | MELPTR | RHYTHM | NEXT | PREV |
|---|---|---|---|---|---|---|
| 0 | 1 | 2 | 3 | 4 | 5 | 6 |

sent[7xi+KEY] : MUSICAL KEY(0~11)

sent[7xi+LENGTH] : LENGTH(1,2,4,8...)

sent[7xi+CHOPTR] : CP INDEX sent[7xi+MELPTR] : MELODY INDEX sent[7xi+RHYTHM] : HARMONIC RHYTHM INDEX sent[7xi+NEXT] : SUCCEEDING PHRASE PTR sent[7xi+PREV] : PRECEDING PHRASE PTR bar : LENGTH MEMORY ADDRESS COUNTER

FIG.22 patNO :

| POPS | ROCK | JAZZ |
|---|---|---|
| 0 | 1 | 2 |

MUSIC STYLE

FIG.54 beat[ ] :

| ADDRESS | DATA | COMMENTS |
|---|---|---|
| 0 | 16 | BAR LENGTH OF POPS |
| 1 | 16 | BAR LENGTH OF ROCK |
| 2 | 12 | BAR LENGTH OF JAZZ |

FIG.55

0 : "CHORD TONE"

1 : "SCALE NOTE"

2 : "TENTION NOTE"

3 : "AVAILABLE NOTE"

4 : "AVOID NOTE"

5 : "ANY NOTE"

FIG.56

0 : "+"

1 : "-"

2 : "0"

3 : "ANY"

FIG.57

0 : "SAME"

1 : "HALF TONE MOTION"

2 : "STEPWISE MOTION"

3 : "WHOLE TONE MOTION

4 : "LEAP MOTION"

5 : "ANY"

FIG.58

| ADDRESSS | DATA | COMMENTS (CHORD TYPE) | (TENSION NOTE PCS) | | | | | |
|---|---|---|---|---|---|---|---|---|
| 00H | e44H | maj | D | Gb | A | Bb | B | |
| 01H | e24H | m | D | F | A | Bb | B | |
| 02H | 34eH | 7 | C# | D | Eb | Gb | Ab | A |
| 03H | 024H | m7 | D | F | | | | |
| 04H | 244H | M7 | D | Gb | A | | | |
| 05H | 224H | mM7 | D | F | A | | | |
| 06H | 844H | 6 | D | Gb | B | | | |
| 07H | 844H | 6(9) | D | Gb | B | | | |
| 08H | 824H | m6 | D | F | B | | | |
| 09H | 824H | m6(9) | D | F | B | | | |
| 0aH | 244H | M7(9) | D | Gb | A | | | |
| 0bH | 244H | M7(9,O3) | D | Gb | A | | | |
| 0cH | 244H | M7(6,#11) | D | Gb | A | | | |
| 0dH | 344H | 7(9) | D | Gb | Ab | A | | |
| 0eH | 024H | m7(9) | D | F | | | | |
| 0fH | 024H | m7(11) | D | F | | | | |
| 10H | 024H | m7(9,11) | D | F | | | | |
| 11H | 024H | m7(9,11,O5) | D | F | | | | |
| 12H | 24eH | 7(13) | C# | D | Eb | Gb | A | |
| 13H | 244H | 7(9,13) | D | Gb | A | | | |
| 14H | 124H | m7b5 | D | F | Ab | | | |
| 15H | 30eH | 7b5 | C# | D | Eb | Ab | A | |
| 16H | b24H | dim | D | F | Ab | A | B | |
| 17H | 444H | aug | D | Gb | Bb | | | |
| 18H | 924H | dim7 | D | F | Ab | B | | |
| 19H | 044H | aug7 | D | Gb | | | | |
| 1aH | 604H | sus4 | D | A | Bb | | | |
| 1bH | 204H | 7sus4 | D | A | | | | |
| 1cH | 204H | 7sus4(9) | D | A | | | | |
| 1dH | 204H | 7sus4(9,O5) | D | A | | | | |
| 1eH | 204H | 7sus4(9,11,13) | D | A | | | | |
| 1fH | e44H | add9 | D | Gb | A | Bb | B | |
| 20H | e24H | madd9 | D | F | A | Bb | B | |
| 21H | 34aH | 7(b9) | C# | Eb | Gb | Ab | A | |
| 22H | 34eH | 7(#11) | C# | D | Eb | Gb | Ab | A |
| 23H | 14eH | 7(b13) | C# | D | Eb | Gb | Ab | |
| 24H | 24aH | 7(b9,13) | C# | Eb | Gb | A | | |
| 25H | 144H | 7(9,b13) | D | Gb | Ab | | | |
| 26H | 14aH | 7(b9,b13) | C# | Eb | Gb | Ab | | |
| 27H | 34aH | 7(#9) | C# | Eb | Gb | Ab | A | |
| 28H | 14aH | 7(#9,b13) | C# | Eb | Gb | Ab | | |
| 29H | 14aH | 7(b9,#9,b13) | C# | Eb | Gb | Ab | | |
| 2aH | 124H | m7b5(11) | D | F | Ab | | | |
| 2bH | 124H | m7b5(b13) | D | F | Ab | | | |
| 2cH | 124H | m7b5(11,b13) | D | F | Ab | | | |

FIG.59

| ADDRESSS | DATA | COMMENTS (CHORD TYPE) | (CHORD TONE PCS) | | | |
|---|---|---|---|---|---|---|
| 00H | 091H | maj | C | E | G | |
| 01H | 089H | m | C | Eb | G | |
| 02H | 491H | 7 | C | E | G | Bb |
| 03H | 489H | m7 | C | Eb | G | Bb |
| 04H | 891H | M7 | C | E | G | B |
| 05H | 889H | mM7 | C | Eb | G | B |
| 06H | 291H | 6 | C | E | G | A |
| 07H | 291H | 6(9) | C | E | G | A |
| 08H | 289H | m6 | C | Eb | G | A |
| 09H | 289H | m6(9) | C | Eb | G | A |
| 0aH | 891H | M7(9) | C | E | G | B |
| 0bH | 891H | M7(9,O3) | C | E | G | B |
| 0cH | 891H | M7(9, #11) | C | E | G | B |
| 0dH | 491H | 7(9) | C | E | G | Bb |
| 0eH | 489H | m7(9) | C | Eb | G | Bb |
| 0fH | 489H | m7(11) | C | Eb | G | Bb |
| 10H | 489H | m7(9,11) | C | Eb | G | Bb |
| 11H | 489H | m7(9,11,O5) | C | Eb | G | Bb |
| 12H | 491H | 7(13) | C | E | G | Bb |
| 13H | 491H | 7(9,13) | C | E | G | Bb |
| 14H | 449H | m7b5 | C | Eb | Gb | Bb |
| 15H | 451H | 7b5 | C | E | Gb | Bb |
| 16H | 049H | dim | C | Eb | Gb | |
| 17H | 111H | aug | C | E | Ab | |
| 18H | 249H | dim7 | C | Eb | Gb | A |
| 19H | 511H | aug7 | C | E | Ab | Bb |
| 1aH | 0a1H | sus4 | C | F | G | |
| 1bH | 4a1H | 7sus4 | C | F | G | Bb |
| 1cH | 4a1H | 7sus4(9) | C | F | G | Bb |
| 1dH | 4a1H | 7sus4(9,O5) | C | F | G | Bb |
| 1eH | 4a1H | 7sus4(9,11,13) | C | F | G | Bb |
| 1fH | 091H | add9 | C | E | G | |
| 20H | 089H | madd9 | C | Eb | G | |
| 21H | 491H | 7(b9) | C | E | G | Bb |
| 22H | 491H | 7(#11) | C | E | G | Bb |
| 23H | 491H | 7(b13) | C | E | G | Bb |
| 24H | 491H | 7(b9,13) | C | E | G | Bb |
| 25H | 491H | 7(b9,b13) | C | E | G | Bb |
| 26H | 491H | 7(#9) | C | E | G | Bb |
| 27H | 491H | 7(#9,b13) | C | E | G | Bb |
| 28H | 491H | 7(b9,#9,b13) | C | E | G | Bb |
| 29H | 449H | m7b5(11) | C | Eb | Gb | Bb |
| 2aH | 449H | m7b5(b13) | C | Eb | Gb | Bb |
| 2bH | 449H | m7b5(11,b13) | C | Eb | Gb | Bb |
| 2cH | 081H | (O3) | C | G | | |

FIG.60 mpDB : START ADDRESS OF melp[ ]

melp[ ] : HEADER OF MELODY PATTERN RULE BASE melp[ix2+0] : POINTER TO i-TH MELODY PATTERN RULE melp[ix2+1] : PRESENCE/ABSENCE OF SUCCEEDING MELODY PATTERN RULE fNote[ ] : ABSTRACT NOTE PATTERN (MELODY PATTERN RB PROPER)

ELEMENTS OF fNote

| NTYPE | ITYPED | ITYPEM | NEXT |
|---|---|---|---|
| 0 | 1 | 2 | 3 |

fNote[4xi+NTYPE] : NOTE TYPE fNote[4xi+ITYPED] : DIRECTION OF MOTION (PITCH INTERUAL)

fNote[4xi+ITYPEM] : DISTANCE OF MOTION fNote[4xi+NEXT] : POINTER TO NEXT fNote

Melody : START ADDRESS OF MELODY MEMORY

Note[ ] : MELODY NOTE SUCCESSION (MELODY MEMORY PROPER)

ELEMENTS OF MELODY NOTE "Note"

| NTYPE | ITYPED | ITYPEM | NEXT | PCLAS | OCT | DUR | DEC |
|---|---|---|---|---|---|---|---|
| 0 | 1 | 2 | 3 | 4 | 5 | 6 | 7 |

Note[ix8+NYTPE] : NOTE TYPE

Note[ix8+ITYPED] : DIRECTION OF MOTION

Note[ix8+ITYPEM] : DISTANCE OF MOTION

Note[ix8+NEXT] : POINTER TO NEXT NOTE

Note[ix8+PCLAS] : PITCH CLASS

Note[ix8+OCT] : OCTAVE

Note[ix8+DUR] : DURATION

Note[ix8+DEC] : TEST FLAG

Rate : SUITABILITY

OTHERS :

Th : SUITABILITY THRESHOLD ptrN,ptrS,ptrMP,ptrFN,pN,pFN etc : POINTERS

FIG. 61 mpDB

| | | |
|---|---|---|
| 00H | 0 | |

melP[ ]

| | | |
|---|---|---|
| 00H | 0 | POINTS TO MELODY PATTERN RULE #1 |
| 01H | 2 | |
| 02H | 12 | POINTS TO MELODY PATTERN RULE #2 |
| 03H | - 1 | |

fNote[ ]

| | | |
|---|---|---|
| 00H | "CHORD TONE" | MELODY PATTERN RULE #1 BEGINS |
| 01H | "+" | |
| 02H | "STEPWISE" | |
| 03H | 4 | |
| 04H | "SCALE NOTE" | |
| 05H | "+" | |
| 06H | "STEPWISE" | |
| 07H | 8 | |
| 08H | "CHORD TONE" | |
| 09H | * | |
| 0aH | * | |
| 0bH | - 1 | |
| 0cH | "CHORD TONE | MELODY PATTERN RULE #2 BEGINS |
| 0dH | "-" | |
| 0eH | "STEPWISE" | |
| 0fH | 4 | |
| 10H | "SCALE NOTE" | |
| 11H | "-" | |
| 12H | "STEPWISE" | |
| 13H | 8 | |
| 14H | "CHORD TONE" | |
| 15H | * | |
| 16H | * | |
| 17H | - 1 | |

FIG. 62 piece[ ] : PIECE MANAGEMENT POINTERS

| HEAD | CUR | TAIL | NEW | OBJ |
|---|---|---|---|---|
| 0 | 1 | 2 | 3 | 4 |

piece[HEAD] : FIRST PHRASE PTR piece[CUR] : CURRENT PHRASE PTR piece[TAIL] : LAST PHRASE PTR piece[NEW] : NEW PHRASE PTR piece[OBJ] : OBJECT PHRASE PTR sent[ ] : PHRASE DATA

| KEY | LENGTH | CHOPTR | MELPTR | RHYTHM | NEXT | PREV |
|---|---|---|---|---|---|---|
| 0 | 1 | 2 | 3 | 4 | 5 | 6 |

sent[7xi+KEY] : KEY(0~11)

sent[7xi+LENGTH] : LENGTH(1,2,4,8...)

sent[7xi+CHOPTR] : CP INDEX sent[7xi+MELPTR] : MELODY INDEX sent[7xi+RHYTHM] : HARMONIC RHYTHM INDEX sent[7xi+NEXT] : POINTER TO SUCCEEDING PHRASE sent[7xi+PREV] : POINTER TO PRECEDING PHRASE

FIG. 64

TECHNIQUE FOR SELECTING A CHORD PROGRESSION FOR A MELODY

BACKGROUND OF THE INVENTION

1. Field of the Invention

This invention generally relates to music apparatus. In particular, the invention is directed to efficient access to a desired chord progression, evaluating suitability between a chord progression and a melody, harmonizing a melody based on the suitability evaluating, and editing a chord progression of a music piece.

2. Description of the Prior Art

Chord progression apparatus which produce a musical chord progression are known in the art of electronic musical instruments or systems. The prior art chord progression apparatus are classified into two distinct categories. In the first category, chord progression apparatus makes a chord progression without any melody (i.e., before any melody is supplied). Thus, the chord progression apparatus in this group are primarily for those users who wish to compose a melody based on a chord or harmony progression (made by the apparatus). The first classified chord progression apparatus should be called "harmony first chord progression apparatus." Chord progression apparatus in the second category make a chord progression after a melody is given. The focus of the apparatus is to make a chord progression suitable for the given melody. Thus, the chord progression apparatus in the second group are helpful for those who have no or little knowledge of harmony. The best name of these apparatus may be "melody first chord progression apparatus" or "melody harmonizing apparatus."

A prior art chord progression apparatus of the harmony first type (disclosed in Japanese patent application laid open to public as Hei 1-262595, Oct. 19, 1989) applies Markov process to transitions from one chord to another. The chord transition table memory describes what chords are more likely or less likely to come after a chord. Probability values from the transition table are combined with random numbers generated by an electronic pseud random number generator to determine a succeeding chord. Repeating the process, the apparatus makes a chord progression (succession of chords) of any desired length. Because of the principles, the apparatus cannot hope to provide various kinds of chord progressions. Users of the apparatus cannot hope to get a desired chord progression in an efficient way.

Another prior art chord progression apparatus of the harmony first type is disclosed in U.S. patent application Ser. No. 07/411,541, filed Sep. 22, 1989 and assigned to the same assignee as the present application. The apparatus applies a theory of functional harmony to the making of a chord progression. According to the functional harmony theory, a chord progression can be analyzed as a chain of short function patterns, each element of which is one of the three functions: tonic (T), dominant (D) and subdominant (S). The apparatus has a function pattern file memory which stores a set of short function patterns, and a chord pattern file memory which stores a set of (root and type specified) chord patterns arranged in groups according to function patterns. In operation, to make (synthesize) a chord progression, the apparatus forms a chain of short function patterns and then converts each function pattern in the chain to a root and type specified chord pattern. Therefore, the apparatus is useful as an educational tool for learning the functional harmony theory. However, it has limited capability of producing practical chord progressions: practical chord progressions often include those chords having no harmonic function, as analysts of practical music point out. Therefore, users of the apparatus will find it difficult to get a desired chord progression which should be practical and real.

Prior art chord progression apparatus of the melody first type i.e., melody harmonizing apparatus are disclosed in Japanese patent application laid open to public as Sho 58-87593, May 25, 1983, and U.S. Pat. No. 4,539,882, Sep. 10, 1985.

Each apparatus relies on several inaccurate or unnecessary assumptions. Among them are (a) no change of key throughout a given melody, (b) diatonic scale notes (on a single key) occupy predominant proportion of a given melody, (c) particular tonal function of last melody notes, (d) no change of harmony (chord) within a bar (i.e., harmony can change only at a bar-line), and (e) harmonic tones (chord tones) always occupy predominant proportion of a melody even if it is a small melody segment as short as one bar. Based on the assumptions (a) to (c), each apparatus determines a single key of a given melody. According to the assumption (d), each apparatus subdivides a given melody into a plurality of small blocks (one-bar melody segments). Then, each apparatus successively determines chords for the melody segments, one chord after another in a forward direction from start to end of the given melody. To determine a chord for a succeeding bar melody segment, the apparatus of the Japanese patent application Sho 58-87593 matches the pitch collection of each chord candidate to that of the melody segment to compute a pitch similarity index for each chord candidate; this matching is based on the assumption (e). The apparatus looks up a statistical table which describes statistics of transitions between two chords. The pitch similarity indexes are combined with the statistical likelihood of chord transitions to determine a single chord for the succeeding melody segment. For the same purpose, the apparatus of U.S. Pat. No. 4,539,882 focuses on main note(s) in a succeeding bar melody segment: the main notes are defined by longest notes, which are presumed harmonic tones (see assumption (e) above). Then apparatus looks up a statistical table which describes transitions to main note(s) from a preceding chord, and returns a succeeding chord (which is used as the chord for the succeeding melody segment).

Each of the two apparatus has the following drawbacks: (A) it cannot control unit/variety balance of a chord progression for a given melody because each apparatus determines chords separately and singly for each melody segment, (B) harmonic rhythm is always made simple and primitive because of the assumption (d) above, (C) each apparatus cannot provide satisfactory harmonization of a melody without modulation, (D) chord progression is made up of diatonic chords only, and (E) each apparatus is inapplicable to the making of a chord progression without a melody.

Another prior art melody harmonization apparatus is disclosed in U.S. Pat. No. 4,951,544, issued on Aug. 28, 1990 to J. Minamitaka (present inventor) and assigned to the same assignee as the present application. The apparatus determines available chords as many as there are for each segment (e.g., bar) of a given melody. To this end, the apparatus scans a set of chord candidates. Each chord candidate is tentatively assumed available for a melody segment of interest. Then melody tones in the melody segment are analyzed and identified in a forward reasoning by exploring a network of stored musical knowledge of classifying melody tone functions while checking local melodic waves. The reasoning continues either until a counterexample of the tentative assumption is found or until verification of the assumption has been made as the case may be. The associated chord candidate is determined available in the latter case and unavailable in the former case. By repeating the available chord determining process for each segment of a given melody, the apparatus forms a two dimensional array of available chord progressions for the entire melody. Then, the apparatus selects chords from the array, one for each melody segment in accordance with tonality-based selection criteria.

While the apparatus overcomes or ameliorates some disadvantages of the two prior harmonizing apparatus mentioned earlier, it still has problems to be solved: (P1) the apparatus is designed for the melody harmonizing application only, (P2) selection of chords is made one by one, thus limiting real harmonization capabilities, and (P3) harmonic rhythm is made simple, or less active.

In summary, no prior art chord progression apparatus provide a convenient environment in which users can easily get the desired chord progression. None of the prior art chord progression apparatus is applicable to both tasks of melody harmonization and making of a chord progression without a melody. No prior art apparatus are so helpful as the invention for those users having insufficient musical knowledge or experience to compose a music piece. No prior art chord progression apparatus have capability of editing a chord progression of a music piece to aid user's music compostion. No prior art melody harmonization apparatus take a chord progression (rather than a chord) as an integrated and coherent entity or unit for harmonizing a melody, apply a chord progression for one time to a relatively long melody segment (i.e., phrase), or test suitability of a chord progression candidate for a phrase melody based on stored musical knowledge of melodies.

These problems are successfully overcome by the invention, as will be understood from the following description.

SUMMARY OF THE INVENTION

In accordance with an aspect of the invention, there is provided an apparatus for selecting a chord progression which comprises chord progression database means for storing a database of chord progressions, localizing means responsive to user's commands for localizing those chord progressions of the chord progression database means that are favored by the user, chord progression selecting means responsive to a user's command for selecting a chord progression from the chord progression database means based on localization by the localizing means, whereby the apparatus allows the user to gain efficient access to a desired chord progression.

The chord progression database means may contain a large collection of chord progressions with various kinds of harmonic rhythm and pitch contents, each practical and real. Some chord progressions have a simple harmonic rhythm, and some have very active harmonic changes. Some chord progressions are suitable for certain musical styles and some suitable for other musical styles.

The localizing means provides a virtual space of chord progressions preselected from the database in accordance with user's musical tastes and/or intentions. The virtual space can be made much smaller than the whole (and real) space of the database. If a user searched directly through the database space for a desired chord progression, it would require a great, even painstaking amount of time, particularly when the database space is vast. In the limited space of preselected chord progressions set up by the localizing means the user will easily find a desired chord progression.

The localizing means may comprise chain table means for storing a chain of pointers each indexing a different chord progression in the chord progression database means, and chain table modifying means for modifying the chain table means in accordance with user's commands to set up a desired chain of pointers in the chain table means.

In the chain (modified by the chain table modifying means), those chord progressions of user's interest are virtually localized.

Another aspect of the invention provides an apparatus for producing a chord progression of a music piece which comprises chord progression database means for storing a database of chord progressions, selecting means for selecting a plurality of chord progressions from the chord progression database means, and editing means for electronically editing the selected plurality of chord progressions in accordance with user's commands to produce an edited complete chord progression of a music piece.

with this arrangement, the user may select desired chord progressions from the database for respective parts of a complete chord progression of a music piece. The complete chord progression is produced by electronically editing the selected chord progressions from the database in accordance with user's commands. Therefore, no substantial musical knowledge is required on the user's part. Nevertheless, by the aid of the apparatus, the user can easily make a desired complete chord progression of a music piece.

All parts of the complete chord progression are not necessarily selected from the database; some parts may be supplied by a user from a chord progression input device.

The editing means may comprise sequencing means for variably connecting chord progressions selected by the selecting means so that the selected chord progressions are put together in a desired sequence to form at least part of the complete chord progression of the music piece.

The CP (chord progression) editing feature of the invention may be combined with the CP localizing feature. A combination will lead to an apparatus for producing a chord progression of a music piece which comprises chord progression database means for storing a database of chord progressions, chain table means for storing a chain of pointers each indexing a different chord progression in the chord progression database means, chain table modifying means for modifying the chain table means in accordance with user's commands to set up a desired chain of pointers in the chain table means, chord progression selecting means responsive to user's commands for selecting a plurality of chord progressions from the chord progression database means based on the desired chain of pointers set up in the chain table means, and editing means for electronically editing the selected plurality of chord progressions in accordance with user's commands to produce an edited chord progression of a music piece.

A further aspect of the invention provides an apparatus for producing a chord progression of a music piece which comprises musical form defining means for defining a form of a music piece by a chain of phrases, phrase attribute setting means for setting desired attributes of a phrase in the chain, database means for storing a database of chord progressions, candidate selecting means for selecting chord progressions from the database means, each as a chord progression candidate of the phrase in the chain, candidate testing means responsive to the candidate selecting means for testing each chord progression candidate for its attributes to find a chord progression candidate, attributes of which are consistent with the desired attributes of the phrase in the chain, the found chord progression candidate defining a chord progression of the phrase in the chain, and repeating means for repeating operations of the phrase attribute setting means, the candidate selecting means and the candidate testing means with respect to each phrase in the chain to thereby produce a chord progression of the music piece.

This arrangement is very helpful for an unskilled user to get or make a desired chord progression of a music piece. With this arrangement, the user can easily construct a music piece chord progression by a chain of phrase chord progressions, each selected from the database of practical chord progressions and well screened by the phrase attribute test.

The feature of the arrangement may be combined with the CP localizing feature of the invention. This results in an apparatus for producing a chord progression of a music piece which comprises musical form defining means for defining a form of a music piece by a chain of phrases, phrase attribute setting means for setting desired attributes of a phrase in the chain, database means for storing a database of chord progressions, chain table means for storing a chain of pointers each indexing a different chord progression in the database means, chain table modifying means for modifying the chain table means in accordance with user's commands to set up a desired chain of pointers in the chain table means, candidate selecting means for selecting, as chord progression candidates of the phrase in the chain, chord progressions from the database means based on the desired chain of pointers set up in the chain table means, candidate testing means responsive to the candidate selecting means for testing each chord progression candidate for its attributes to find a chord progression candidate, attributes of which are consistent with the desired attributes of the phrase in the chain, the found chord progression candidate defining a chord progression of the phrase in the chain, and repeating means for repeating operations of the phrase attribute setting means, the candidate selecting means and the candidate testing means with respect to each phrase in the chain to thereby produce a chord progression of the music piece.

The apparatus may further comprise chain editing means for electronically editing the chain of phrases in accordance with user's commands to obtain a desired chain of phrases.

The phrase attribute setting means may comprise means for getting a desired length of a phrase in the chain, and the candidate testing means may include means for finding a chord progression candidate that has the desired length.

The phrase attribute setting means further may comprise means for setting a desired harmonic rhythm of a phrase in the chain, and the candidate testing means may further comprise means for finding a chord progression candidate that has the desired harmonic rhythm.

The phrase attribute setting means may further comprise means for setting a desired key of a phrase in the chain, and the candidate testing means may further comprise transposing means for transposing a chord progression candidate from the candidate selecting means in accordance with the desired key.

A still further aspect of the invention provides an apparatus for evaluating suitability between a melody and a chord progression which comprises melody providing means for providing a melody, chord progression providing means for providing a chord progression, melody analyzing means for analyzing the melody based on the chord progression to obtain analyzed results, musical knowledge storage means for storing musical knowledge of melodies, and examining means for examining the analyzed results by using the musical knowledge to evaluate suitability between the melody and the chord progression.

This arrangement can apply equally to the two distinct types of chord progression apparatus; one for making a chord progression before a melody is added, and the other for harmonizing a melody given in advance. Moreover, this arrangement is also helpful to those who wish to think of a melody and its harmonization in an integrated mental process rather than separate or independent processes. A further advantage of this arrangement is that suitability is collectively examined between a chord progression and a melody (rather than repeatedly examined between a single chord and a short melody segment, as in the prior art) to thereby make it easier to maintain natural and real flow of the resultant chord progression and/or melody.

The features of the arrangement may be combined with the CP localizing feature of the invention. This will present an apparatus for evaluating suitability between a melody and a chord progression which comprises melody providing means for providing a melody, chord progression providing means for providing a chord progression, melody analyzing means for analyzing the melody based on the chord progression to obtain analyzed results, musical knowledge storage means for storing musical knowledge of melodies, and examining means for examining the analyzed results by using the musical knowledge to evaluate suitability between the melody and the chord progression, and wherein the chord progression providing means comprises chord progression database means for storing a database of chord progressions, chain table means for storing a chain of pointers each indexing a different chord progression in the chord progression database means, chain table modifying means for modifying the chain table means in accordance with user's commands to set up a desired chain of pointers in the chain table means, and chord progression selecting means for selecting a chord progression from the chord progression database means based on the desired chain of pointers set up in the chain table means.

In a preferred embodiment, the melody analyzing means obtains a pattern of note types and pitch intervals as the analyzed results of melody. To this end, it comprises coincident chord locating means for locating a coincident chord in the chord progression that corresponds in time to an individual note in the melody, pitch class set determining means for determining, from a key and the coincident chord, a pitch class set for each note type, note type identifying means for identifying a note type of each note in the melody according to the pitch class set for each note type, and interval evaluating means for evaluating a pitch interval between adjacent notes in the melody. The musical knowledge storage means comprises rule base means for storing a set of melody pattern rules each describing a pattern of note types and pitch intervals. The examining means comprises matching means for matching the analyzed results represented by a pattern of note types and pitch intervals to melody pattern rules in the set, and suitability computing means for computing suitability between the melody and the chord progression from results from the matching means.

Using the feature of evaluating suitability between a melody and a chord progression, the invention provides an apparatus for harmonizing a melody which comprises melody input means for inputting a melody, database means for storing a database of chord progressions, and searching means for searching through the database means for a chord progression suitable for the melody. The searching means comprises melody analyzing means for analyzing the melody based on a chord progression from the database means to obtain analyzed results, musical knowledge storage means for storing musical knowledge of melodies to obtain analyzed results and examining means for examining the analyzed results by using the musical knowledge to evaluate suitability between the melody and the chord progression.

The various features of the various apparatus described so far can advantageously be combined with one another in several ways in accordance with the invention.

For example, there is provided an apparatus for harmonizing a melody which comprises melody input means for inputting a melody having a plurality of segments, chord progression database means for storing a database of chord progressions, selecting means for selecting a plurality of chord progressions from the chord progression database means, each chord progression being suitable for a different segment of the melody, and editing means for electronically editing the selected plurality of chord progressions in accordance with user's commands to produce an edited complete chord progression of a music piece. The selecting means comprises searching means which searches through the chord progression database means for a chord progression suitable for each segment of the melody. The searching means comprises database managing means which manages the chord progression database means and comprising chain table means for storing a chain of pointers each indexing a different chord progression in the chord progression database means, chain table modifying means for modifying the chain table means in accordance with user's commands to set up a desired chain of pointers in the chain table means, and chord progression selecting means for selecting a chord progression from the chord progression database means based on the desired chain of pointers set up in the chain table means. The searching means further comprises melody analyzing means for analyzing a segment of the melody based on a chord progression selected by the chord progression selecting means to obtain analyzed results, musical knowledge storage means for storing musical knowledge of melodies, and examining means for examining the analyzed results by using the musical knowledge to evaluate suitability between the melody and the chord progression.

The editing means may comprise musical form defining means for defining a form of the music piece by an electronically editable chain of phrases and phrase attribute setting means for setting desired attributes of each phrase in the chain. The searching means may further comprise candidate testing means for receiving chord progressions from the chord progression database means by the database managing means, each as a chord progression candidate of a phrase in the chain and for testing each chord progression candidate for its attributes to find a chord progression candidate, attributes of which are consistent with the desired attributes of the phrase. The melody analyzing means analyzes a segment of the melody corresponding to the phrase in the chain based on the found chord progression candidate to obtain analyzed results.

BRIEF DESCRIPTION OF THE DRAWINGS

The above and other features and advantages of the invention will be more apparent from the following description taken in conjunction with the drawings in which:

FIG. 22 shows variables used in the apparatus of FIG. 20;

FIG. 54 illustrates music style ID data;

FIG. 55 illustrates bar length ID data;

FIG. 56 illustrates ID data of various note types;

FIG. 57 illustrates ID data of motion (pitch interval) directions;

FIG. 58 illustrates ID data of motion distances;

FIG. 59 illustrates a data set of standardized tension note pitch class set (PCS);

FIG. 60 illustrates a data set of standardized chord tone PCS;

FIG. 61 illustrates variables and constants used in the apparatus of FIG. 53;

FIG. 62 illustrates a melody pattern rule base;

FIG. 64 illustrates music structuring data;

DETAILED DESCRIPTION OF THE PREFERRED EMBODIMENTS

The detailed description begins with a chord progression (CP) selecting feature of the invention which enables a user to easily get a desired chord progression from CPDB having a vast space of chord progressions. The description then takes up a music piece CP producing feature of the invention which electronically edits a chain of phrases into a desired music piece and uses the CP selecting feature to determine a chord progression of each phrase in the chain. Then the description focuses on a suitability evaluating feature of the invention which evaluates suitability between a melody and a chord progression based on stored musical knowledge of melodies. Then, a modified CP selecting apparatus is presented. Finally, the description takes up a music composition support system incorporating various features of the invention.

<CP Selecting Feature >

Figure 1:
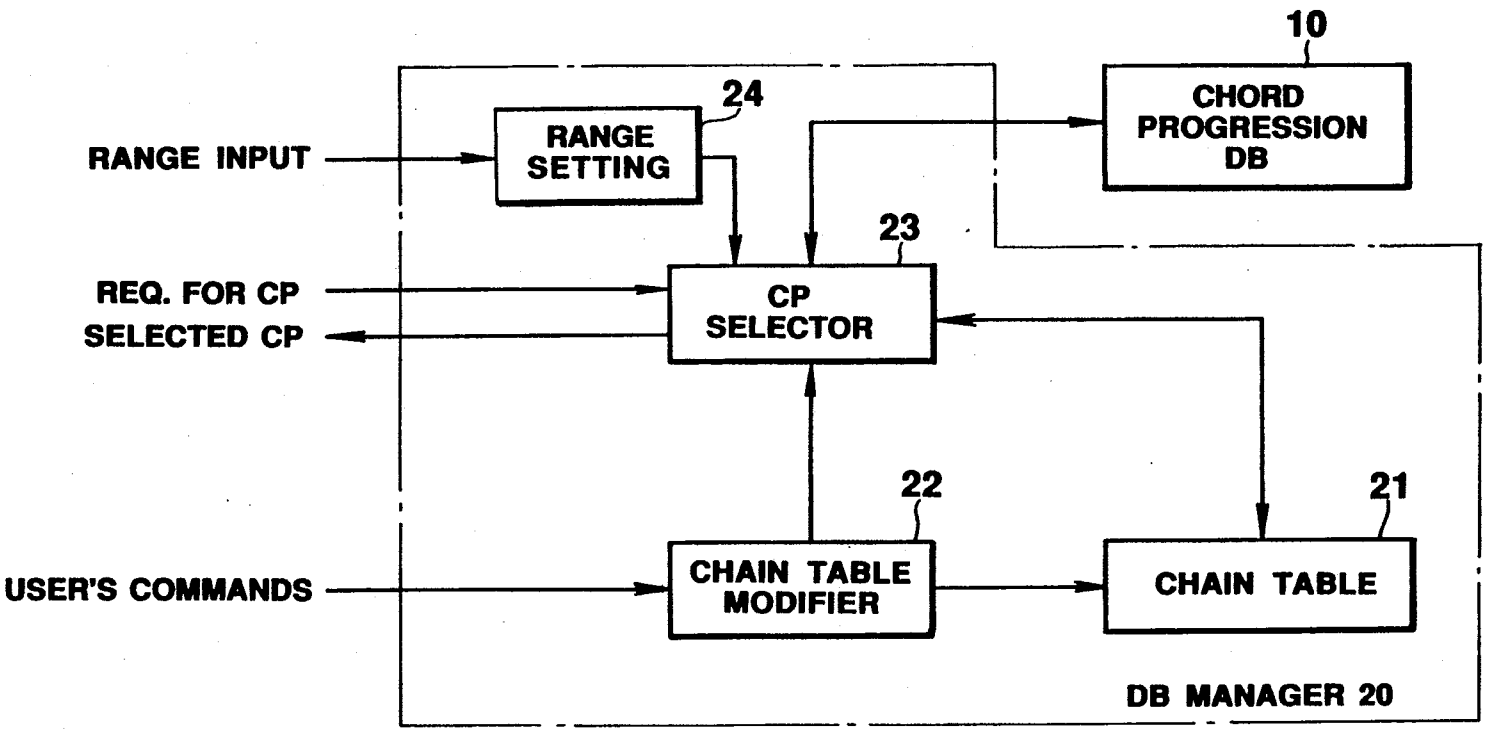
FIG. 1 is a functional block diagram of a chord progression (CP) selecting apparatus in accordance with the invention.
Figure 2:
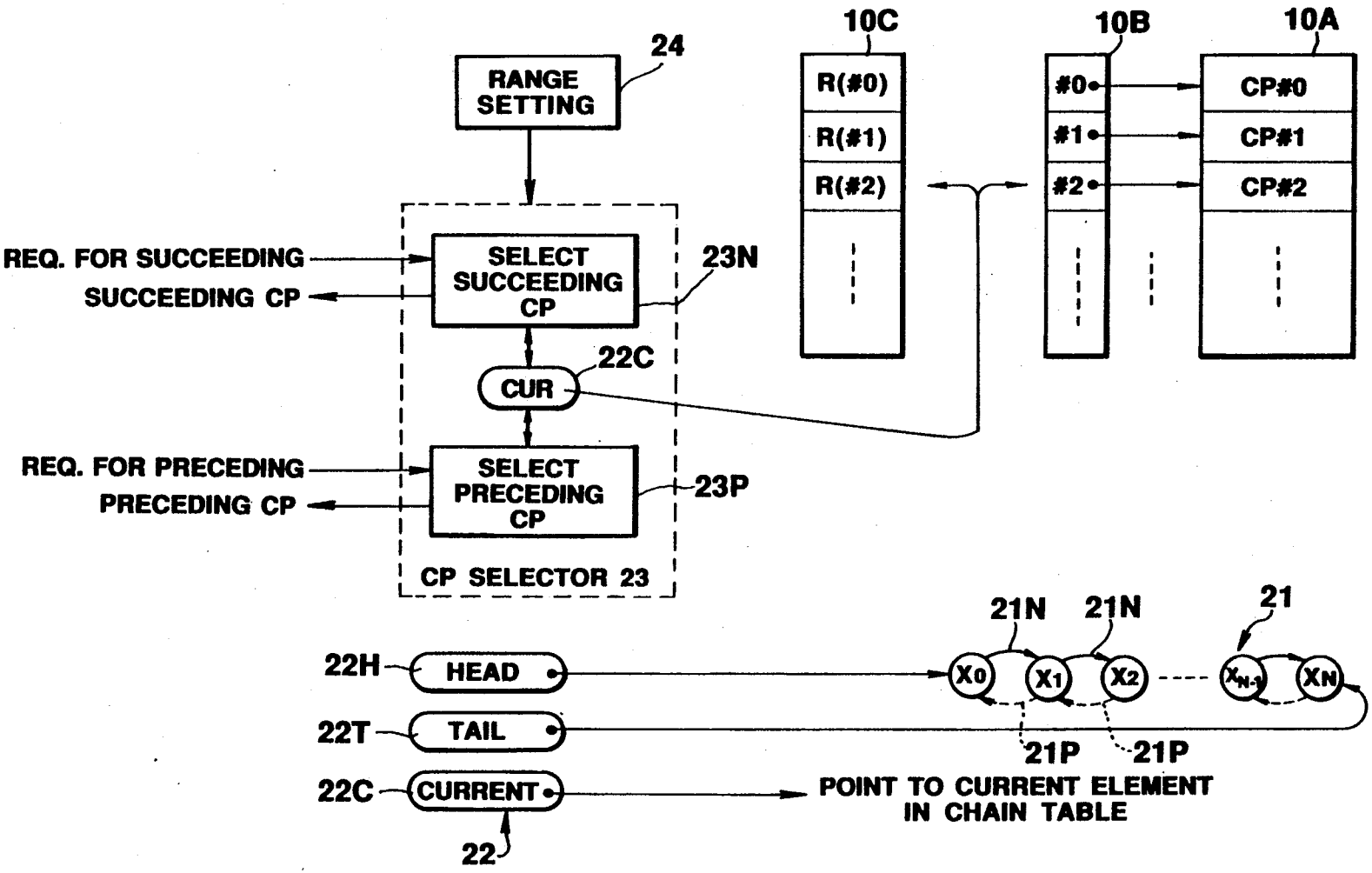
FIG. 2 illustrates the data structure of the CP selecting apparatus in FIG. 1.

FIG. 1 shows a functional diagram of a chord progression (CP) selecting apparatus in accordance with the invention. FIG. 2 illustrates data structures of the apparatus. A chord progression database (CPDB) 10 stores a collection of multiple chord progressions. A database (DB) manager 20 provides a convenient user-interface by which a user can easily get a desired chord progression from CPDB 10. A chain tabel 21 in the DB manager 20 stores a chain of pointers each uniquely indexing a different chord progression in the database 10. A chain table modifier 22 in the DB manager 20 modifies the chain table 21 in accordance with user's commands to set up a desired chain in the chain table 21. Once a desired chain has been established in the chain table 21, a user can easily obtain a desired chord progression from CPDB 10 by means of a chord progression selecting module 23 in the DB manager. To this end, CP selecting module 23 receives from the chain table modifier 22 data for managing the chain table 21. In response to a user's request for CP, the CP selector 23 looks up the chain table 21, gets a pointer indexing a requested chord progression, and uses the pointer to select (retrieve) the chord progression from the database 10.

Preferably the chord progression database 10 contains a large collection of chord progressions with various kinds of musical style and harmonic rhythm, and each practical and real. Also a user may wish to get a chord progression which matches the style of his or her intended music. Taking these into consideration, the apparatus of FIG. 1 receives a range or style input from the user and stores it into a range setting memory 24. The chord progression database 10 contains additional records of style or range index associated with respective stored chord progressions. The CP selector 23 retrieves from CPDB 10, a chord progression, style (range) index of which is consistent with the desired music style (i.e., which falls within the range input and stored in the memory 24).

The components of the apparatus shown in FIG. 1 may have several forms of data structure. An example is shown in FIG. 2.

In FIG. 2, the chain table 21 includes a plurality of CP pointers designated $X_0, X_1, X_2, \ldots X_{N-1}, X_N$. Each pointer (node) has a forward link 21N to a succeeding node and a backward link 21P to a preceding node. For example, the node $X_1$ has a forward link $21_N$ to the node $X_2$, and a backward link 21P to the node $X_0$. These links form a chain of CP pointers $X_0, X_1, X_2, \ldots X_{N-1}, X_N$ in which $X_0$ denotes the head (first) pointer and $X_N$ denotes the tail (last) pointer.

To manage the pointer chain in the chain table 21, the chain table modifier 22 uses a head pointer 22H, tail pointer 22C, and current pointer 22C. The head pointer 22H indexes the first node $X_0$ in the chain. The tail pointer 22T indexes the last node $X_N$. The current pointer locates a current element in the chain. Using these pointers 22H, 22T and 22C, the chain table modifier 22 can change the sequence or chain of the elements of the chain table 21. For example, to put the element $X_1$ on head (top) of the chain, the modifier 22 changes the illustrated chain table 21 such that the forward link of the element $X_1$ points to the element $X_0$, backward link of the element $X_0$ points to the element $X_1$, the forward link of the element $X_0$ points to the element $X_2$, and the backward link of the element $5X_2$ points to the element $X_0$. Further, the chain table modifier 22 changes the head pointer 22H so as to index the element X1. Now the chain begins with $X_1$ followed by $X_0$ followed by $X_2$ etc. The chain table modifier 22 executes such chain modifying operations in accordance with user's commands (e.g., "put it on top") to thereby form a desired chain of CP pointers in the chain table 21.

In the alternative, the chain table may be realized on contiguous storage locations without the links between nodes such that each storage location stores a CP pointer indexing a chord progression in CPDB 10, and the first storage location serves as the head (first node) of the chain, the second location as the second node of the chain, the third location as the third node of the chain and so on.

In FIG. 2, the chord progression database 10 is made up of a database main 10A, a pointer table 10B and a range (style index) table 10C. The database main 10A stores multiple chord progressions, each indexed by a different one of the elements of the pointer table 10B. For example, the top element #0 of the pointer table 10B points to chord progression #0 in the database main 10A. The range table 10C stores range indexes (style indexes) each indicative of the style or range of a corresponding chord progression in the database main 10A. In operation, the CP selecting module 23 retrieves from the database main 10A those chord progression, range index of which falls within the desired range input stored in the range memory 24.

According to these data structures, each link of an element (node) of the chain table 21 and each of the chain managing pointers 22H, 22T and 22C of the chain modifier 22 uniquely indexes a particular element of the pointer table 10B of the chord progression database 10.

The CP selecting module 23 illustrates in FIG. 2 comprises a succeeding CP selector 23N and a preceding CP selector 23P. Each CP selector 23N, 23P updates the current pointer 22C in response to a user's CP request and retrieves from CPDB 10 a chord progression, style index of which is consistent with the desired style prestored in the range memory 24. Specifically, the succeeding CP selector 23 operates as follows in response to a user's request for succeeding CP. Using the current pointer 22C, the succeeding CP selector 23N accesses the element (node) of the chain table 21 specified by the current pointer 23C, reads the forward link 21N of that element and updates the current pointer 22C to the forward link read. Then, using the updated current pointer 22C, the succeeding CP selector 23N accesses a corresponding element of the range table 10C of CPDB 10 to examine whether the accessed range matches the desired range in the range setting memory 24. If not matched, the succeeding CP selector 23N looks up again the chain table 21, further updates the current pointer 22C and accesses the range table 10C by the further updated pointer 22C. If the accessed range falls within the desired range, the succeeding CP selector uses the current pointer 22C to access an element of the pointer table 10B, specified by the pointer 22C. Using that element of the pointer table 10B, the succeeding CP selector 23N retrieves from the database main 10A a chord progression pointed to by that element, thus selecting a succeeding chord progression requested by the user. The preceding CP selector 23P similarly operates in response to a user's request for preceding CP. It looks up the chain table 21, updates the current pointer 22C to the looked-up forward link indexing a preceding CP, uses the updated current pointer 22C to access the range table to find a preceding CP, range of which falls within the desired range.

Without the CP selectors, it would take a great amount of time for a user to search out a desired chord progression from the chord progression database 10 particularly when the database 10 contains a large number of chord progressions. With the present CP selecting apparatus, the user can pre-localize interesting chord progressions in a modest number within the chain table 21 under the control of the chain table modifier 22. Afterwards, the user does not have to search any longer through the extensive space of the database 10 but to simply glance over the localized space established by the chain table modifier 22 to select a desired chord progression. The apparatus thus achieves a high efficient access to a desired chord progression.

Figure 3:
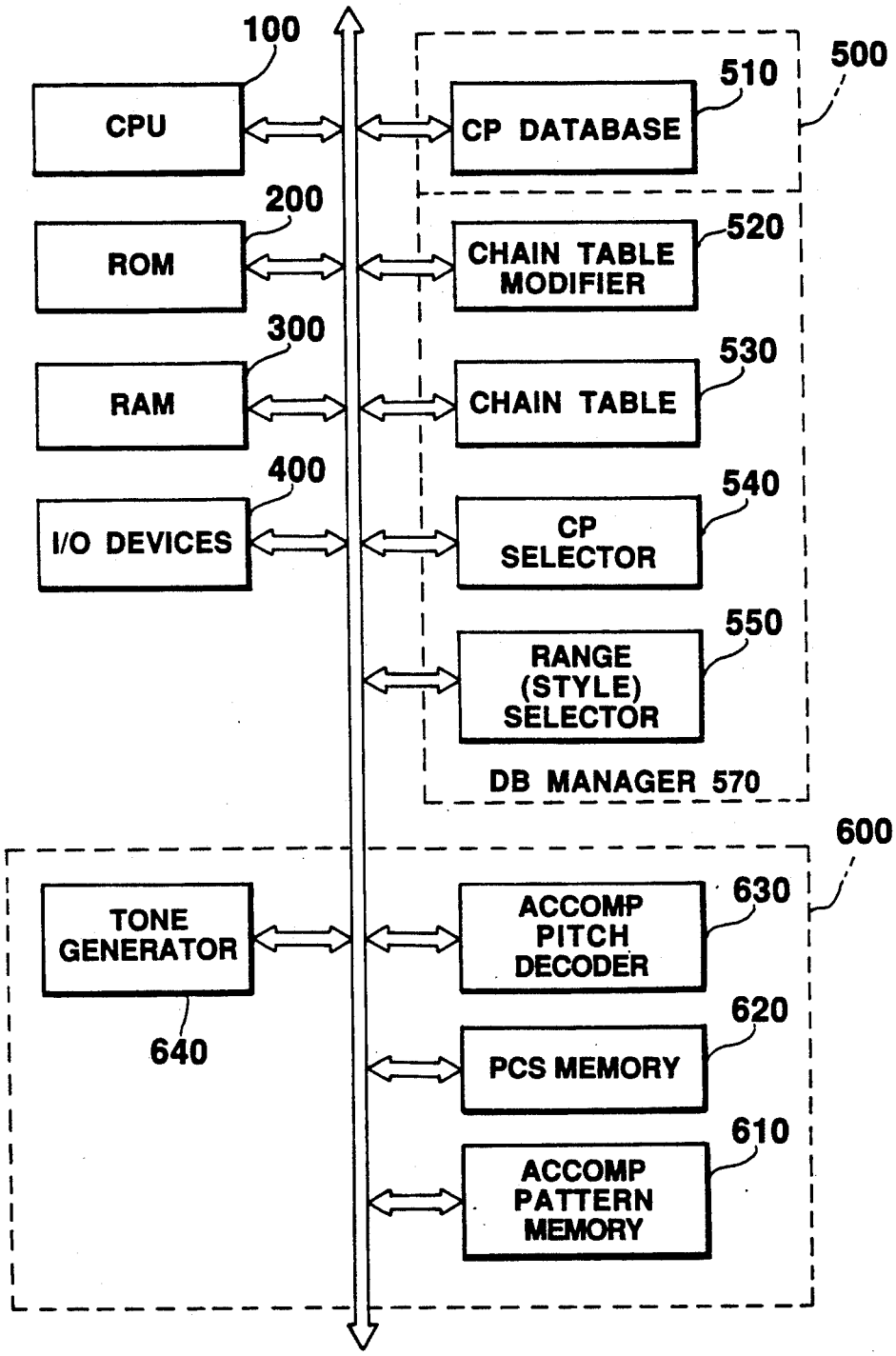
FIG. 3 is a block diagram of a computer-based music apparatus incorporating the CP selecting feature of the invention.

FIG. 3 shows a block diagram of a computer-based music apparatus incorporating the CP selecting feature of the invention, such as described in connection with FIGS. 1 and 2. The microcomputer-based music apparatus basically comprises, as computer resources, a CPU100, ROM200 for storing programs and permanent (constant) data, RAM200 as a working memory of CPU100, and input and output (I/O) devices 400. FIG. 3 also shows a CP selecting apparatus 500 and an accompaniment apparatus 600 to clarify features of the music apparatus of FIG. 3. The CP selecting apparatus 500 comprises a chord progression database (CPDB) 510, chain table editor or modifier 520, chain table 530, CP selector 540 and range (style) selector 550. The accompaniment apparatus 600 forms and plays a musical accompaniment based on a chord progression selected by the CP selecting apparatus 500. The accompaniment block 600 includes an accompaniment pattern memory 610, pitch class set (PCS) memory 620, accompaniment pitch decoder 630 and an electronically operated tone generator 640. Actually, respective components of the blocks 500 and 600 are implemented by at least one of the computer resources mentioned above, as is obvious to those skilled in the art. For example, CPDB 510 can be realized on part of the ROM200.

Figures 4, 5:
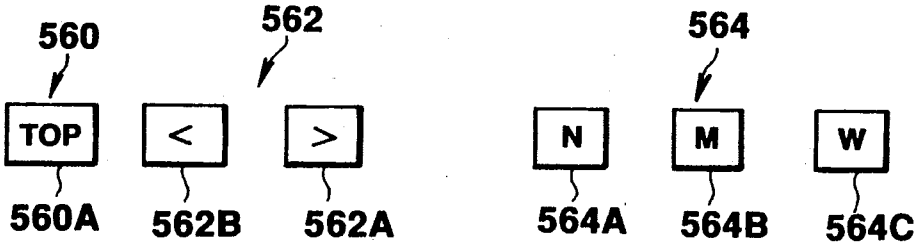
FIG. 4 shows input devices of the apparatus in FIG. 3.
FIG. 5 shows variables used in the apparatus of FIG. 3.

FIG. 4 shows input devices for use with the CP selecting apparatus 500. The input devices include a chain edit input device 560 for inputting chain editing commands, a CP select input device 562 for requesting CP selection, and a range input device 564 for setting a desired range (style) of CP. In the illustration shown in FIG. 4, the chain edit input device 560 takes the form of a top key 560A. CP select input device 562 comprises a forward shift key 562A and a backward shift key 562B. The range input device 564 is made up of N (narrow range) key 564A, M (middle range) key 564B and W (wide range) key 564C. The top key 560A is used to put an element of the chain table on its top. The forward key 562A is used to request a succeeding chord progression (select a succeeding chain element). The backward key 562B is used to request a preceding chord progression (select a preceding chain element). N key 564A is used to select a narrow range of CPDB. M key 564B is for selecting a middle or medium range of CPDB, and W key 564C for selecting a wide range of CPDB.

FIG. 5 shows a main variable list used in the musical apparatus of FIG. 3. A variable or array cpdb[ ]indicates a header of the chain table and simulteneously indicates a header of CPDB. The array is made up of three elements cpdb[0], cpdb[1] and cpdb[2] in which cpdb[0] points to the head element (top) of the chain table, cpdb[1] indexes the current element of the chain, and cpdb[2] points to the last element (tail) of the chain. These variables or registers cpdb[0], cpdb[1] and cpdb[2] correspond to the head pointer 22H, current pointer 22C and tail pointer 22T in FIG. 2, respectively. In effect, cpdb[0] points to a chord progression in CPDB, called by the head or top CP, cpdb[1] points to a chord progression in CPDB, called by the current CP and cpdb[2] indexes a chord progression in CPDB, called by the tail or last CP. An array chain [ ] defines the chain table. A variable "range" indicates a selected range (style).

Figures 6, 7:
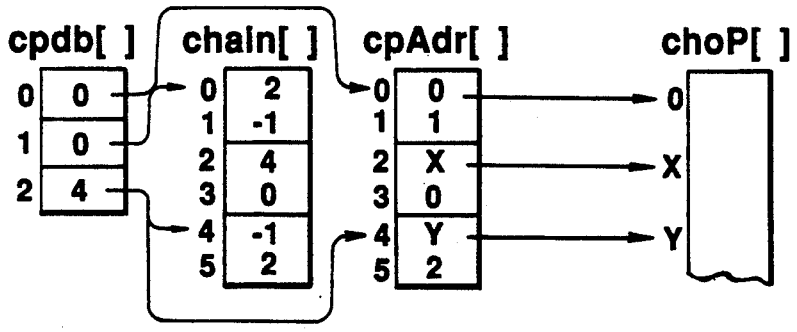
FIG. 6 shows constants used in the apparatus of FIG. 3.
FIG. 7 illustrates CP localizing data.

FIG. 6 shows a main constant list. An array or memory cpAdr[ ] forms the CP pointer and style index table. An array choP[ ] defines CPDB (main).

FIG. 7 shows a data example. The illustrated data structure is such that each element of the array cpdb[ ] points to a particular element (head, current, top) of the chain table chain [ ] and at the same time points to a particular element of the cp pointer and range index table cpAdr[ ]. The memory cpAdr[ ] stores at each even address a pointer for addressing a chord progression in CPDB choP[ ], and stores at the next odd address a range (style index) of that chord progression. For example, cpAdr[0] points to the first chord progression in CPDB choP[ ]. The range index of the first chord progression is stored at cpAdr[1] by data "1." Range index data "0", "1" and "2" indicates wide, medium and narrow ranges, respectively. The chain table memory chain [ ] takes a one dimensional, bidirectional list structure. Each element of the chain table occupies two adjacent storage locations, of which even location stores a forward link to the succeeding element of the chain table while odd location stores a backward link to the preceding element of the chain table. For example, the chain element occupying the addresses 2 and 3 has forward link data "4", stored at the address 2 and indexing its succeeding element in the chain, and backward link data "0", stored at the address 3 and indexing the preceding element of the chain table. Since the head element of the chain table has no preceding element, the address 1 of the head element stores data "−1" to indicate this. Similarly, the tail element of the chain has no succeeding element. This is indicated by data "−1" stored at the address 4 of the tail element.

Figure 8:
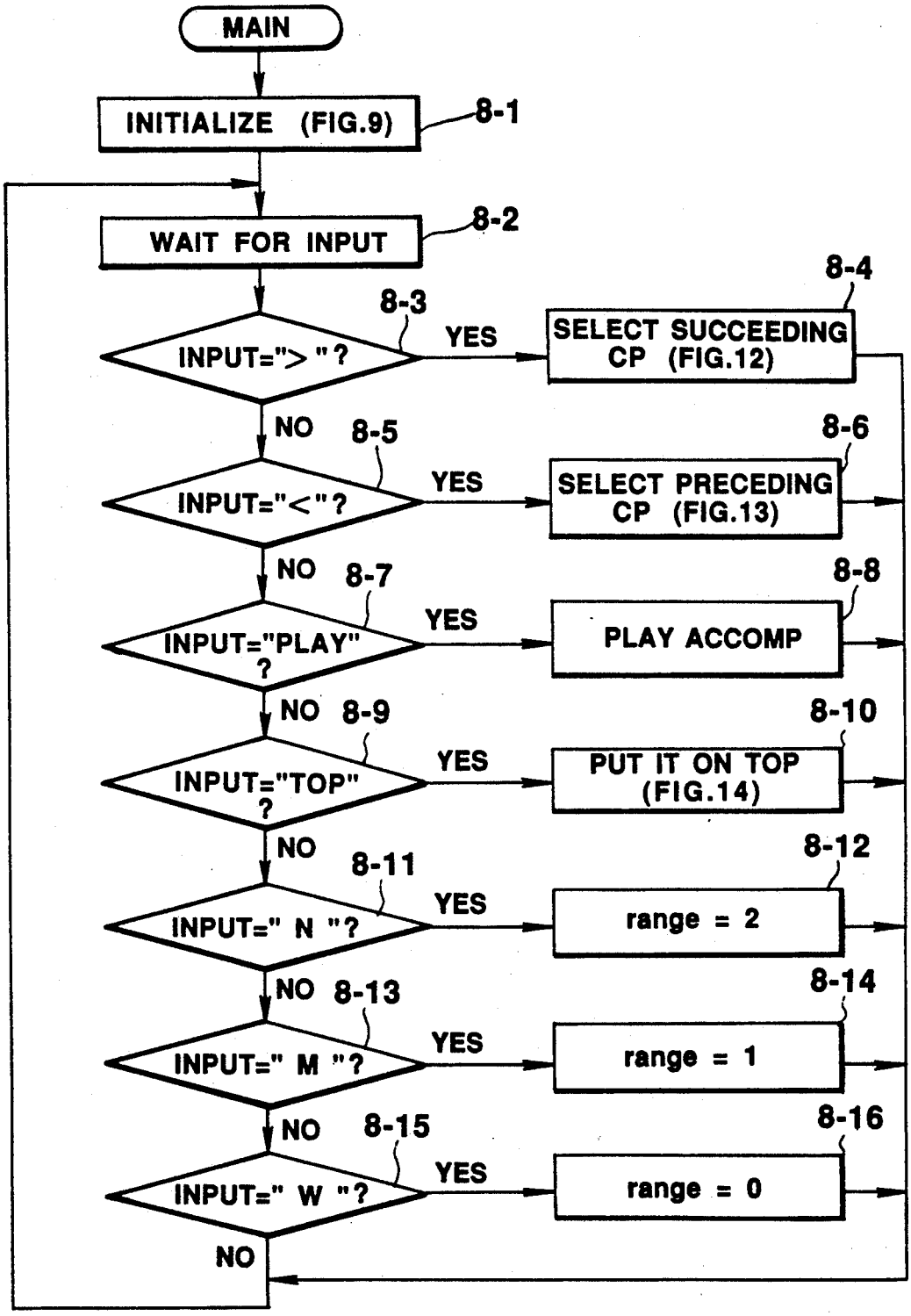
FIG. 8 shows a main flow chart of the apparatus in FIG. 3.

FIG. 8 shows a flow chart of a main program stored in ROM200 and executed by CPU100 of the music apparatus of FIG. 3. First, the main program initializes the system (8-1). Then, in the main loop, the program waits for an input from the input devices (8-2), and when detecting an input, it executes a corresponding routine (8-3 to 8-16). Specifically, when the forward key 562A of CP select input device 562 is depressed (8-3), a routine of select succeeding CP is executed (8-4). When the backward key 562B is operated (8-5), a select preceding CP routine is executed (8-6). When a play key (not shown in FIG. 4) is depressed (8-7), an accompaniment is performed based on the selected chord progression (8-8). For an input from the top key 560A (8-9), a put it on top routine is executed to place the current chain element on top of the chain table (8-10). In response to an operation of N key 564A, M key 564B and W key 564C (8-11, 8-13, 8-15), the range memory "range" is set to "2", "1" and "0" respectively (8-12, 8-14, 8-16).

Figure 9:
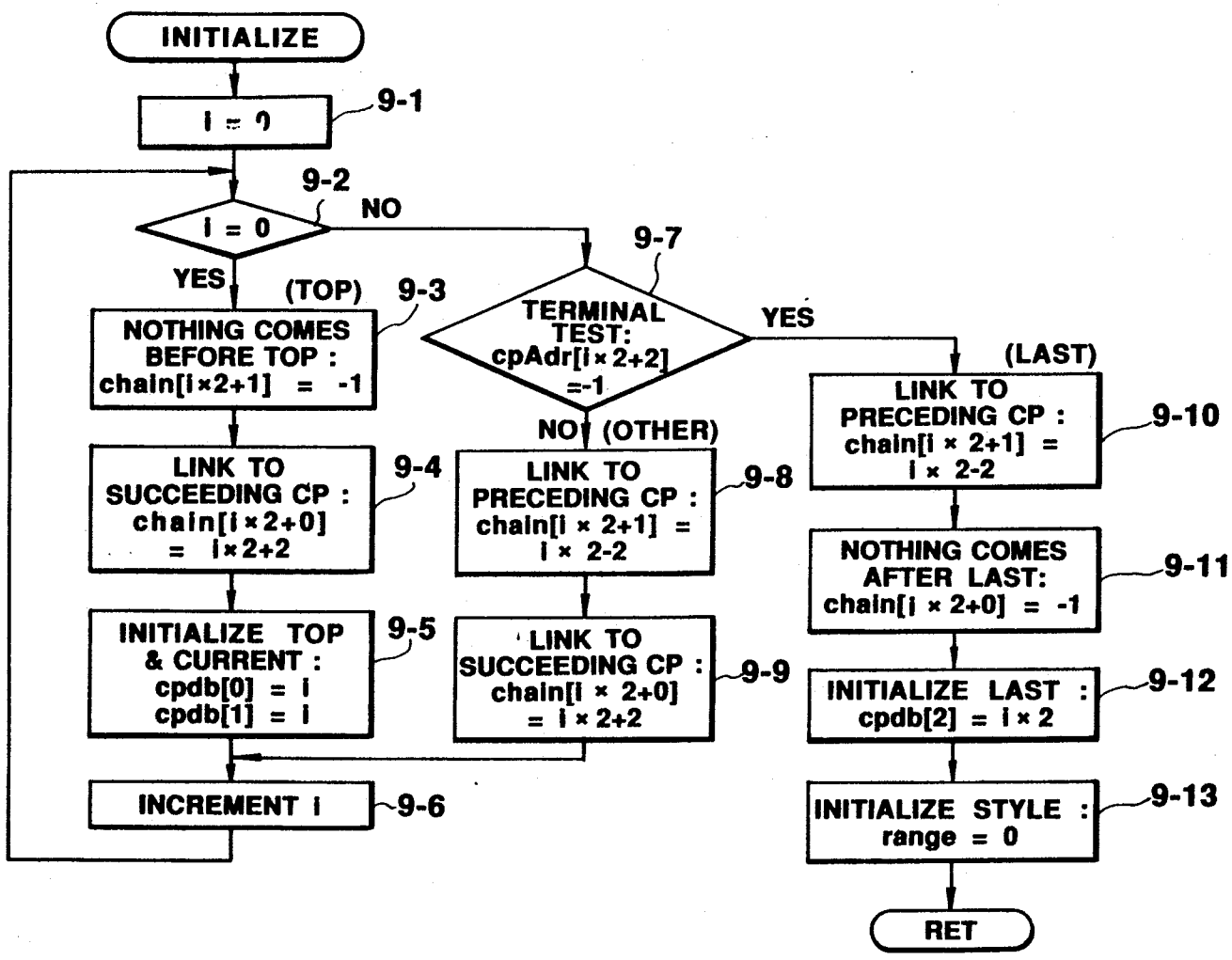
FIG. 9 is a flow chart of an initialize routine.

FIG. 9 shows details of the initialize routine 8-1 in FIG. 8. This routine includes initialization of the chain table chain[ ], chain table header cpdb[ ] and range data "range." According to the illustrated routine of 9-1 to 9-13, the chain table chain[ ] is initialized such that the top chain element of the chain table points to the first chord progression in the database choP[ ], the second chain element points to the second chord progression in the database, and so on until the tail chain element indexes the last chord progression in the database. The chain table managing header cpdb [ ] is initialized such that the head pointer cpdb[0] is set to "0" pointing to the first chord progression in the database choP[ ], the current pointer cpdb[1] is also set to "0", and the tail pointer cpdb[2] is set to the value pointing to the last chord progression in the database (9-5, 9-12). the range data "range" is initialized to "0" indicative of a wide range (9-13).

Figure 10:
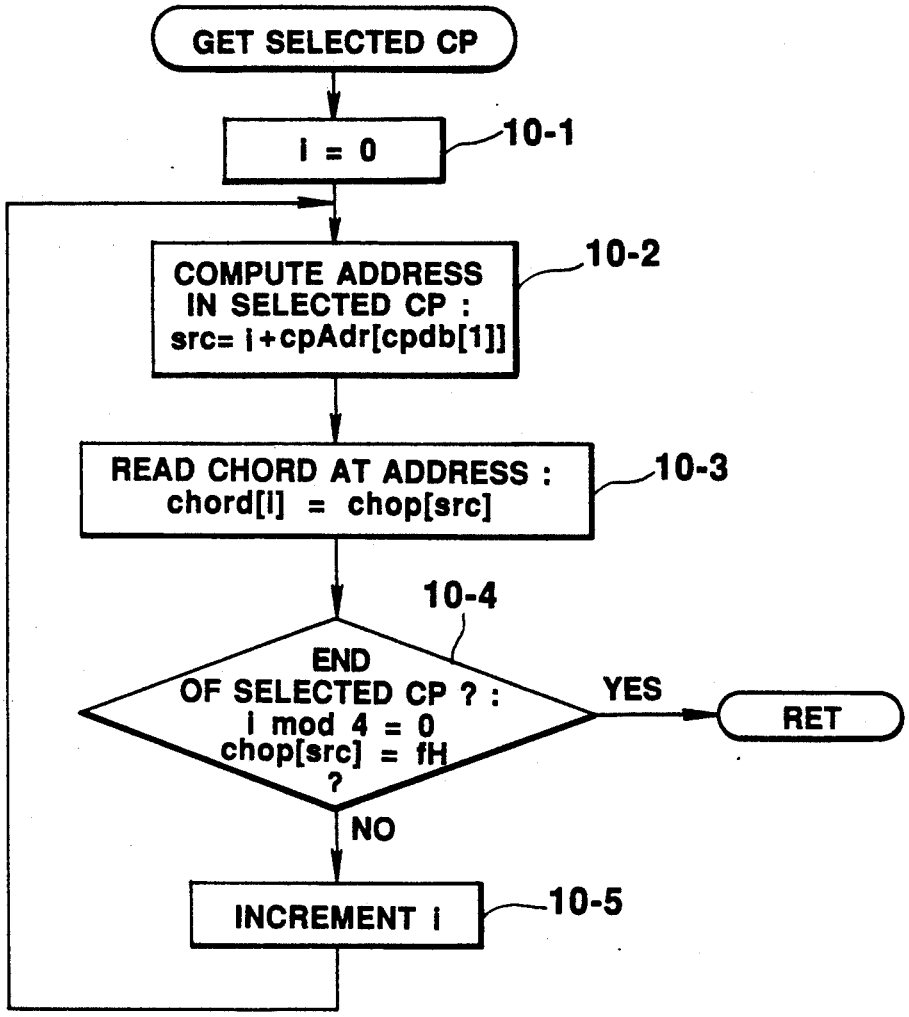
FIG. 10 is a flow chart of a get selected CP routine.

FIG. 10 is a flow chart of a get selected CP subroutine called by the play accompaniment routine 8-8 in FIG. 8.

Figure 11:
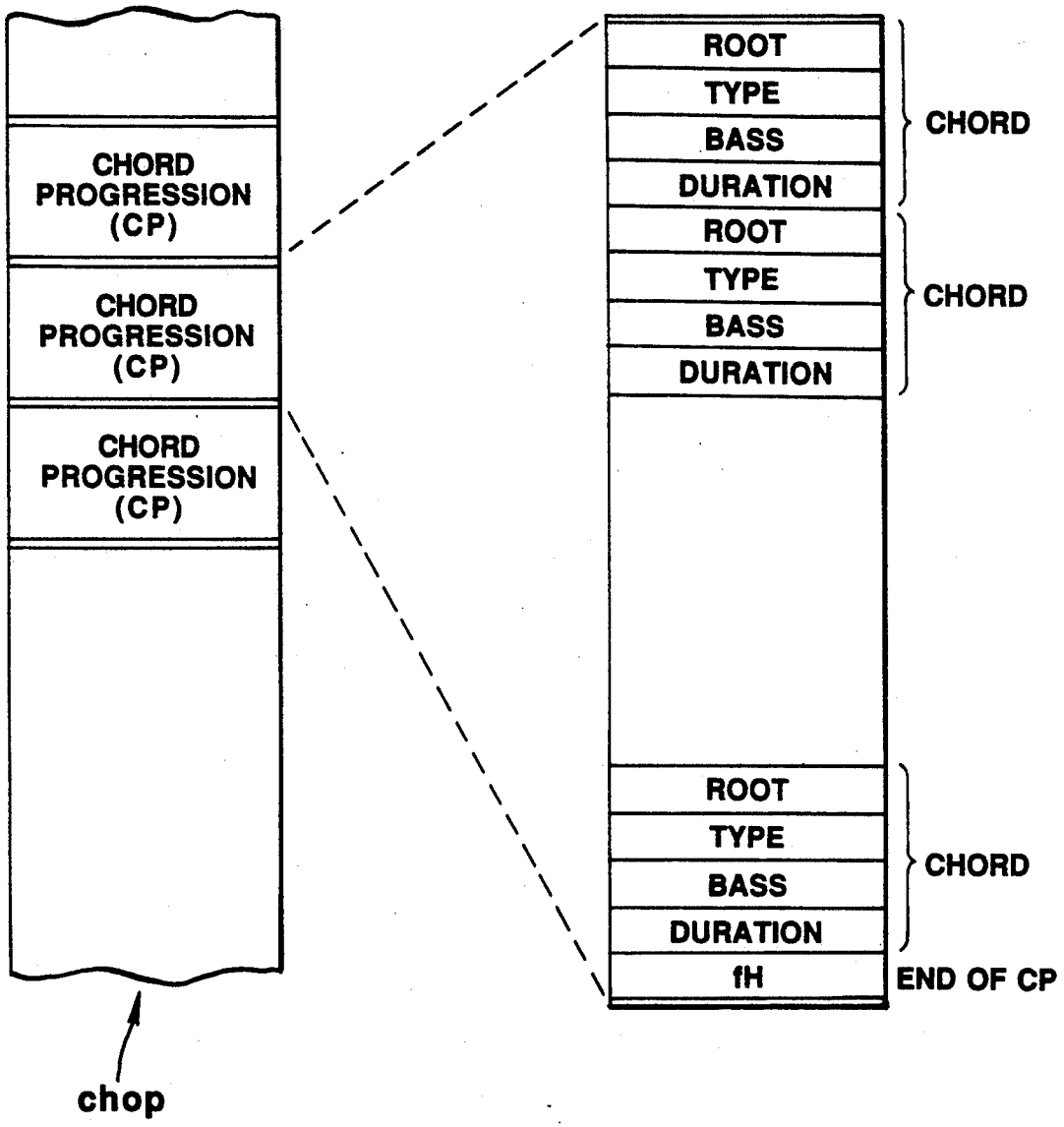
FIG. 11 shows a main portion of a CP database.

FIG. 11 illustrates a data structure of the chord progression database main choP[ ]. The database choP[ ] stores a multiplicity of chord progressions. Each chord progression is represented by a sequence of chords. Each chord is represented by root, type, bass and duration. An end-of-CP mark "fH" is stored at the end of each chord progression. The routine of 10-1 to 10-5 illustrated in FIG. 10 gets (reads) a chord progression selected by the CP selecting apparatus 500. The database index table element cpAdr[cpdb[1]], pointed to by the current pointer cpdb[1], stores the address of the storage location in the database choP[ ] where the selected chord progression begins. Thus, starting from this location, the get selected CP routine successively reads data into an array chord[ ] from the database choP[ ] until an end-of-CP mark "fH" is found.

Figure 12:
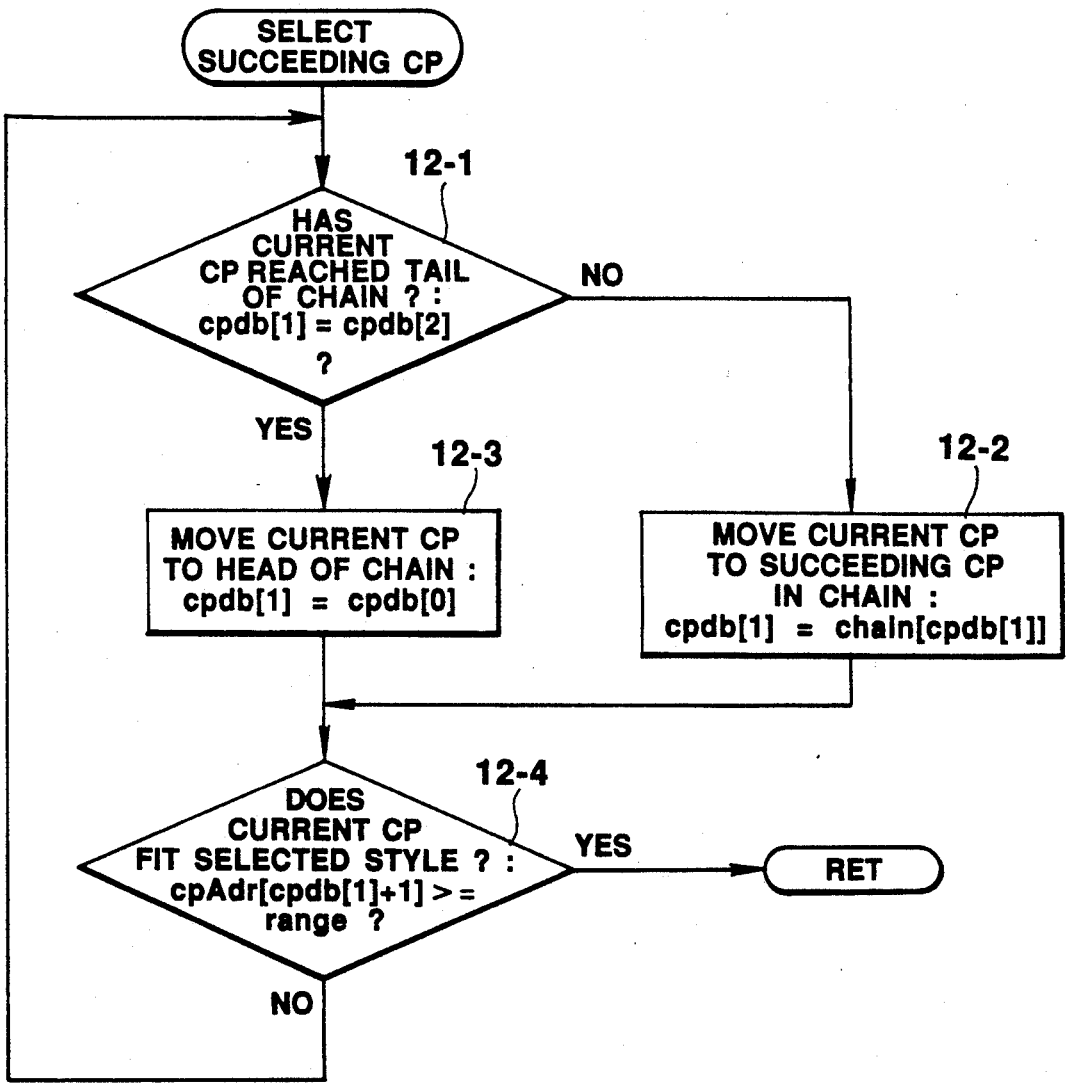
FIG. 12 is a flow chart of a select succeeding CP routine.

FIG. 12 shows details of the select succeeding CP routine 8-4 in FIG. 8. This routine is executed in response to a forward key 562A operation. First (12-1), the routine tests cpdb[1]=cpdb[2] to see whether the current CP (chain element) has reached the tail of the chain table. If not, the current CP is moved to the succeeding CP in the chain by cpdb[1]=chain[cpdb[1]] (12-2). If it has reached the tail of the chain, the current CP is moved to the head of the chain by cpdb[1]=cpdb[0] (12-3). Then, the routine tests cpAdr[cpdb[1]+1]≧range to see whether the current CP fits the selected music style (12-4). If not, the routine repeats the process of 12-1 to 12-4 until it finds a CP suitable for the selected style or range. As a result, the current pointer cpdb[1] (i.e., the selected CP pointer) points to a succeeding chord progression in the chain and falling within the selected range.

Figure 13:
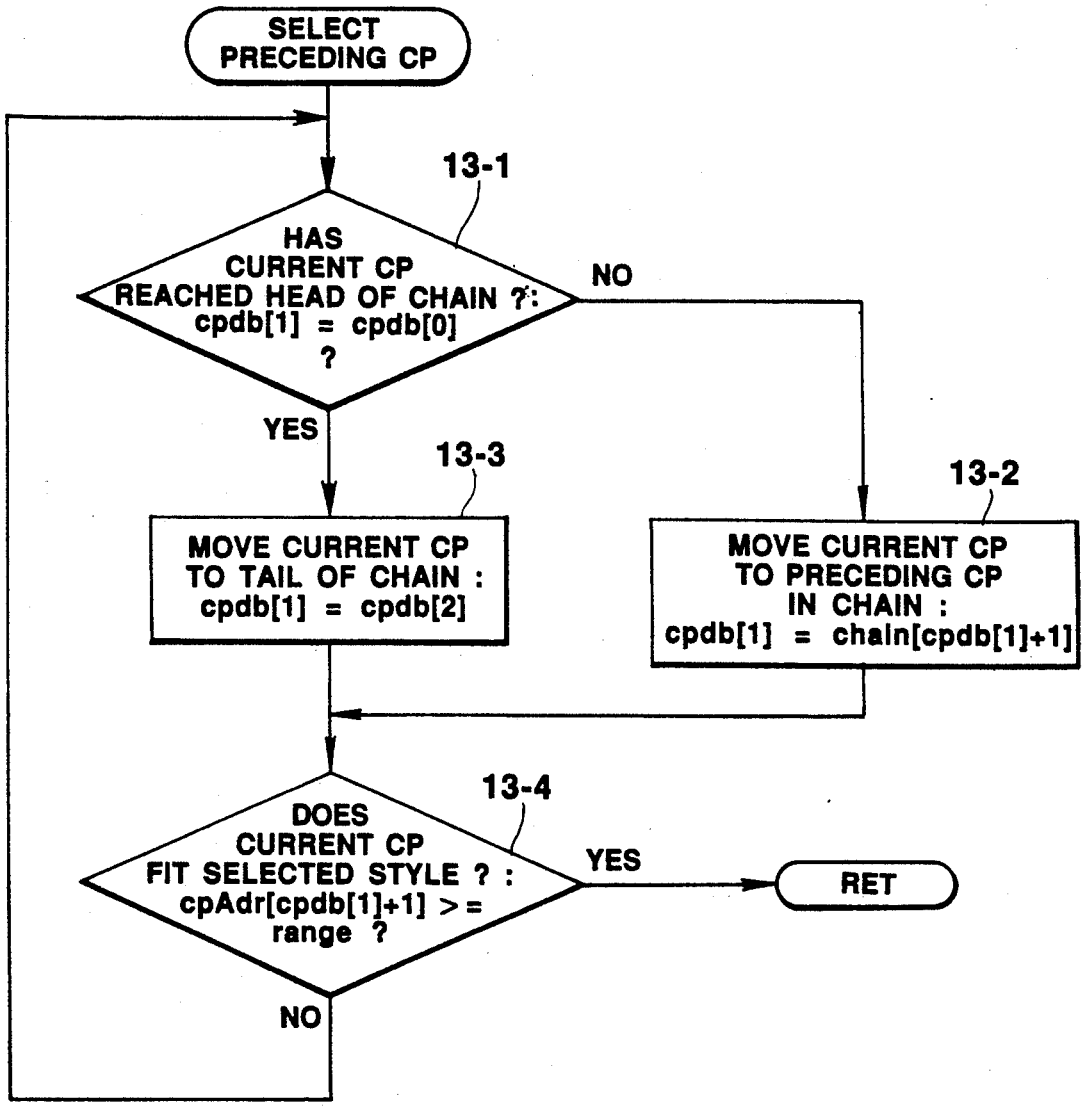
FIG. 13 is a flow chart of a select preceding CP routine.

FIG. 13 details the select preceding CP routine 8-6 in FIG. 8. This routine is executed in response to a backward key 562B operation. First (13-1), the routine compares cpdb[1] with cpdb[0] to see whether the current CP has reached the head of the chain table. If not, the current CP is moved to a preceding CP in the chain (13-2) by cpdb[1]=chain[cpdb[1]+1]. If it has arrived at the head of the chain, the current CP is moved to the tail of the chain (13-3) by cpdb[1]=cpdb[2]. Then, the routine tests cpAdr[cpdb[1]+1]≧range to see whether the current CP fits the selected style or range. If not, the routine repeats the process of 13-1 to 13-3. In this manner, the current pointer cpdb[1] (i.e., the selected CP pointer) is changed so as to point to a preceding chord progression in the chain and falling within the selected range.

Figure 14:
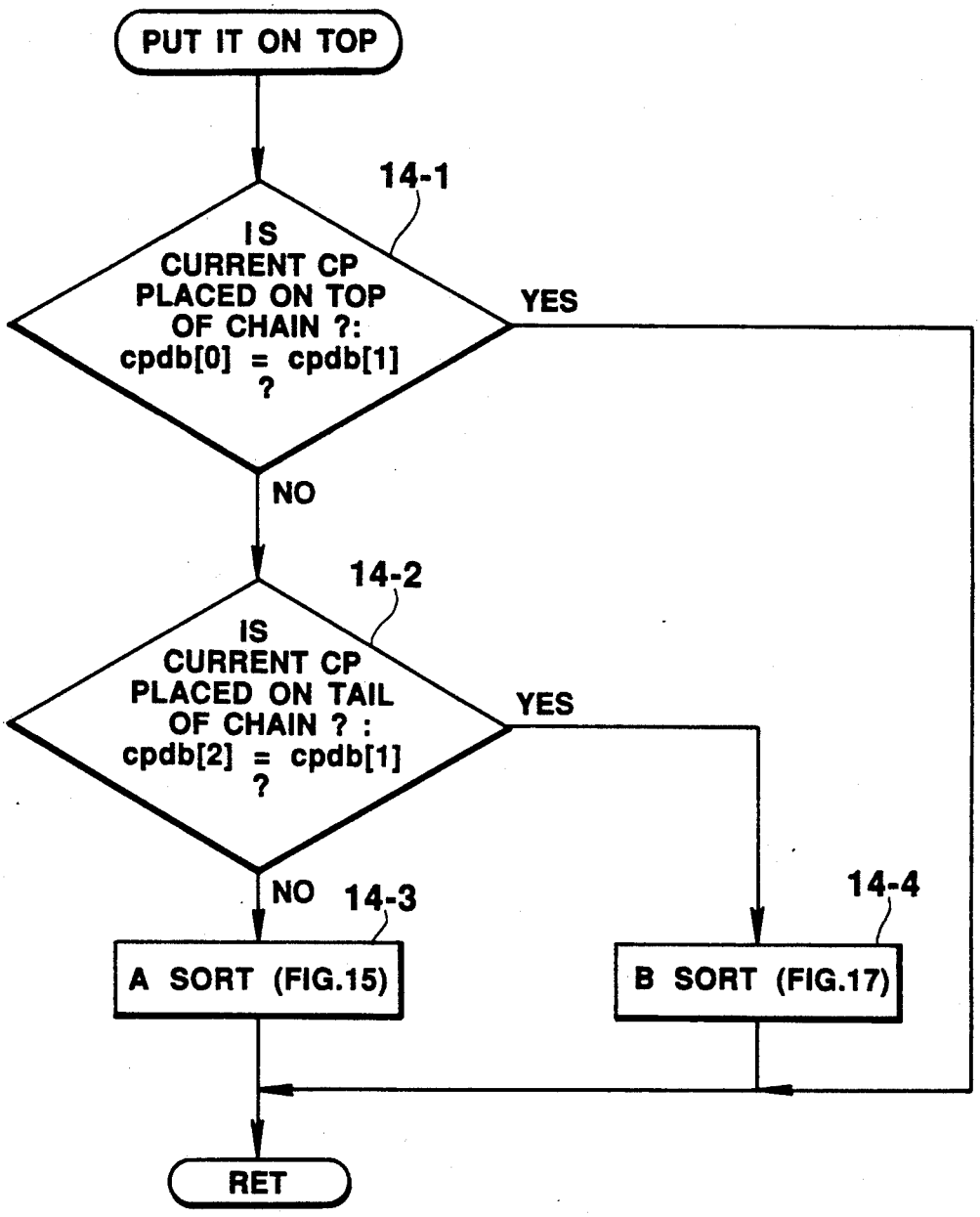
FIG. 14 is a flow chart of a put it on top routine.
Figure 15:
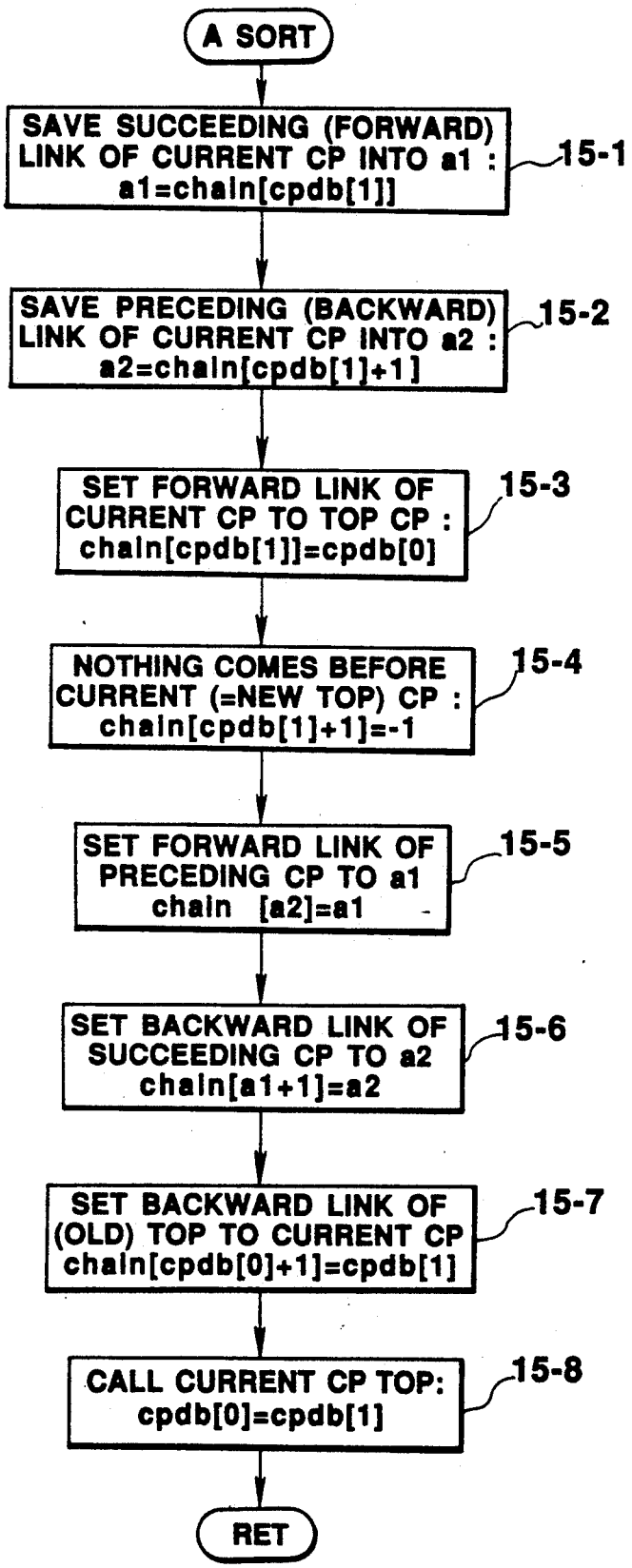
FIG. 15 is a flow chart of an A sort routine.
Figure 17:
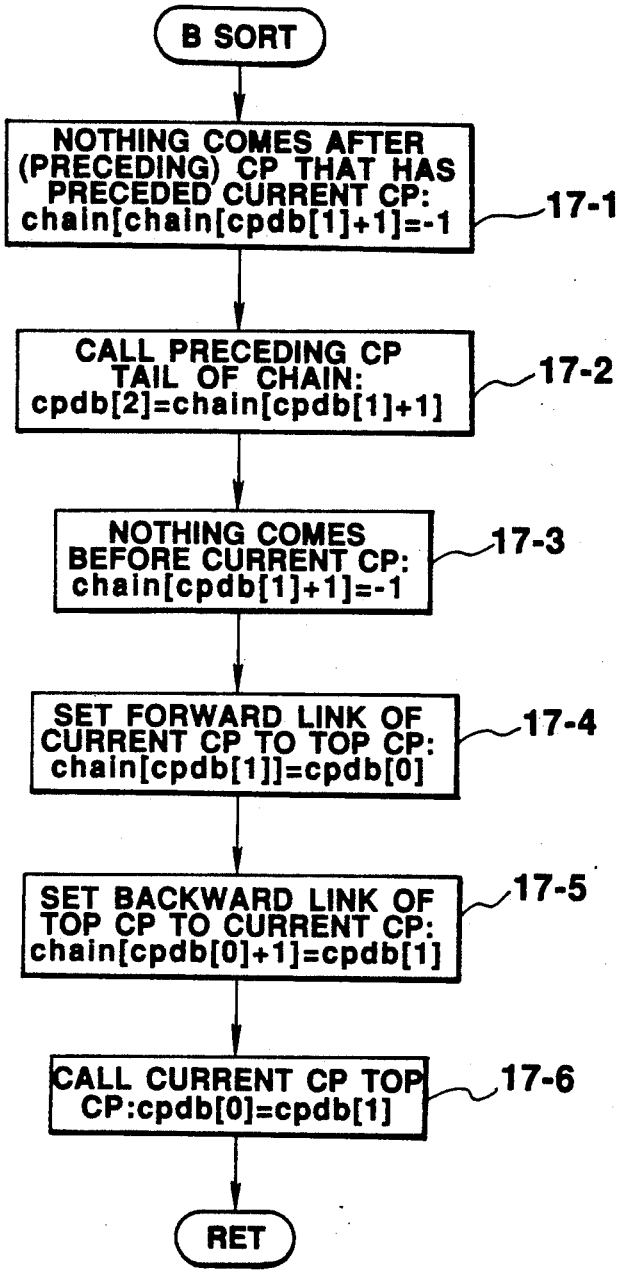
FIG. 17 is a flow chart of a B sort routine.

FIG. 14 shows details of the put it on top routine 8-10 in FIG. 8. This routine is executed in response to a top key 560A operation. The function of this routine is to put the chain element indexed by the current pointer on the top of the chain. First (14-1), the routine compares cpdb[1] with cpdb[0] to see whether the current CP is placed on top of the chain. If this is the case, the routine directly returns to the main program of FIG. 8. If not, the routine compares cpdb[1] with cpdb[2] to see whether the current CP is placed on tail of the chain (14-2). In the negative case, the routine executes A sort process 14-3 detailed in FIG. 15, and executes B sort process 14-4 detailed in FIG. 17 in the affirmative case.

Figure 16:
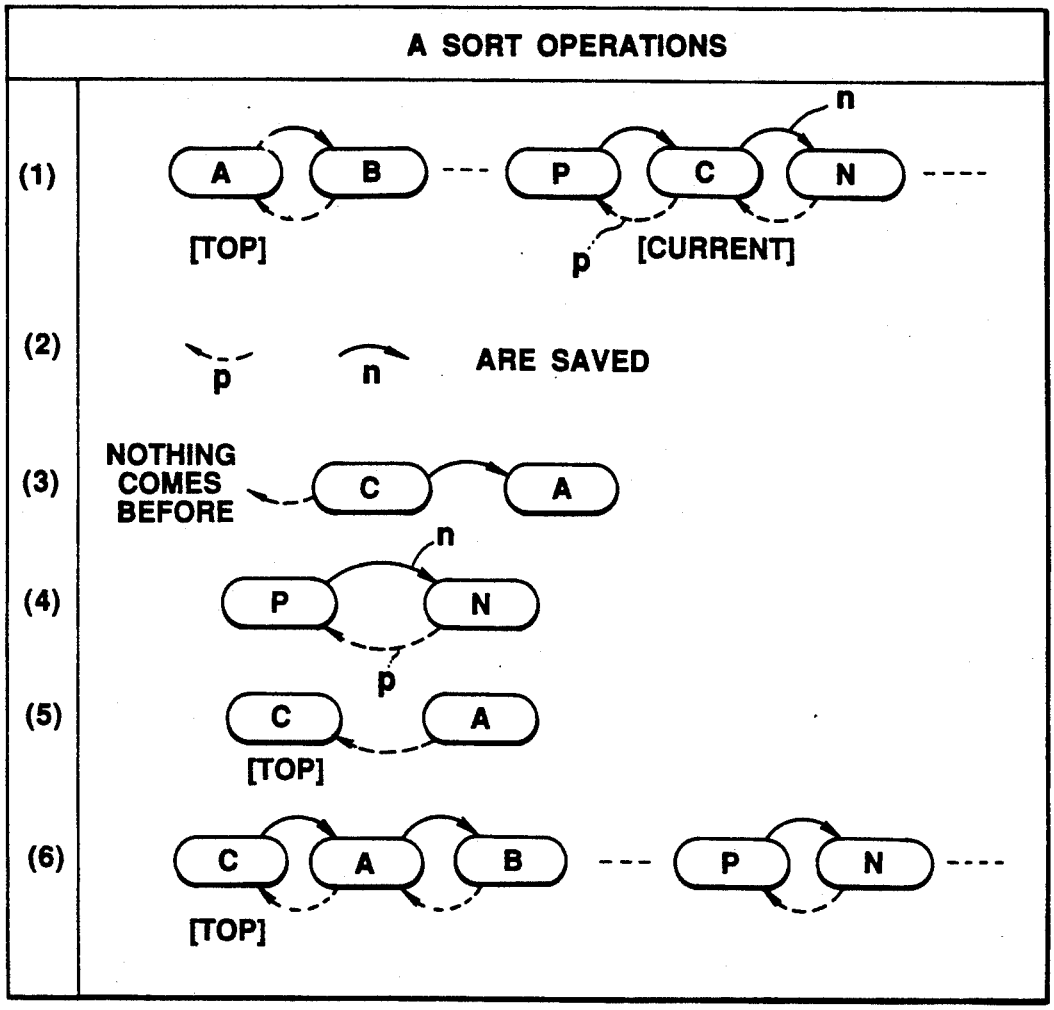
FIG. 16 illustrates A sort operations.

FIG. 16 illustrates the A sort operations. In FIG. 16, each oval-like symbol indicates an element of the chain table. Part (1) represents the chain table before sorting. A element is placed on top of the chain, followed by B. C is the current chain element pointed to by the current pointer cpdb[1]. P comes before C. N comes after C. The object of the A sort is to put the current element C on top of the chain. The result is illustrated in part (6). To this end, the backward and forward links P and N of the current element C are saved (15-2, 15-1), as shown in part (2). The forward link of the element C is changed to point to the element A (15-3), and the backward link of the element C indicates nothing comes before the C (15-4), as shown in part (3). The saved links are used to change the forward link of the element P to the element N (15-5), and to change the backward link of the element N to the element P (15-6), as illustrated in part (4). The backward link of the element A is changed to point to the element C (15-7), as shown in part (5). The current element C is now called top (15-8), as indicated in part (6). In this manner, the A sort process produces the chain table illustrated in part (6) with the element C placed on top.

Figure 18:
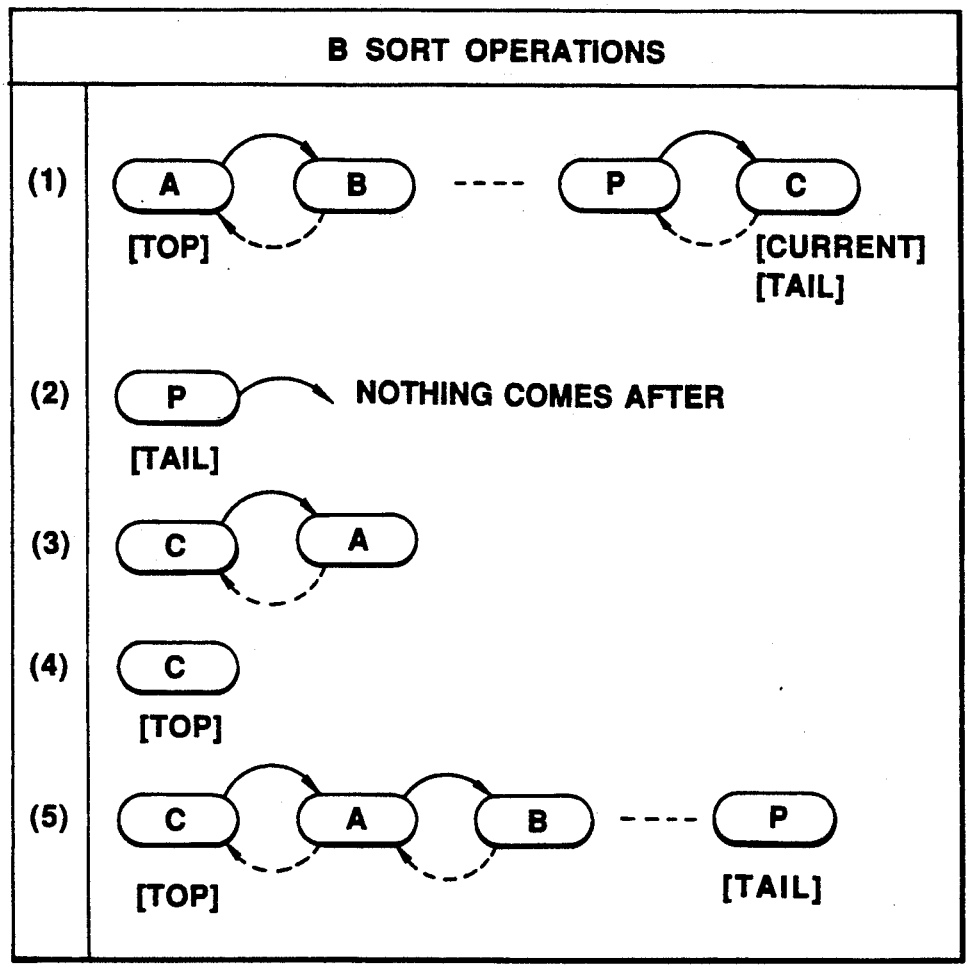
FIG. 18 illustrates B sort operations.

FIG. 18 illustrates B sort operations. Part (1) shows the chain table before the sorting. A element is placed on top of the chain, and B follows. C element, which is the current element, is placed on tail of the chain and preceded by P element. The object of the B sort is to move and place the C element on top. The result is illustrated in part (5). To this end, the forward link of P element is changed to "−1" to indicate nothing comes after P (17-1). The P element is now called tail (17-2), as indicated in part (2). The forward link of C element is changed to A element (17-4), and the backward link of the A element is changed to point to the C element (17-5), as illustrated in part (3). The C element is now called top (17-6), as shown in part (4). In this manner, B sort process modifies the chain table onto the one shown in part (5) with the C element placed on top.

As understood from the foregoing description, the apparatus constructs a desired chain of chord progressions in accordance with user's commands entered from the forward, backward and top keys 562A, 562B and 560A. Afterwards, based on the desired chain the user can easily select a desired chord progression from CPDB by simply operating the forward key 562A and/or backward key 562B. The desired chord progression selected in this way may be used as a complete chord progression of a music piece if it is long enough. More conveniently, it may also be used as a partial chord progression of an intended music piece.

<Music Piece CP Editing Feature >

The description now turns to a chord progression producing apparatus which is an application of the CP selecting apparatus described in the previous section and uses a chord progression selected from CPDB as a phrase chord progression of a music piece.

Figure 19:
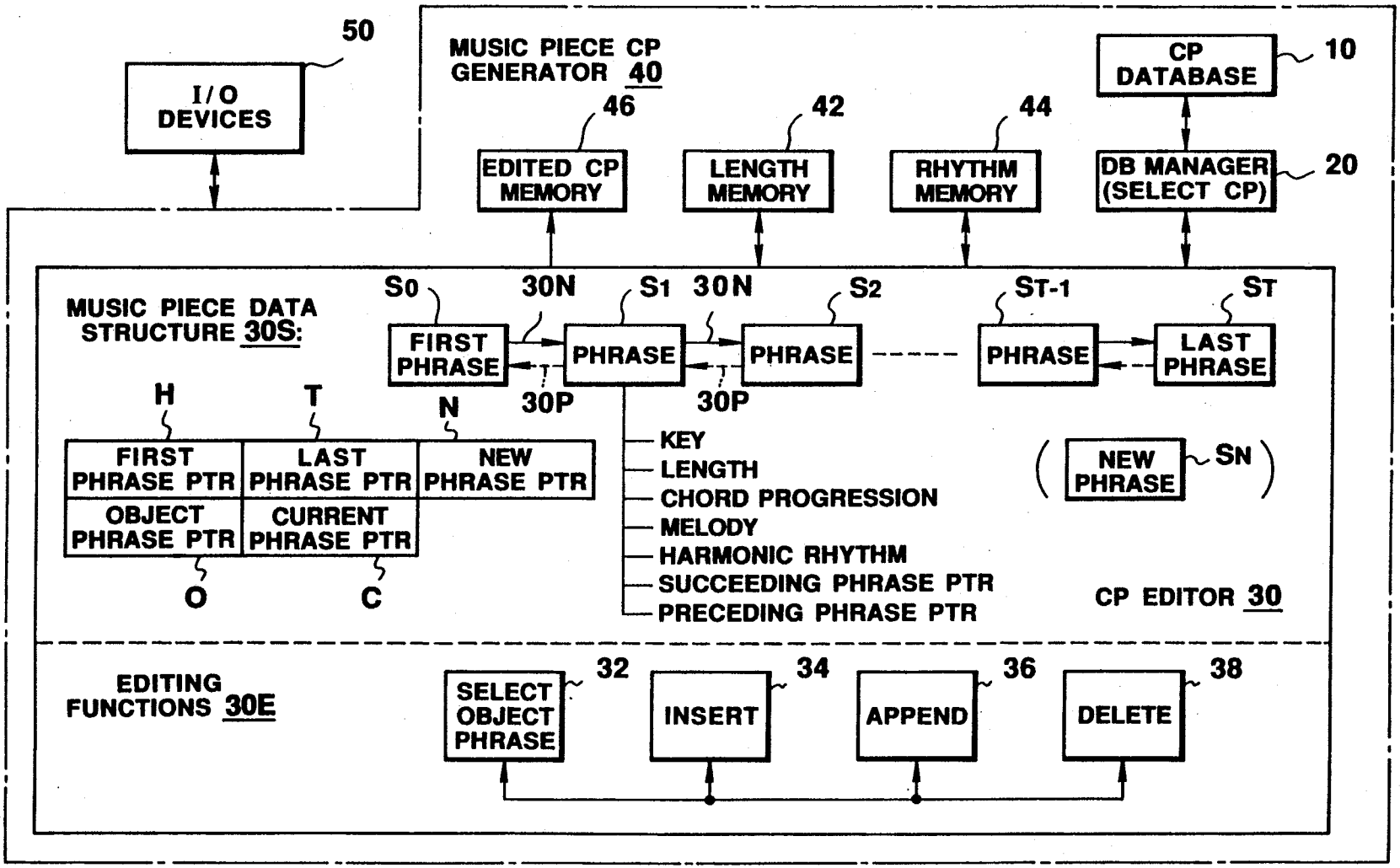
FIG. 19 is a functional block diagram of a chord progression (CP) producing apparatus in accordance with the invention.

FIG. 19 illustrates a functional diagram of such a chord progression apparatus in accordance with the invention. With the apparatus, a user can construct a desired complete chord progression of a music piece through a dialogue conducted with the music piece CP generator 40 by input and output (I/O) devices 50. In accordance with the invention, the apparatus 40 includes a chord progression (CP) editor 30 which edits a desired music piece chord progression based on a plurality of chord progressions selected from the chord progression database (CPDB) 10 via the database manager 20.

The CP editor 30 structures a music piece by the data structure 30S as follows. First, a music piece (form) is defined by a chain of phrases $S_0$, $S_1$, $S_2 \ldots S_{T-1}$ and $S_T$ in which $S_0$ indicates the first (head) phrase and $S_T$ indicates the last (tail) phrase. $S_N$ indicates a new phrase which can be added to the music piece. To manage the music piece formed by a chain of phrases, the editor 30 uses several pointers; head H, tail T, new N, object O and current C. The head pointer H indexes the first phrase $S_O$. the tail pointer indexes the last phrase $S_T$. The new pointer points to a new phrase $S_N$. The object pointer O indexes an object phrase to be edited (inserted, appended and/or deleted). The current pointer C indexes a current phrase of the music piece. Each phrase is made up of a plurality of elements. These include a key, length index, chord progression (CP) index, melody index, harmonic rhythm index, succeeding phrase pointer and preceding phrase pointer. The key index indicates a key of the phrase. The length index locates a length entry in a length memory 42 which specifies the phrase length. The melody index locates an area of a melody memory (not shown) which area stores the phrase melody. The harmonic rhythm index locates a rhythm entry or data record in a rhythm memory 42 which specifies the harmonic rhythm of the phrase. The succeeding phrase pointer 30N locates a succeeding phrase in the chain. The preceding phrase pointer or link 30P points to a preceding phrase. For example, the succeeding link of the phrase $S_1$ points to the phrase $S_2$. The preceding link of the phrase $S_1$ points to the phrase $S_0$. The CP editor 30 has an editing capability of providing a desired chain of phrases to form a desired music piece. Since each phrase contains information about a chord progression, the chained phrases determine a desired complete chord progression of a music piece. Each phrase chord progression may be selected from the chord progression database 10. If desired, some phrase chord progressions may be supplied from the user by a suitable input device such as a musical keyboard.

The editing function of the CP editor 30 may take various forms. The phrase editing function 30E illustrated in FIG. 19 includes select object phrase 32, insert 34, append 36 and delete 38. The select object phrase function 32 selects either one of the phrases in the chain or a new phrase $S_N$, as an object phrase to be edited. The insert function 34 inserts a new phrase $S_N$ (selected by the function 32) in the chain of phrases. The append function 36 adds a new phrase $S_N$ to the chain. The delete function 38 deletes a phrase (selected by the function 32) from the chain. By these editing functions 30E, a desired chain of phrases is formed, and therefore, a desired chord progression of a music piece is completed and stored in an edited CP memory 46.

In this manner, the apparatus 40 selects chord progressions from the database 10 and electronically edits them into a desired music piece chord progression in accordance with user's commands.

Figure 20:
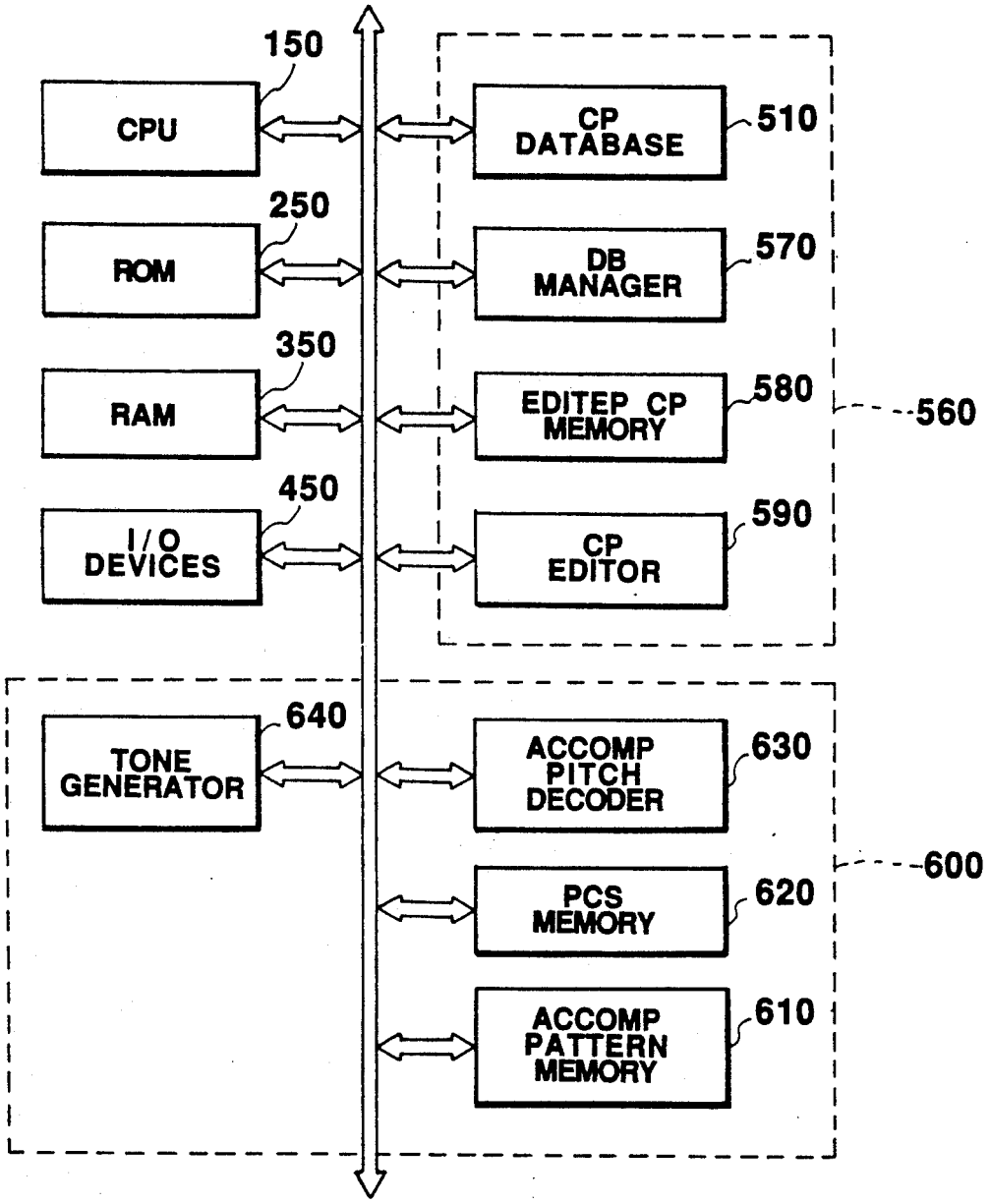
FIG. 20 is a block diagram of a computer-based music apparatus incorporating the CP producing feature of the invention.

FIG. 20 shows a block diagram of a computer based music apparatus incorporating the features described in connection with FIG. 19. The microcomputer-based music apparatus comprises, as computer resources, CPU150, ROM250 storing programs and constant data, RAM350 as a working memory, and input and output (I/O) devices 450. To clarify features of the music apparatus, FIG. 20 further shows a music piece CP generator 560 and accompaniment apparatus 600. The CP generator 560 is essentially identical with the apparatus 40 in FIG. 19 and includes CPDB (chord progression database) 510, DB manager 570, edited CP memory 580 and CP editor 590. The accompaniment apparatus 600 is identical with the corresponding component in FIG. 3.

Actually, each component of the music piece CP generator 560 is realized by one or more of the computer resources stated. The realization will be obvious to those skilled in the art from the foregoing and following description and the drawings.

Figures 21, 23:
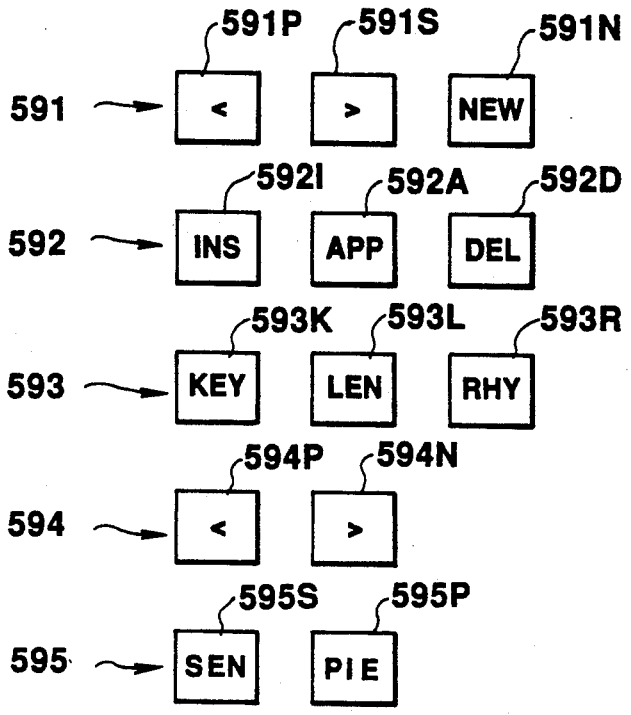
FIG. 21 shows input devices of the apparatus in FIG. 20.
FIG. 23 shows constants used in the apparatus of FIG. 20.

FIG. 21 illustrates input devices of the music piece CP generator 560. A phrase select input device 591 serves to select a phrase, and includes a backward key 591P for selecting a preceding phrase, a forward key 591S for selecting a succeeding phrase, and a NEW key 591N for selecting a new phrase. An edit command input device 592 inputs edit commands for a music piece, and includes an INS or insert key 592I, APP or append key 592A, and DEL or delete key 592D. A phrase attribute entry device 593 is used to set desired attributes of a phrase, and include a KEY or tonality key 593K, LEN or length key 593L and RHY or harmonic rhythm key 593R. A chord progression (CP) select input device 594 serves to select a chord progression from CPDB560, and includes a backward key 594P and a forward key 594N. A play command device 595 requests a musical performance, and include a SEN or phrase play key 595S and a PIE or piece plan key 595P.

FIG. 22 shows main variables used in the apparatus of FIG. 20. An array piece [ ] stores music piece management pointers, and includes piece [HEAD] pointing to the first (head) phrase of a music piece, piece[CUR] pointing to a current phrase, piece[TAIL] pointing to the last phrase, piece[NEW] pointing to a new phrase, and piece[OBJ] pointing to an object phrase.

An array sent[ ] stores phrase (structuring) data. Each phrase has seven data items as follows. The first item sent]7×i+KEY] indicates the key of a phrase, in which key C is represented by "0", C# by "1", and so on, and B by "11." The second item sent [7×i+LENGTH] indicates a phrase length by indexing a length entry in a length table memory. The phrase length may be one, two, four or eight bars, or the like. The third item sent[7×i+CHOPTR] indicates a phrase chord progression by pointing to a CP entry in the chord progression database. The fourth item sent[7×i+MELPTR] indicates a phrase melody by indexing a melody block in a melody memory (not shown). The fifth item sent[7×i+RHYTHM] indicates a desired harmonic rhythm of the phrase by indexing a rhythm entry in a rhythm table memory. The sixth item sent[7×i+NEXT] points to a succeeding phrase. The seventh item sent[7×i+PREV] points to a preceding phrase.

A variable "bar" is an address counter for the length table memory.

FIG. 23 shows main constants. An array cpAtt[ ] forms a CP attribute memory for storing attributes of each chord progression entry in CPDB. An even-numbered element cpAtt[i×2+0] indicates the length of i-th chord progression in CPDB, and the next odd-numbered element indicates the harmonic rhythm index of the i-th chord progression.

An array barLength[ ] forms the length table memory for storing a set of lengths. A phrase length is selected from barLength[ ]. A constant maxRhythm indicates the total number of rhythms stored in the rhythm table memory.

Figure 24:
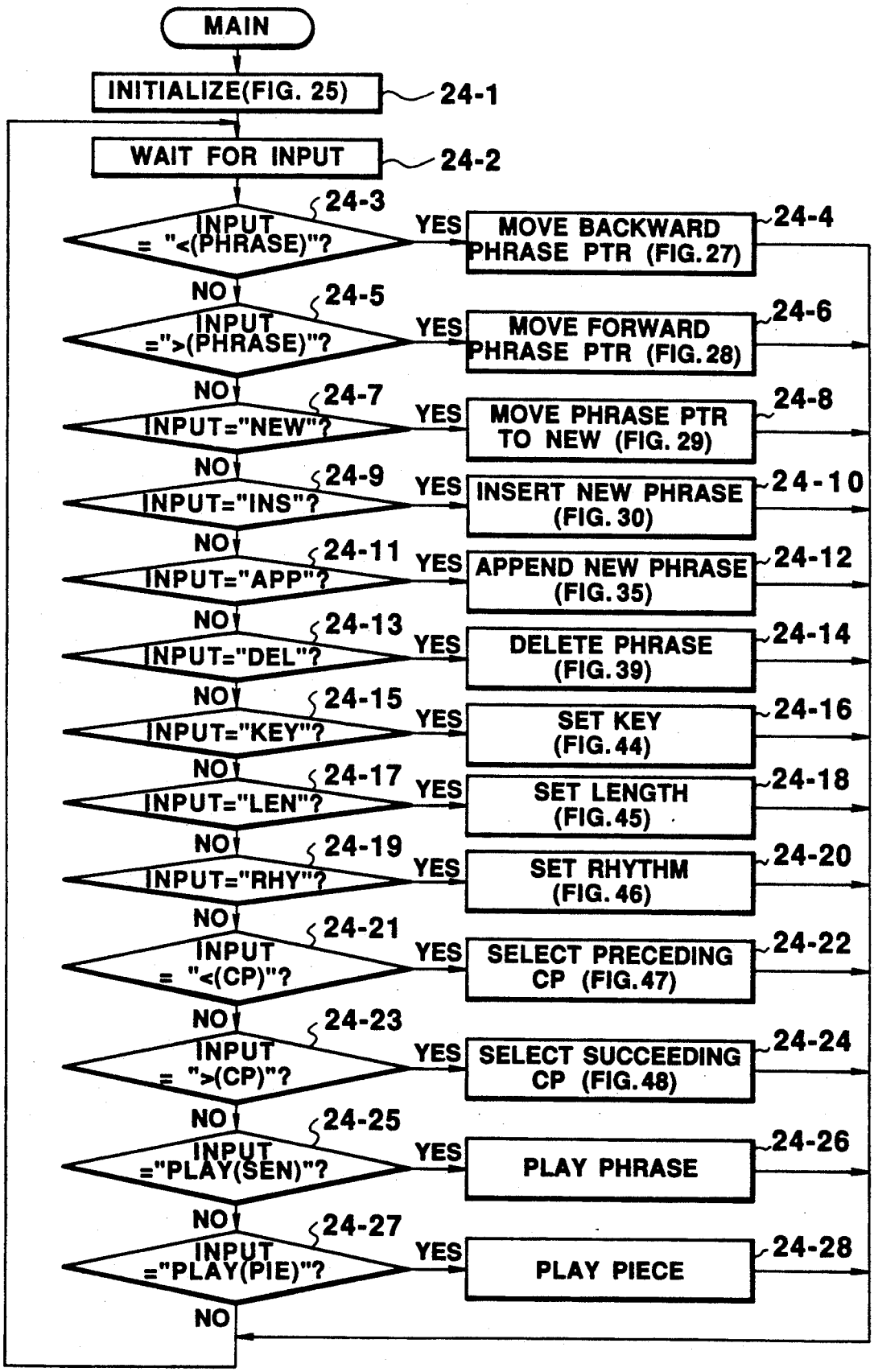
FIG. 24 shows a main flow chart of the apparatus in FIG. 20.

FIG. 24 shows a general flow chart of a main program of the music apparatus in FIG. 20, stored in ROM250 and executed by CPU150. First (24-1), the main program initializes the system. In the main loop, it awaits an input from the input devices (24-2) and each time it receives an input, a corresponding routine is executed. Specifically, when the backward key 591P of the phrase selector 591 is depressed (24-3), a move phrase pointer backward routine is executed (24-4) to move the current phrase to a preceding phrase. When the forward key 591S of the phrase selector is depressed (24-5), a move forward phrase pointer routine is executed (24-6) to move the current phrase to a succeeding phrase. In response to a NEW key 591N operation (24-7), a move phrase pointer to new routine is executed (24-8) to select a new phrase. When the INS key 592I is depressed (24-9), an insert new phrase routine 24-10 is executed to insert a new phrase in the chained phrases. In response to an APP key 592A operation (24-11), an append new phrase routine 24-12 is executed to append a new phase to the chain of phrases. When the DEL key 592D is operated (24-13), a delete phrase routine 24-14 is executed to delete a phrase from the chain. In response to a KEY key 593K operation (24-15), a set key routine 24-16 is executed to set a desired key of a phrase. For a LEN key 593L operation (24-17), a set length routine 24-18 is executed to set a desired phrase length. When the RHY key 593R is depressed (24-19), a set rhythm routine 24-20 is executed to set a desired harmonic rhythm of the phrase. When the backward key 594P of the CP selector 594 is depressed (24-21), a select preceding CP routine 24-22 is executed to select a suitable preceding chord progression from CPDB. For an operation of the forward key 594N of CP selector, a select succeeding CP routine 24-24 is executed to select an appropriate succeeding chord progression from CPDB. When the SEN key 595S is depressed, a play phrase routine 24-26 is executed to play a phrase of melody and chord progression (as accompaniment). When PIE key 595P is depressed (24-27), a play piece routine 24-28 is executed to play a music piece with a complete melody and an edited chord progression in the form of an accompaniment.

Figure 25:
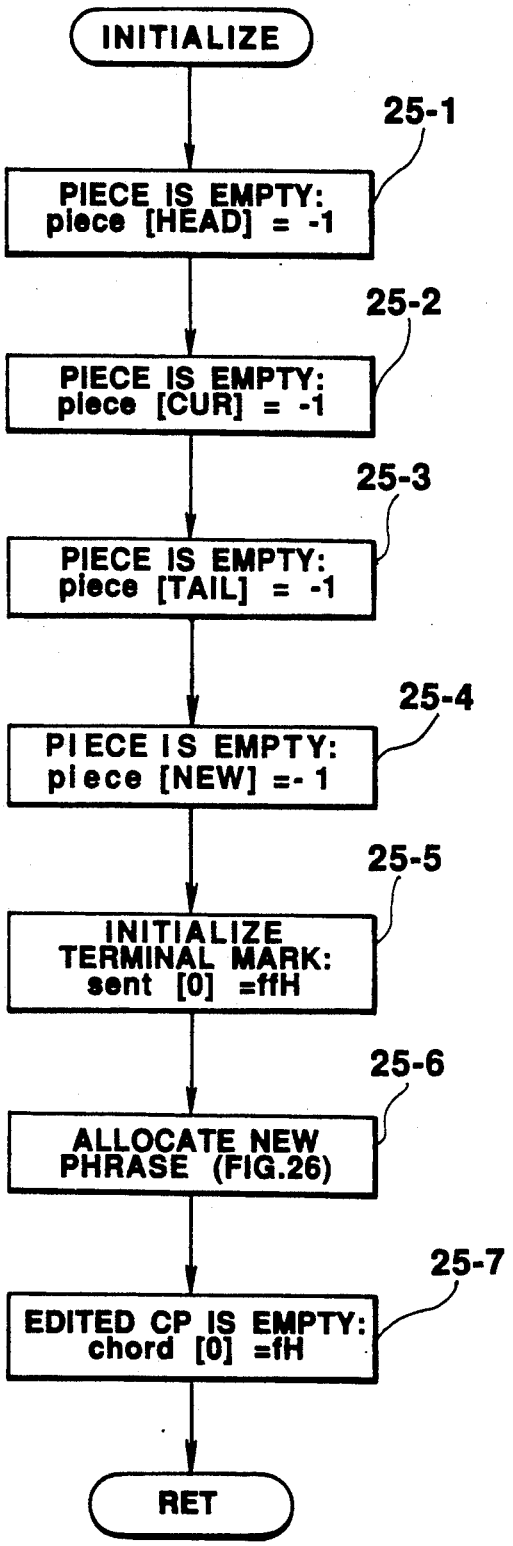
FIG. 25 is a flow chart of an initialize routine.

FIG. 25 shows details of the initialize routine 24-1 in FIG. 24. In steps 25-1 to 25-4, the routine sets music piece managing pointers piece [HEAD], piece [CUR], piece [TAIL] and piece [NEW], each to a null value of "−1" to indicate that a music piece is empty. Step 25-5 initializes a terminal mark by sent[0]=ffH. Step 25-6 allocates a storage area to a new phrase. Finally step 25-7 sets chord[0] to fH to indicate that an edited chord progression is empty.

Figure 26:
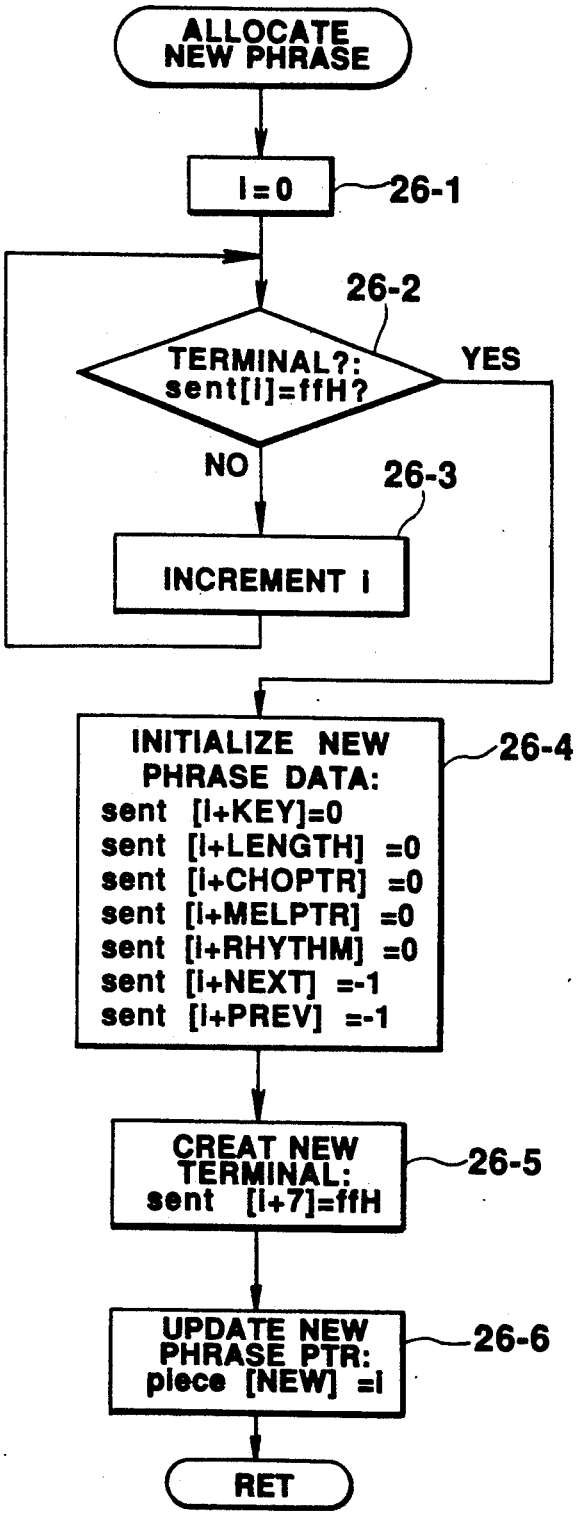
FIG. 26 is a flow chart of an allocate new phrase routine.

FIG. 26 details the allocate new phrase routine (executed, for example at step 25-6 in FIG. 25). In 26-1 to 26-3, the routine finds out a terminal mark in the phrase chain memory sent[ ]. Then, starting from the discovered location of the terminal mark, the routine initializes new phrase data (26-4) by sent[i+KEY]=0 (indicative of key C), sent[i+LENGTH]=0 (indicative of the first length entry in the length memory), sent[i+CHOPTR]=0, sent[i+MELPTR]=0, sent[i+RHYTHM]=0 (indexing the first rhythm entry in the rhythm memory), sent[i+NEXT]=−1 (indicative of no succeeding phrase) and sent[i+PREV]=−1 (indicative of no preceding phrase). Then, the routine creats a new terminal (26-5) by writing ffH at the location of sent[i+7] which succeeds the new phrase data locations. Finally, the routine updates the new phrase pointer piece[NEW] (26-6) by piece[NEW]=i so that the updated new phrase pointer piece[NEW] indexes the entry point of the new phrase data allocated by step 26-4.

Figure 27:
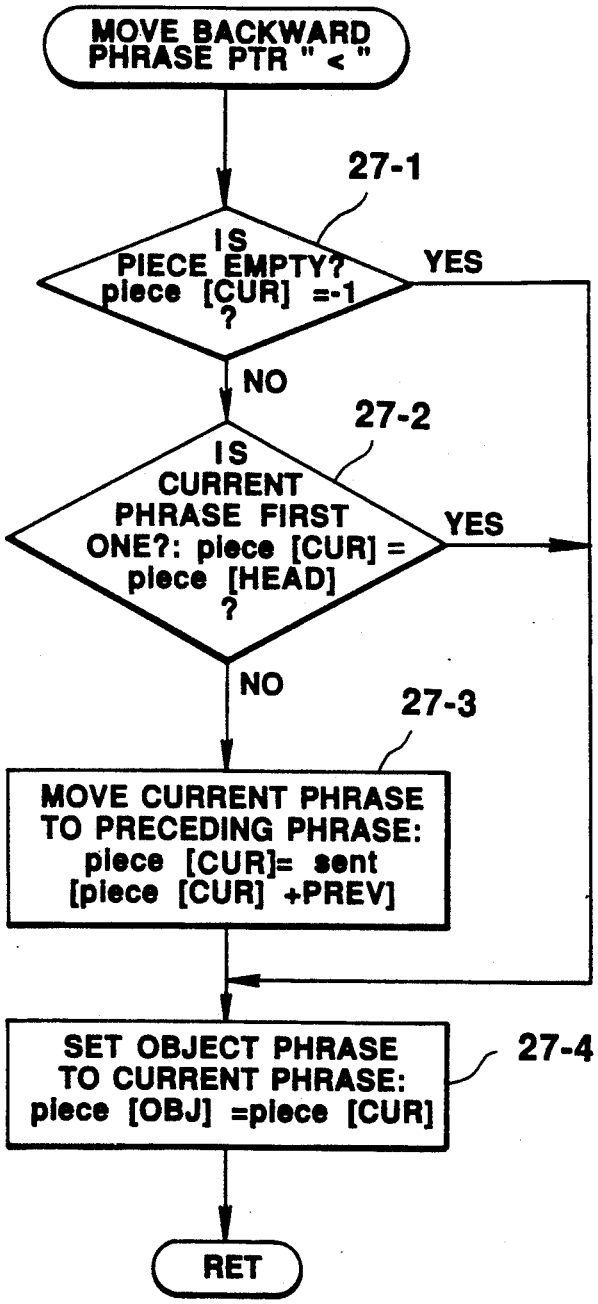
FIG. 27 is a flow chart of a move backward phrase pointer routine.

FIG. 27 shows details of the move backward phrase pointer routine 24-4. This routine is executed in response to a backward key 591P operation. First (27-1), the routine tests piece[CUR]=−1 to see whether the music piece is empty. If not empty, step 27-2 checks the current phrase pointer piece[CUR] to see whether it points to the first (head) phrase of the piece. If piece[CUR] points to a phrase other than the first phrase, step 27-3 moves the current phrase to a preceding phrase by piece[CUR]=sent[piece[CUR]+PREV]. Finally, the routine sets the object phrase to the current phrase (27-4) by object[OBJ]=piece[CUR].

Figure 28:
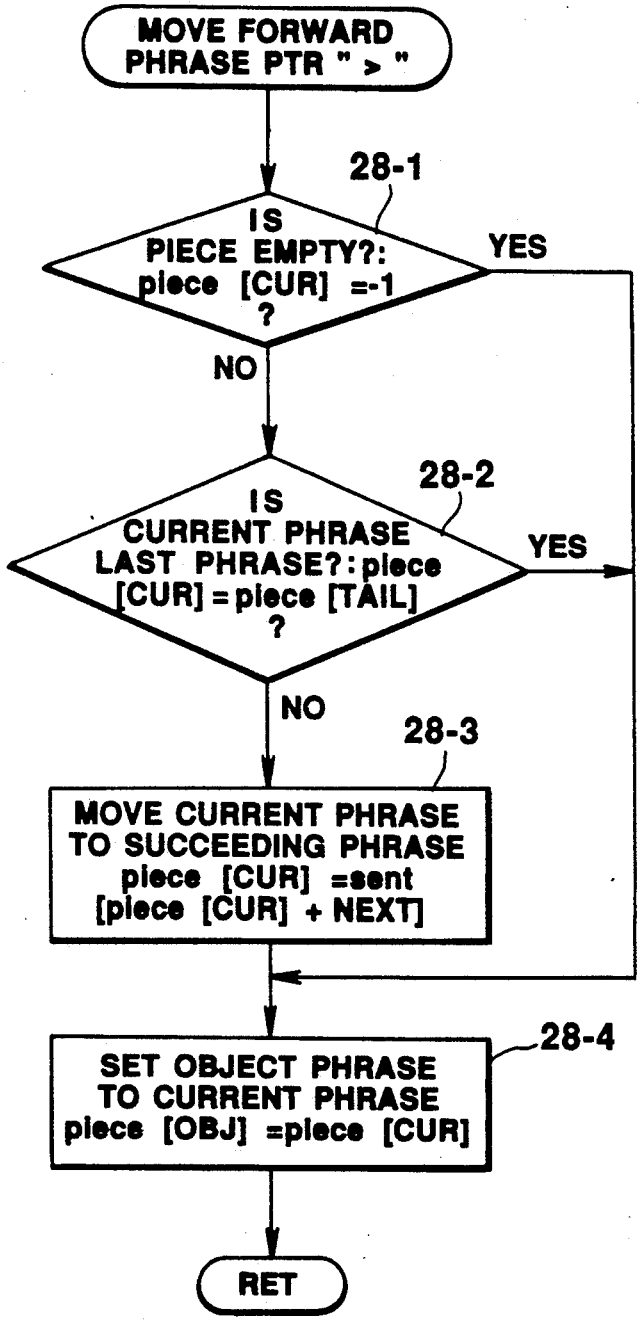
FIG. 28 is a flow chart of a move forward phrase pointer routine.

FIG. 28 is a detailed flow chart of the move forward phrase pointer routine 24-6. This routine is executed when the forward key 591S of the phrase selector is depressed. If the music piece is not empty (28-1), and if the current phrase pointer locates a phrase other than the last phrase of the piece (28-2), the routine moves the current phrase to a succeeding phrase (28-3) by piece [CUR]=sent[piece[CUR]+NEXT]. Finally, the routine sets the object phrase to the current phrase (28-4) by piece[OBJ]=piece[CUR].

Figure 29:
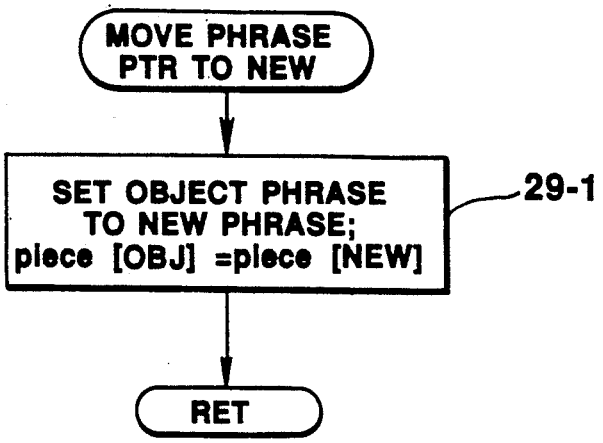
FIG. 29 is a flow chart of a move phrase pointer to new routine.

FIG. 29 shows details of the move phrase pointer to new routine 24-8. This routine is executed in response to a NEW key 591N operation, and sets the object phrase to the new phrase (29-1) by piece[OBJ]=piece[NEW].

Figure 30:
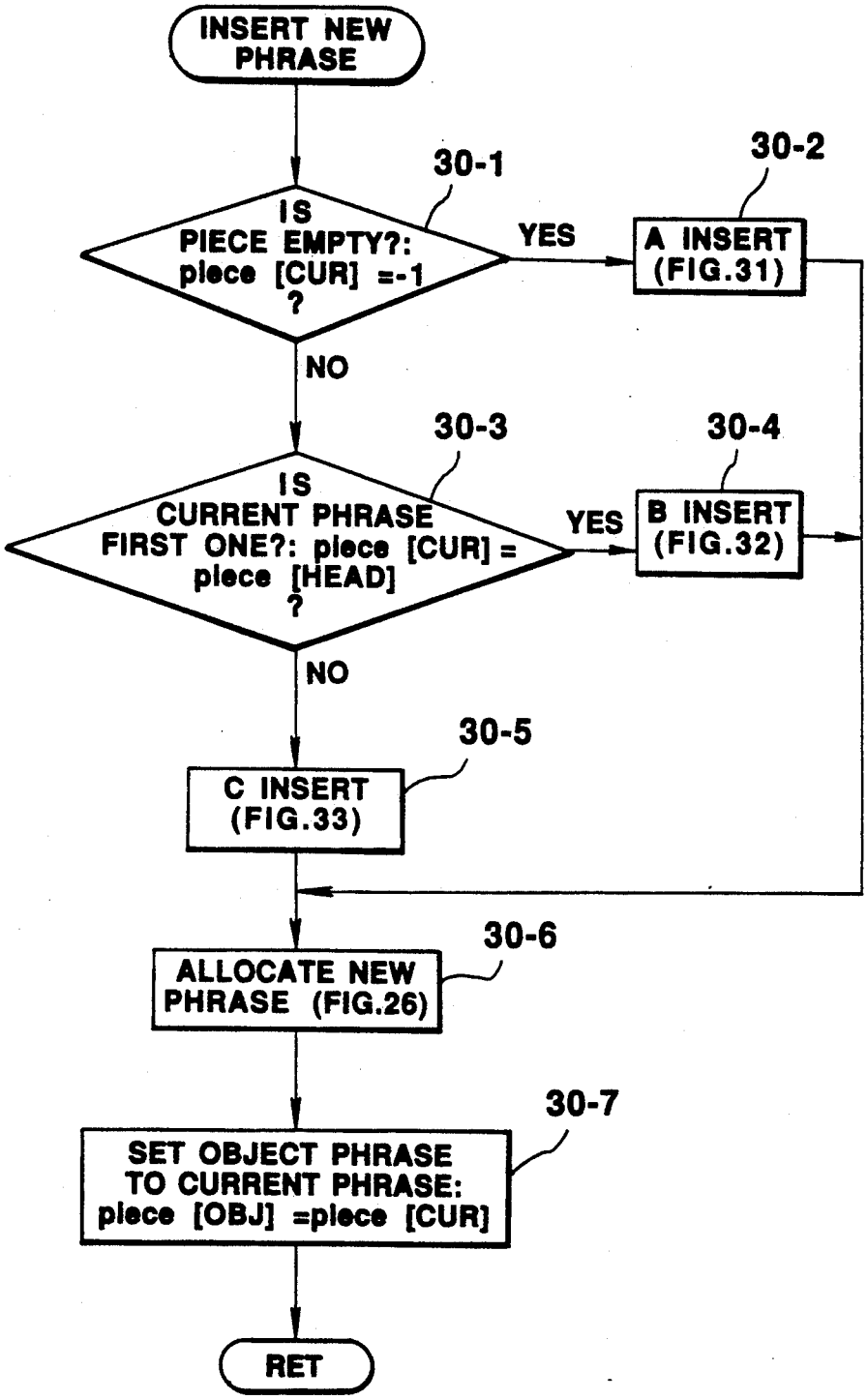
FIG. 30 is a flow chart of an insert new phrase routine.

FIG. 30 shows details of the insert new phrase routine 24-10 in FIG. 24. This routine is executed when INS key 592I of the piece edit command is depressed. If the music piece is empty (30-1), A insert 30-2 is executed to use a new phrase as a single phrase of the piece. If the music piece is not empty, and if the current phrase is the first phrase of the piece (30-3), B insert 30-4 is executed to insert or place a new phrase before the first phrase. If the music piece is not empty, and if the current phrase is not the first one, C insert 30-5 is executed to insert a new phrase between the current and its preceding phrases. Since each insert routine 30-2, 30-4, 30-5 incorporates the new phrase into the music piece, this makes it necessary to call and execute the allocate new phrase routine 30-6. Finally (30-7), the object phrase is set to the current phrase by piece[OBJ]=piece[CUR].

Figure 31:
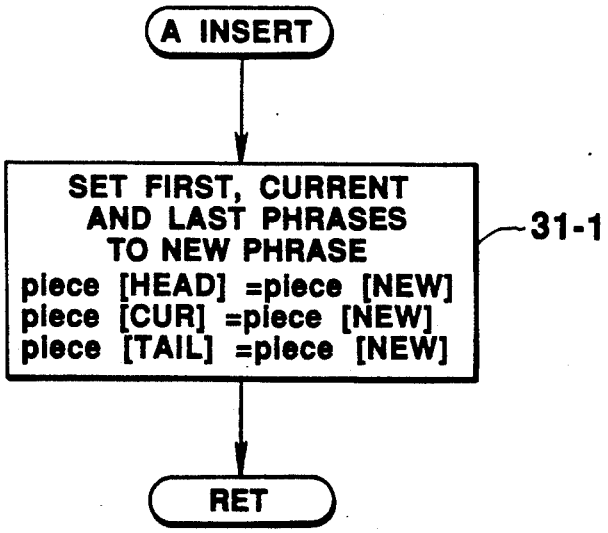
FIG. 31 is a flow chart of an A insert routine.

FIG. 31 shows details of the A insert routine 30-2 executed when the music piece is empty. The routine sets each of the first, current and last phrases to a new phrase (31-1) by piece[HEAD]=piece[NEW], piece[CUR]=piece[NEW] and piece[TAIL]=piece[NEW].

Figure 32:
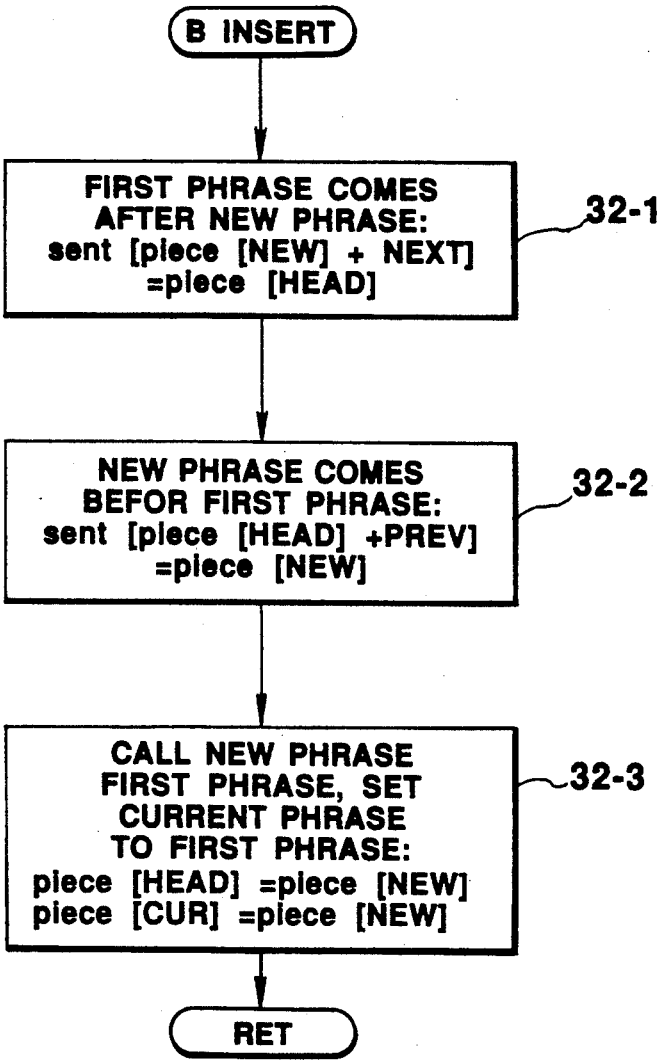
FIG. 32 is a flow chart of a B insert routine.

FIG. 32 shows details of the B insert routine 30-4 executed when the current phrase is the first phrase. First (32-1), the routine sets sent[piece[NEW]+NEXT]=piece[HEAD] to make the first phrase come after the new phrase. Then (32-2), it sets sent[piece[HEAD]+PREV]=piece[NEW] to make the new phrase come before the first phrase. Finally (32-3), the routine calls the new phrase the first phrase of the music piece, and sets the current phrase to the first phrase by piece[HEAD]=piece[NEW] and piece[CUR]=piece[NEW]. In this manner, the B insert routine puts the new phrase to the front of the phrase chain (music piece).

Figure 33:
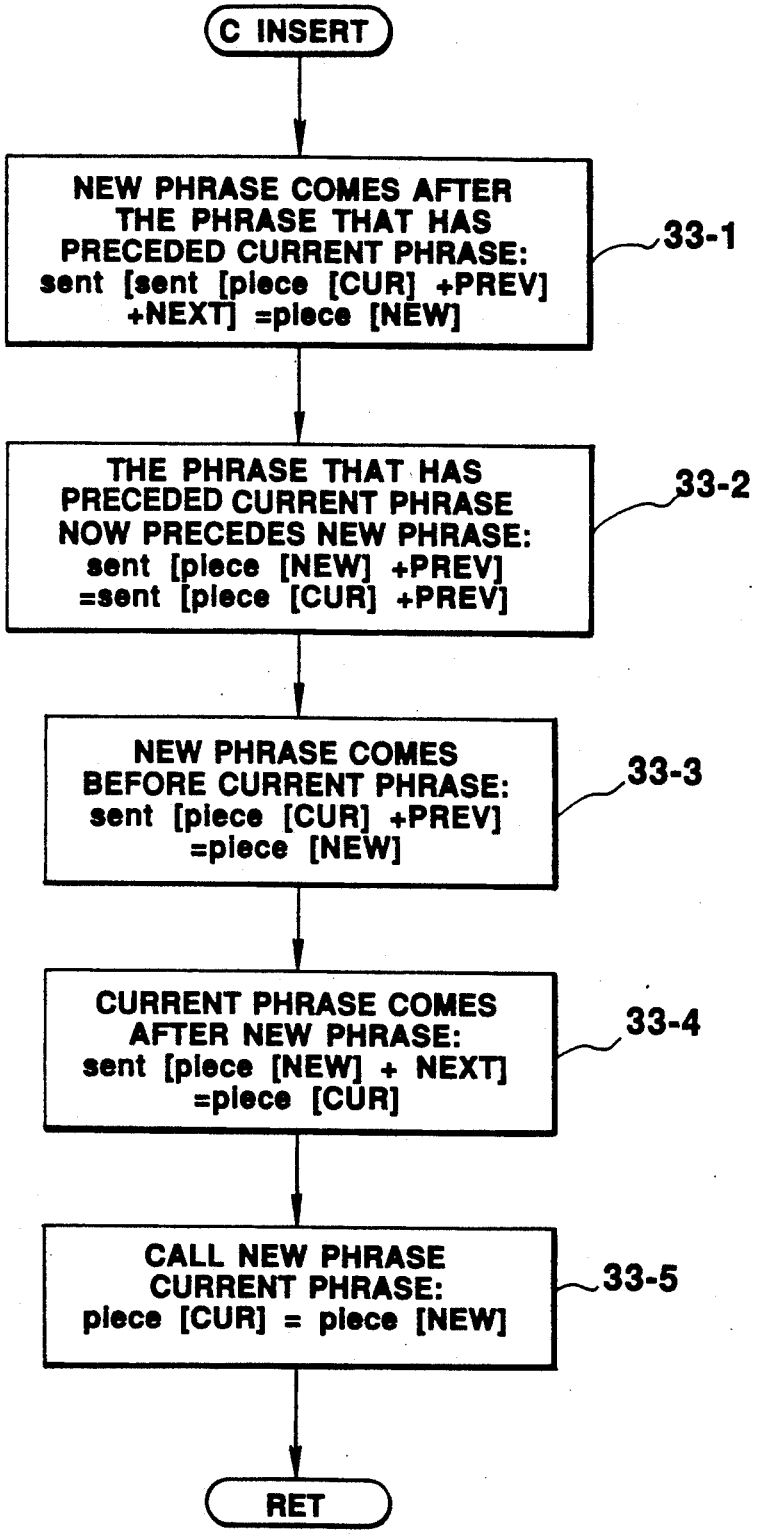
FIG. 33 is a flow chart of C insert routine.

FIG. 33 shows details of the C insert routine 30-5 executed when the current phrase is a phrase in the chain, other than the first one.

Figure 34:
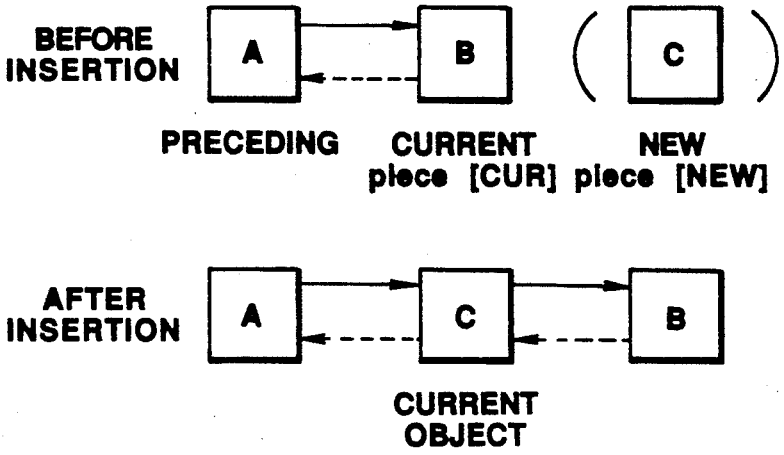
FIG. 34 illustrates a C insert operation.

FIG. 34 illustrates the C insert operation. Before insertion, B phrase is the current phrase, and A phrase precedes B. C phrase indicates a new phrase to be inserted. By the insertion, the C phrase is placed between A and B phrases. To this end, at 33-1 the C insert routine sets sent]sent[piece[CUR]+PREV]+NEXT]=piece[NEW] to make the new phrase (C phrase) come after the phrase (A phrase) that has preceded the current phrase (B phrase). At 33-2, the routine sets sent[piece[NEW]+PREV]=sent[piece[CUR]+PREV] to make the phrase (A phrase) that has preceded the current phrase (B phrase) precede the new phrase (C phrase). At 33-3, it sets sent[piece[CUR]+PREV]=piece[NEW] to make the new phrase (C phrase) come before the current phrase (B phrase). At 33-4, the routine sets sent[piece[NEW]+NEXT]=piece[CUR] to make the current phrase (B phrase) come after the new phrase (C phrase). Finally (33-5), the routine calls the new phrase (C phrase) the current phrase. The C phrase is also called the object phrase (30-7). These result in the chain of phrases shown in "after insertion" in FIG. 34.

Figure 35:
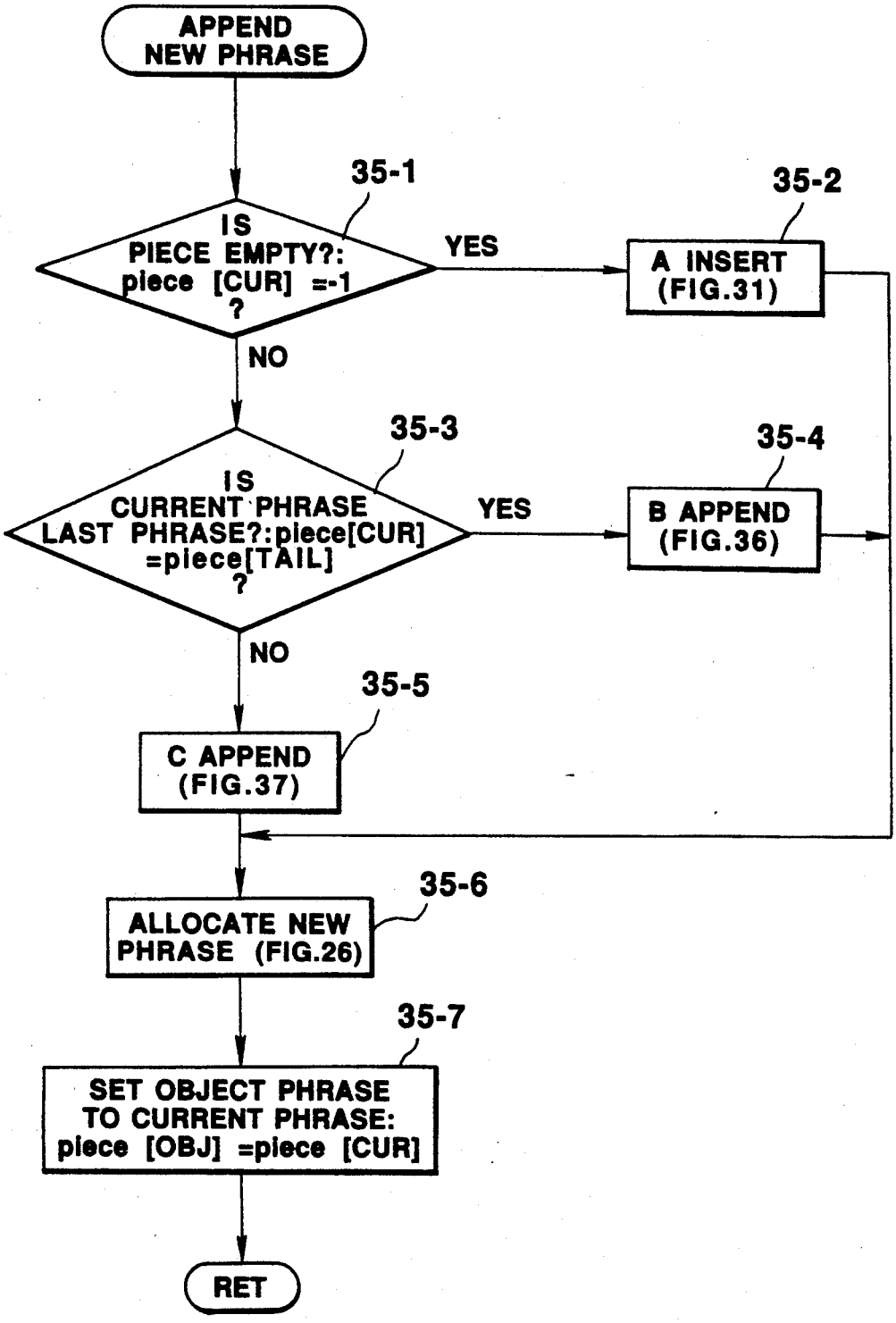
FIG. 35 is a flow chart of an append new phrase routine.

FIG. 35 shows details of the append new phrase routine 24-12. This routine is executed when APP key 592A of the music edit command 592 is depressed. If the music piece is empty (35-1), A insert 35-2 is executed to make a single phrase of the music piece from the new phrase. If the music piece is not empty and if the current phrase is the last phrase of the piece (35-3), B append 35-4 is executed to append the new phrase to the last phrase. If the current phrase is a phrase in the chain, other than the last one (35-3), C append 35-5 is executed to place the new phrase after the current phrase. Then the allocate a new phrase routine 35-6 is called and executed since each append subroutine 35-2, 35-4, 35-5 has incorporated the new phrase into the chain (music piece). Finally (35-7), the object phrase is set to the current phrase by piece[OBJ]=piece[CUR].

Figure 36:
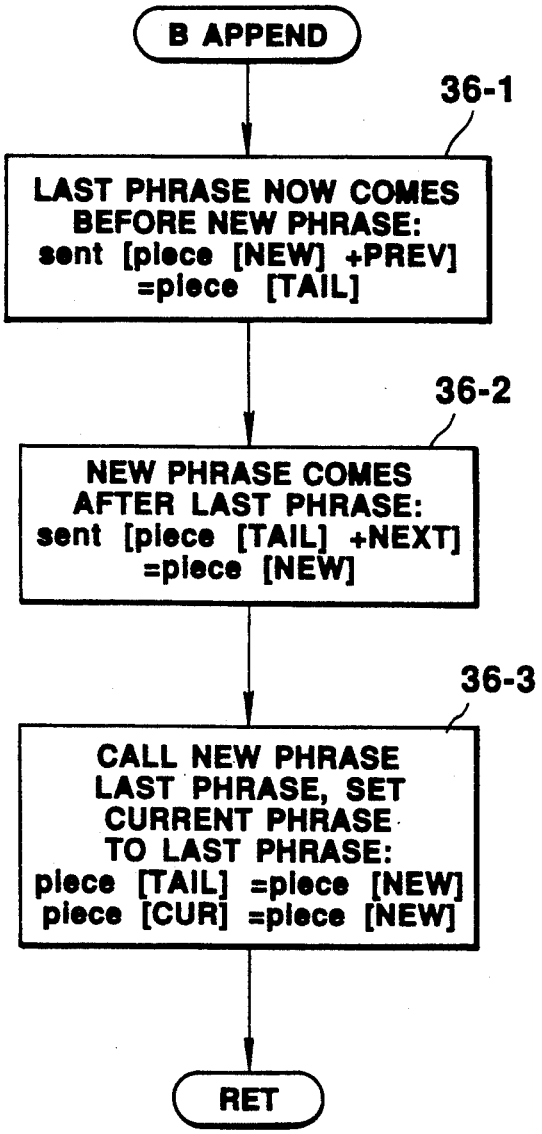
FIG. 36 is a flow chart of a B append routine.

FIG. 36 shows details of the B append routine 35-4 called when the current phrase is the last phrase of the piece. First (36-1), the routine sets sent[piece[NEW]+-PREV]=piece[TAIL] to make the last phrase come before the new phrase. Then (36-2), it sets sent[piece[-TAIL]+NEXT]=piece[NEW] to make the new phrase come after the last phrase. Finally (36-3), the new phrase is called the last phrase, and the current phrase is set to the last phrase by piece[TAIL]=piece[-NEW] and piece[CUR]=piece[NEW]. In this manner, the B append routine adds the new phrase at the end of the music piece.

Figure 37:
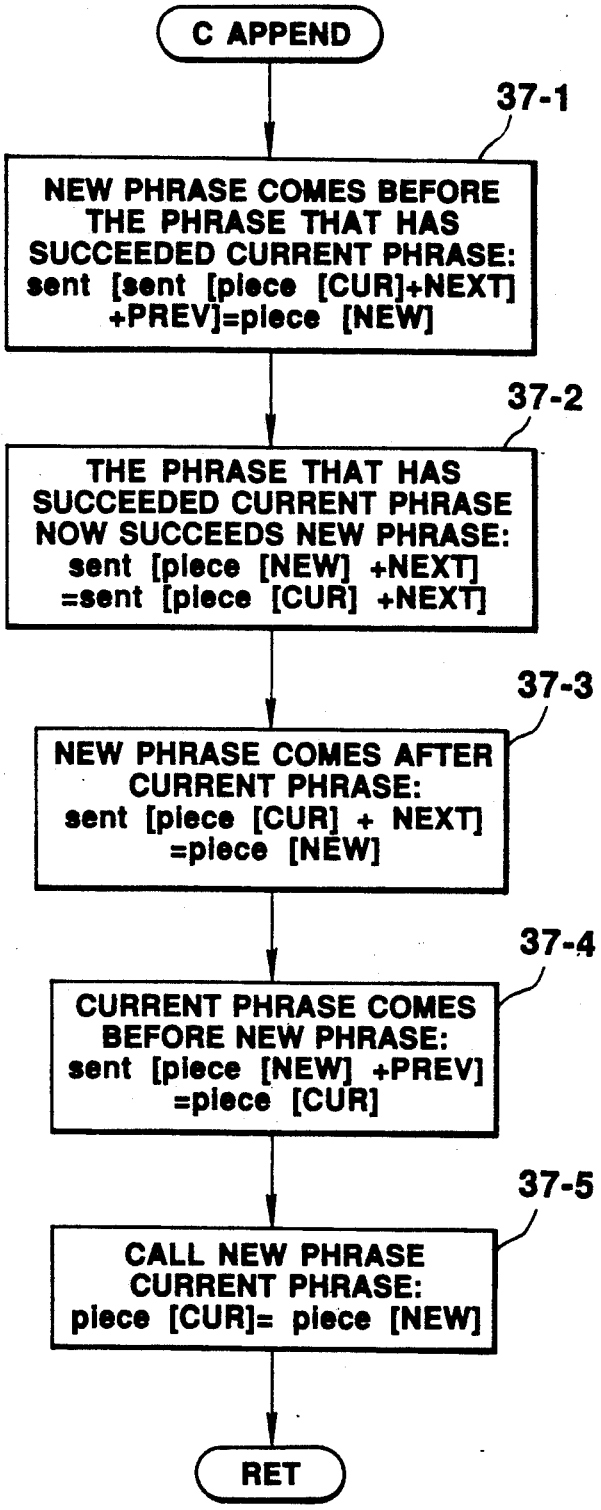
FIG. 37 is a flow chart of C append routine.

FIG. 37 is a detailed flow chart of the C append routine 35-5 in FIG. 35. This routine is executed when the APP key 592 is operated with the current phrase set to a phrase in the piece other than the last one.

Figure 38:
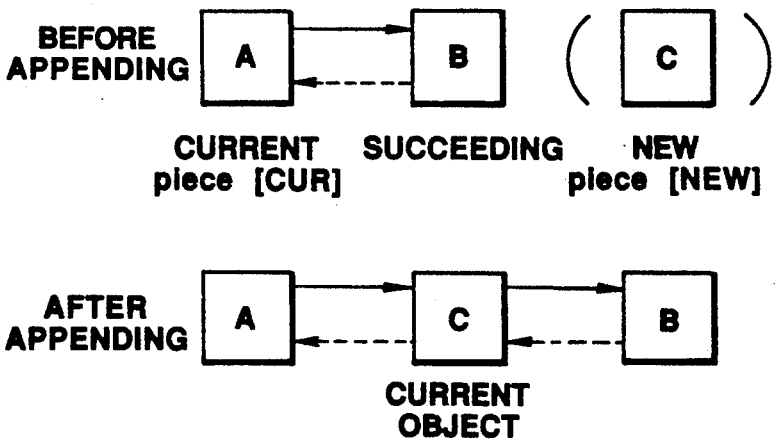
FIG. 38 illustrates C append operation.

FIG. 38 illustrates the C append operation. Before the appending, A phrase is the current phrase which is succeeded by B phrase. C phrase indicates a new phrase. The function of the C append routine is to place the new phrase (C phrase) between the current and succeeding phrases A and B. To this end, at 37-1, the routine makes the new phrase C come before the phrase B that has succeeded the current phrase A by setting; sent[sent[piece[CUR]+NEXT]+PREV]=piece[-NEW]. At 37-2, it makes the phrase B that has succeeded the current phrase A now succeed the new phrase C by sent[piece[NEW]+NEXT]=sent[piece[-CUR]+NEXT]. Step 37-3 changes the succeeding phrase pointer of the current phrase to the new phrase to declare that the new phrase C comes after the current phrase A by sent[piece[CUR]+NEXT]=piece[NEW]. Step 37-4 changes the preceding phrase link of the new phrase by sent[piece[NEW]+PREV]=piece[CUR], thus indicating that the current phrase A comes before the new phrase C. Finally, step 37-5 announces that the new phrase C is the current phrase by piece[CUR]-=piece[NEW]. In this way, the C append routine puts the new phrase after the current phrase of the piece, as illustrated in "after appending" in FIG. 38.

Figure 39:
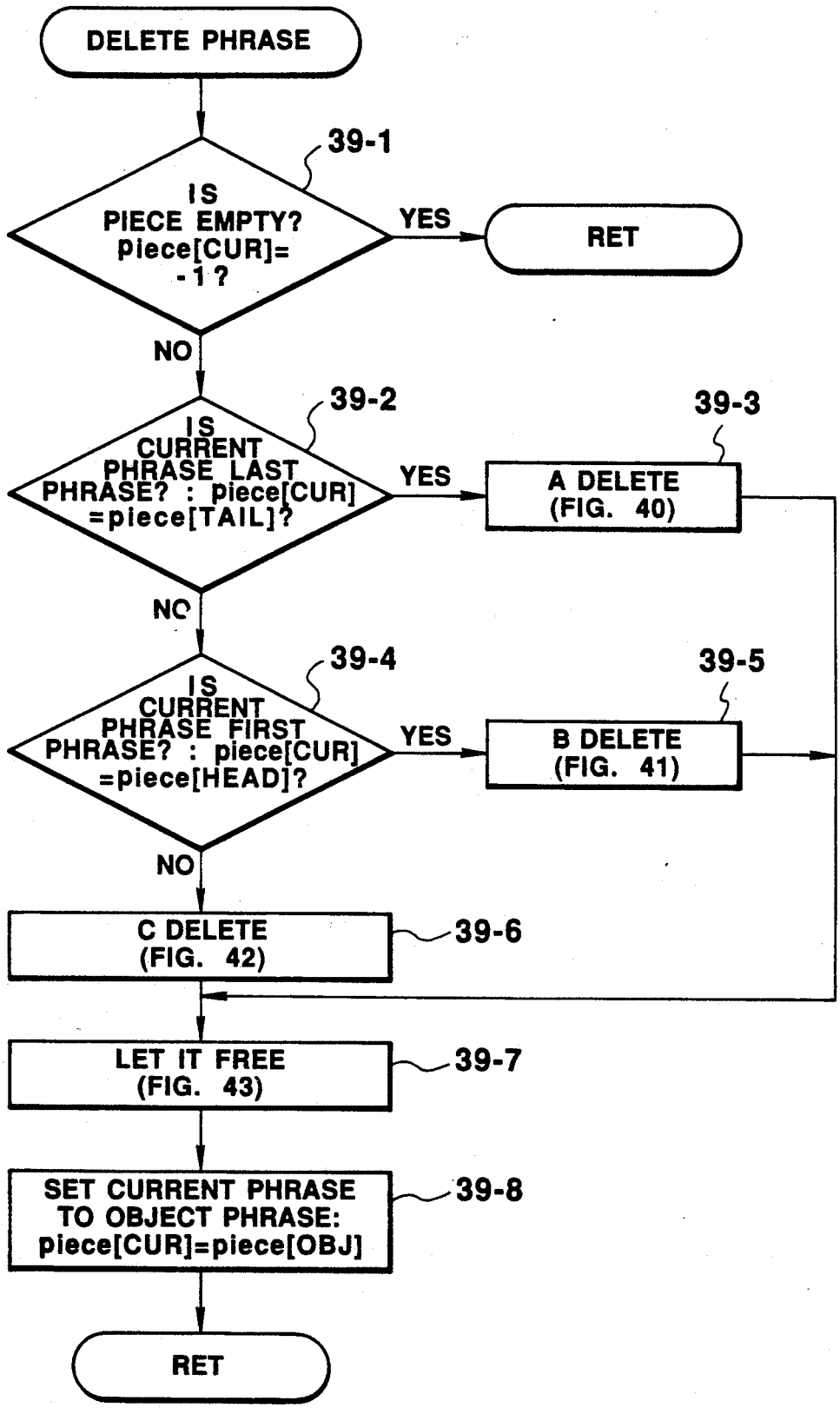
FIG. 39 is a flow chart of a delete phrase routine.

FIG. 39 shows details of the delete phrase routine 24-14 in FIG. 24. This routine is executed in response to a DEL key 592D operation. The purpose of this routine is to delete the current phrase from the music piece. If the piece is empty (39-1), the routine directly returns because there is no phrase to be deleted. If the music piece is not empty, and if the current phrase is the last phrase (39-2), A delete routine 39-3 is called to delete the last phrase. If the current phrase is the first phrase of the music piece (39-4), B delete routine 39-5 is called to delete the first phrase. If the current phrase pointer points to a phrase of the piece which is neither last nor first (39-2, 39-4), C delete routine 39-6 is executed to delete the current phrase from the music piece. Since either of the routines 39-3, 39-5 and 39-6 has deleted a phrase, a let it free routine 39-7 is then called to free the storage area that has been occupied by a phrase. Finally, step 39-8 sets the current phrase to the object phrase by piece[CUR]=piece[CBJ].

Figure 40:
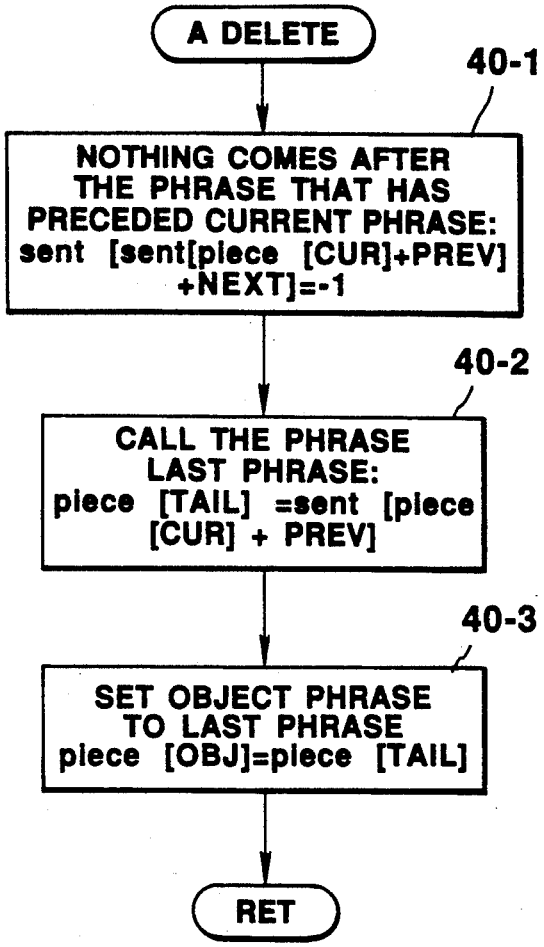
FIG. 40 is a flow chart of an A delete routine.

FIG. 40 details the A delete routine 39-3 for deleting the last phrase from the music piece. Step 40-1 changes the succeeding phrase pointer of the phrase placed before the current (last) phrase by sent[sent[piece[-CUR]+PREV]+NEXT]=−1, thus indicating that nothing comes after the phrase that has preceded the current phrase. Step 40-2 calls this phrase the last phrase by piece[TAIL]=sent[piece[CUR]+PREV]. Step 40-3 sets the object phrase to the last phrase by piece[OBJ-]piece[TAIL].

Figure 41:
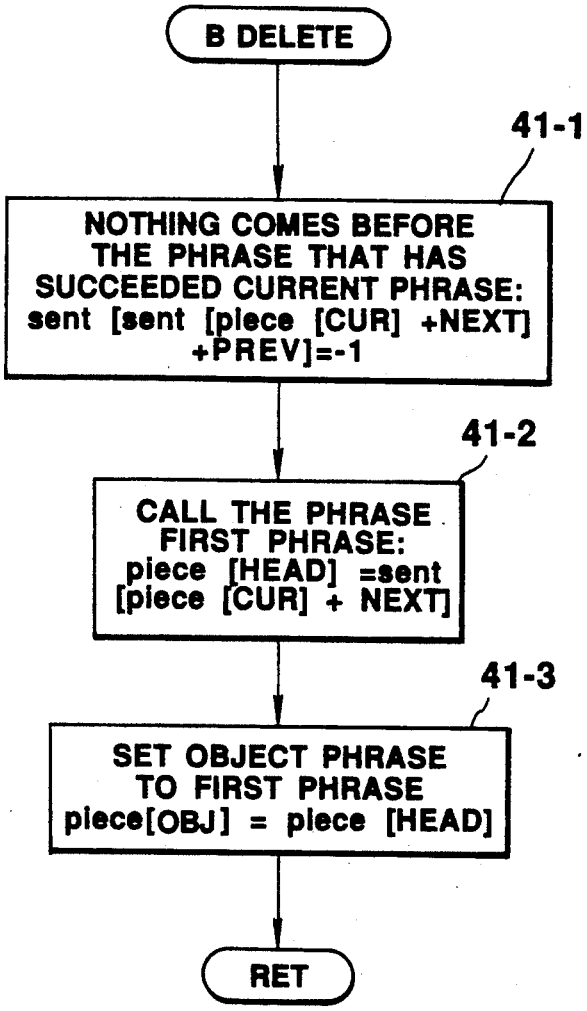
FIG. 41 is a flow chart of a B delete routine.

FIG. 41 shows details of the B delete routine 39-5 which deletes the first phrase of the music piece. Step 41-1 declares that nothing comes before the phrase that has succeeded the current (first) phrase by sent[sent-[piece[CUR]+NEXT]+PREV]=−1. Step 41-2 calls this phrase the first phrase of the music piece by piece[-HEAD]=sent[piece[CUR]+NEXT]. Step 41-3 sets the object phrase to the first phrase by piece[OBJ]=piece[-HEAD].

Figure 42:
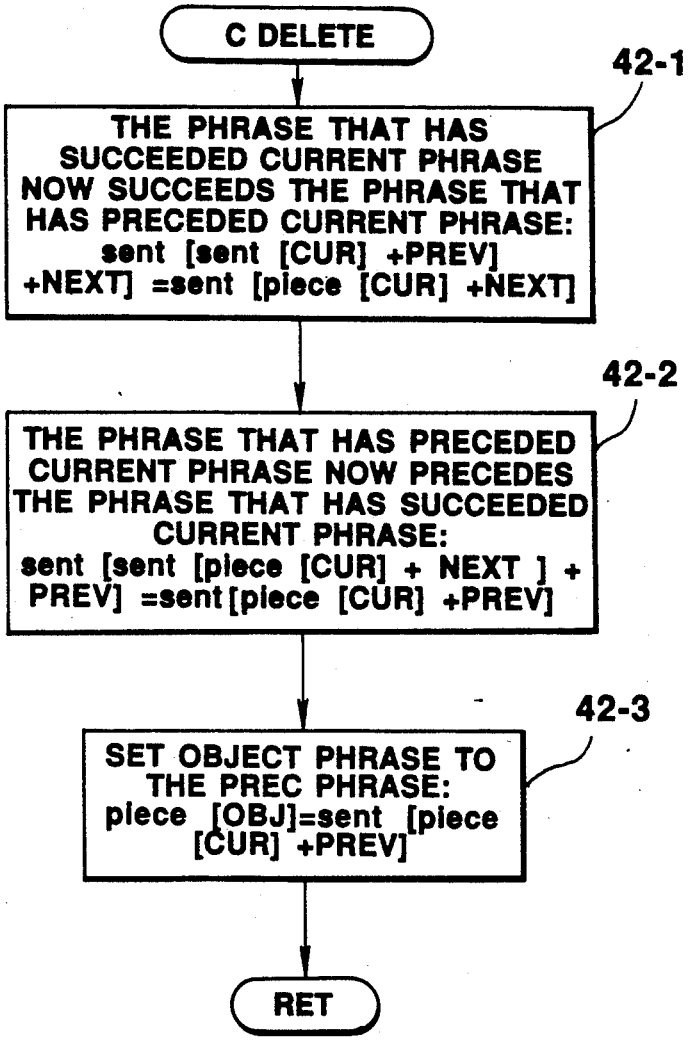
FIG. 42 is a flow chart of a C delete routine.

FIG. 42 is a detailed flow chart of the C delete routine 39-6 in FIG. 39. This routine deletes a phrase which is neither the last nor first phrase. First step 42-1 indicates that the phrase that has succeeded the current phrase now succeeds the phrase that has preceded the current phrase by sent[sent[piece[CUR]+PREV]-+NEXT]=sent[piece[CUR]+NEXT]. Step 42-2 indicates that the phrase that has preceded the current phrase (i.e., the preceding phrase of the current) now precedes the succeeding phrase of the current (i.e., the phrase that has succeeded the current phrase) by sent-[sent[piece[CUR]+NEXT]+PREV]=sent[piece[-CUR]+PREV]. Step 42-3 sets the object phrase to the preceding phrase of the (deleted) current by piece-[OBJ]=sent[piece[CUR]+PREV].

Figure 43:
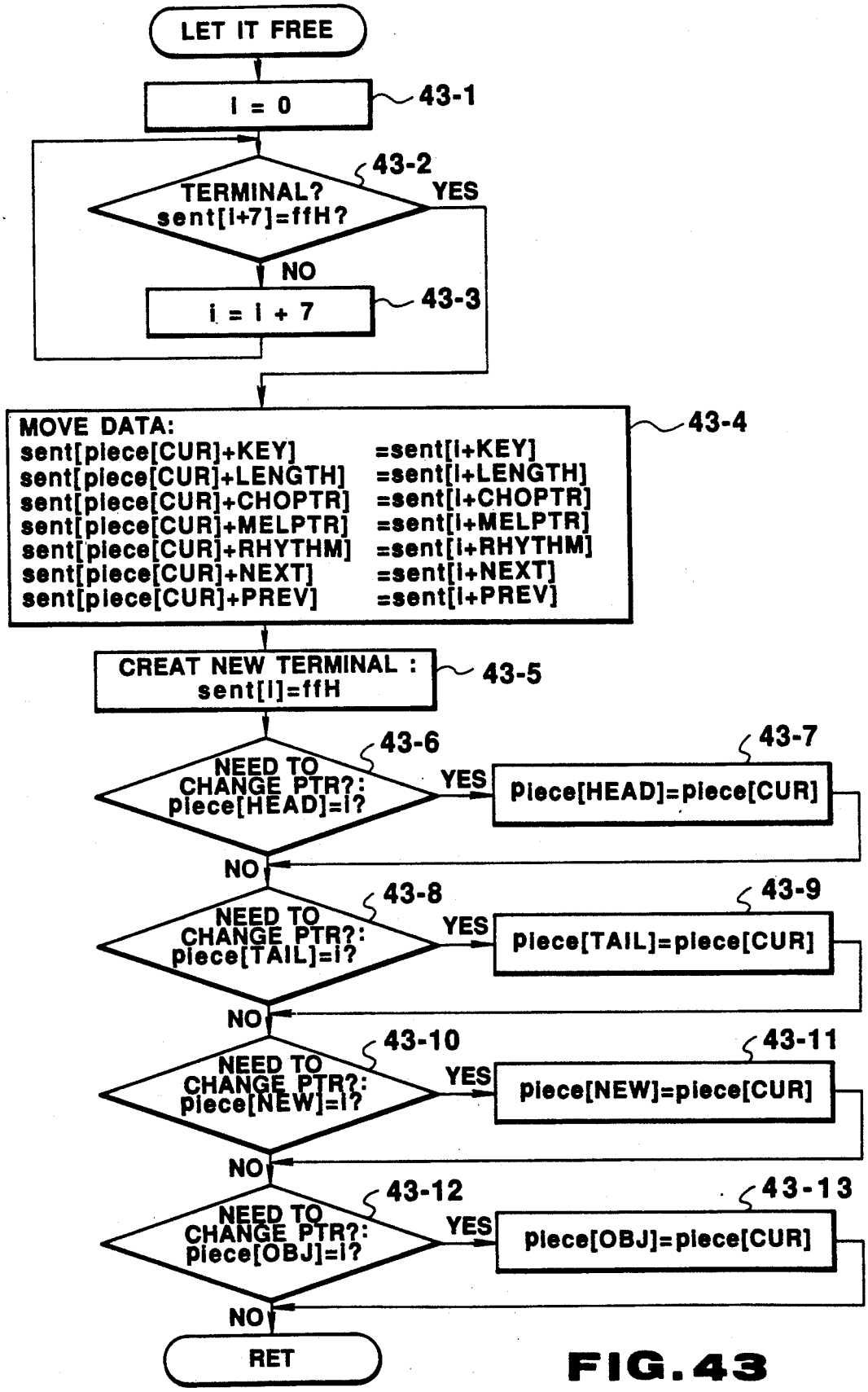
FIG. 43 is a flow chart of a let it free routine.

FIG. 43 details the let it free routine 39-7 which free a phrase storage area in the phrase chain memory sent[ ]. In 43-1 to 43-3, the routine finds out a terminal mark in the phrase chain memory. At step 43-3, the routine moves phrase data to the current (deleted) phrase storage area from the phrase storage area in front of the terminal mark to free the latter area. Then (43-5), it creates a new terminal at the entry point of the freed area. In 43-6 to 43-13, the routine updates piece managing pointers as required, arising from the data transfer 43-4. If one or more of the piece managing pointers piece[HEAD], piece[TAIL], piece[NEW] and piece-[OBJ] happen to point to the freed storage area of which data has now been transferred to the current phrase storage area, they are updated to point to the current phrase piece[CUR].

Figure 44:
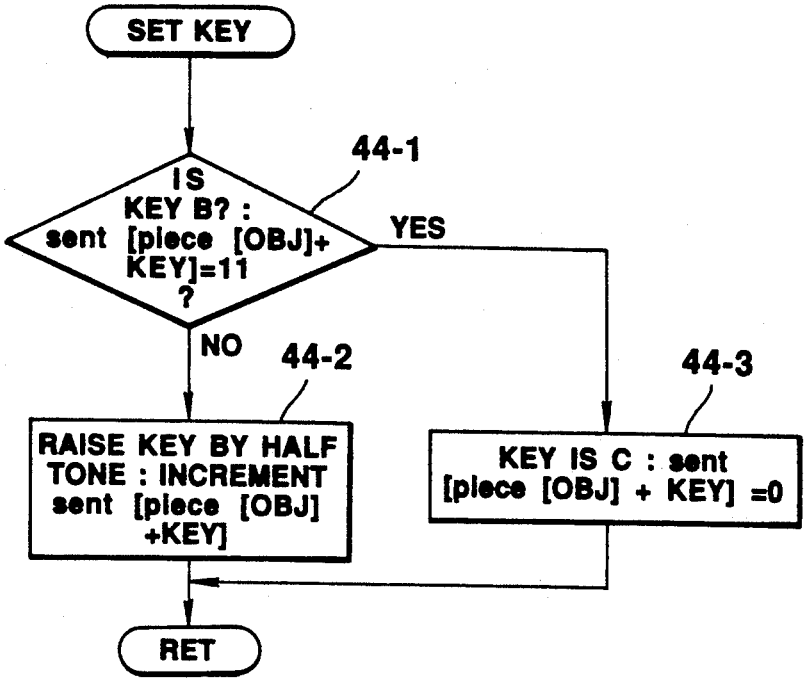
FIG. 44 is a flow chart of a set key routine.

FIG. 44 shows details of the set key routine 24-16 in FIG. 24. This routine is executed when the KEY key 593K of the phrase attribute input device 593 is depressed. The routine raises a phrase key by a half tone each time the key 593K is depressed. Specifically, if the key of the object phrase has been set to B i.e., sent-[piece[OBJ]+KEY]=11 (44-1), the routine sets sent-[piece[OBJ]+KEY]=0 to change the object phrase key to C (44-3). If the key was set to a pitch class other than B, step 44-2 increments sent[piece[OBJ]+KEY] by one to raise the key by a half tone.

Figure 45:
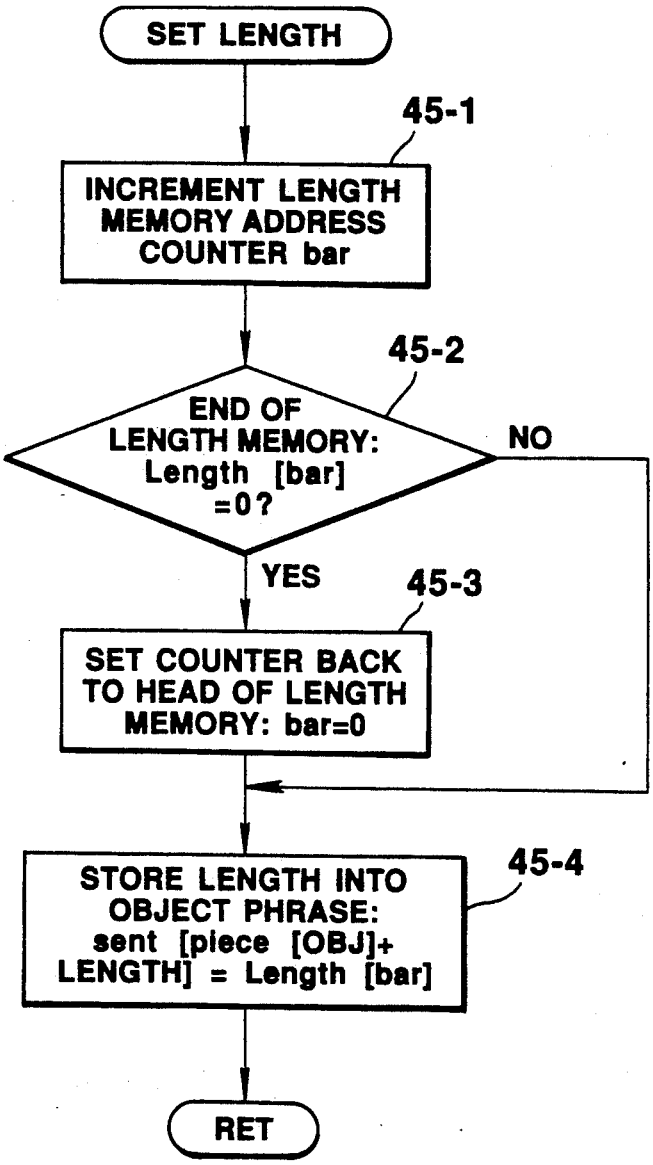
FIG. 45 is a flow chart of a set length routine.

FIG. 45 shows details of the set length routine 24-18 in FIG. 24. This routine is executed when the LEN key 593L is depressed. The purpose of the routine is to set a desired length of a phrase of the music piece. The phrase length is selected from a set of lengths stored in the length memory. To this end, step 45-3 increments the length memory address counter "bar." If it has reached the end of the length memory (45-3), the counter is set back to head of the length memory (45-3). Finally step 45-4 retrieves a length from the length memory Length[ ] at the location of "bar" and stores it into the object phrase by: sent[piece[OBJ]+LENGTH]=Length[bar].

Figure 46:
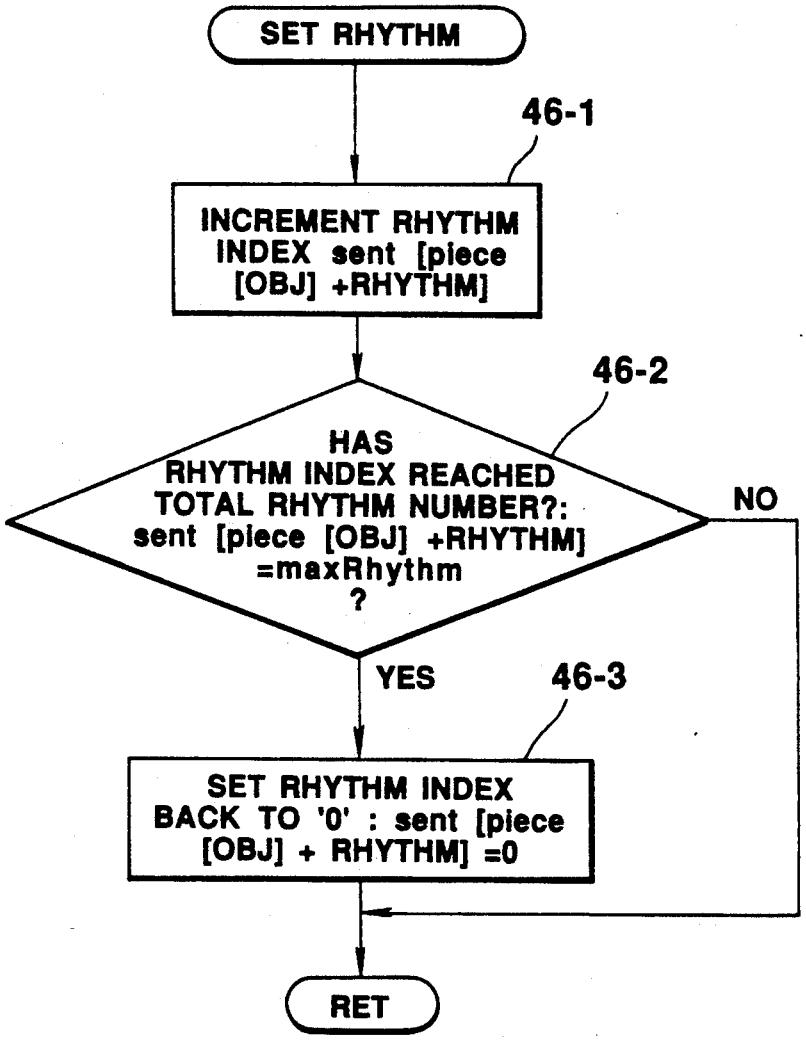
FIG. 46 is a flow chart of a set rhythm routine.

FIG. 46 is a detailed flow chart of the set rhythm routine 24-20 which is executed in response to a RHY key 593R operation. The purpose of this routine is to set a desired harmonic rhythm of a phrase of the music piece. Each time the RHY key 593R of the phrase attribute setting device 593 is depressed, the routine increments a rhythm index sent[piece[OBJ]+RHYTHM] of the object phrase so as to locate a next rhythm entry in the rhythm table memory (46-1). If the incremented rhythm index has reached the tonal rhythm number (46-2) it is set back to "0", pointing to the first rhythm entry in the rhythm table memory (46-3).

Figure 47:
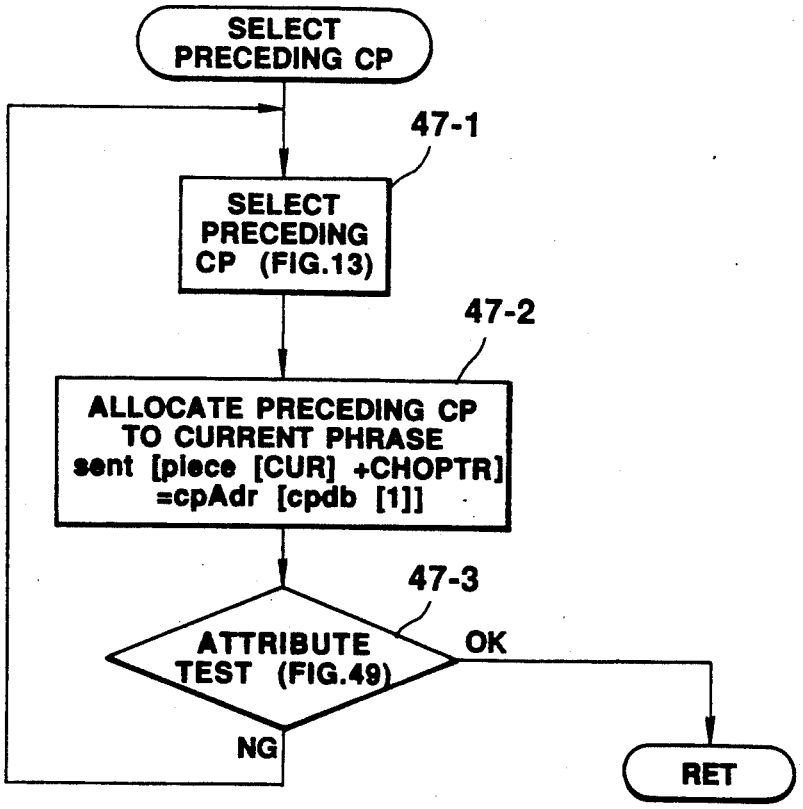
FIG. 47 is a flow chart of a select preceding CP routine.

FIG. 47 shows details of the select preceding CP routine 24-22 in FIG. 24. This routine is executed when the backward key 594D of CP select input device 594 is depressed. At 48-1, it calls the select preceding CP routine shown in FIG. 13, by which a preceding chord progression is selected from CPDB in accordance with the CP chain table. Then step 47-2 allocates the selected chord progression to the current phrase by sent[piece[CUR]+CHOPTR]=cpAdr[dpdb[1]]. At 47-3, the allocated chord progression is tested for its attributes. If the attributes (length and harmonic rhythm) of the chord progression mismatch the desired attributes of the current phrase, the routine returns to step 47-1, calling again the select preceding CP routine of FIG. 13 to select a next preceding chord progression from CPDB according to the CP chain table. As a result, the routine finds out a preceding chord progression satisfying the phrase attribute condition, and stores its index into the current phrase.

Figure 48:
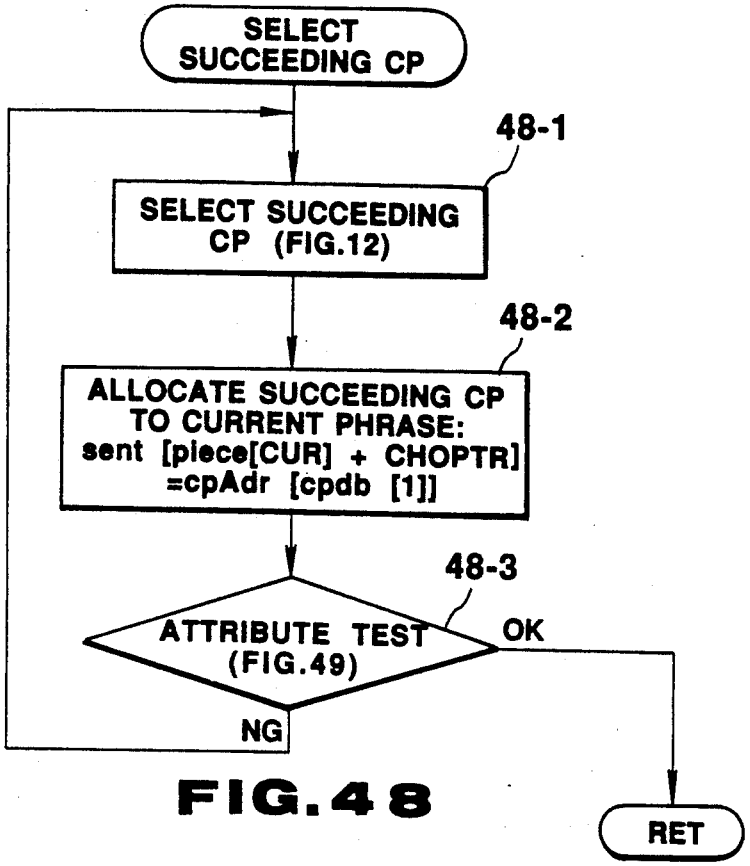
FIG. 48 is a flow chart of a select succeeding CP routine.

FIG. 48 details the select succeeding routine 24-24 in FIG. 24. This routine is executed when the forward key 594S of the phrase CP selector 594. At 48-1, the select succeeding CP routine of FIG. 12 is called to select, as a CP candidate of the current phrase, a succeeding chord progression from CPDB based on the CP chain table. Step 48-2 stores the succeeding chord progression index (pointer) into the current phrase by sent[piece[CUR]+CHOPTR]=cpAdr[cpdb[1]]. At 48-3, the succeeding chord progression is tested for its attributes. If the chord progression does not have the desired attributes set up in the current phrase, the routine returns to the step 48-1, selecting a next succeeding chord progression from CPDB based on the CP chain table. The routine ultimately finds out a succeeding chord progression meeting the phrase attribute condition and stores its index into the current phrase.

Figure 49:
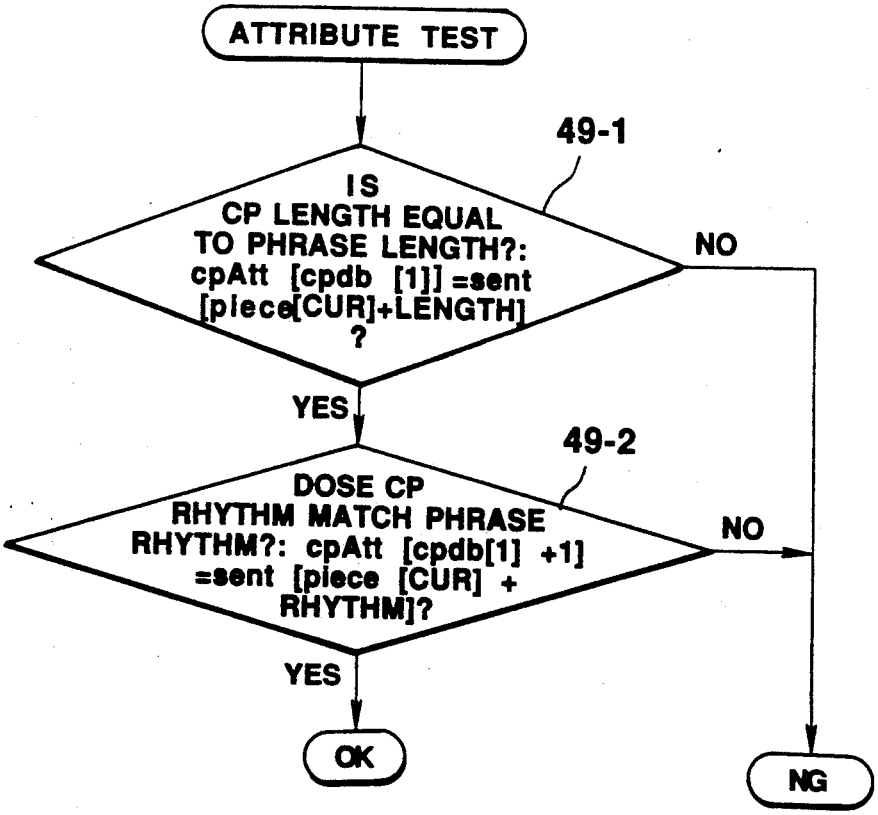
FIG. 49 is a flow chart of an attribute test routine.

FIG. 49 shows details of the attribute test routine which is called at steps 47-3 and 48-3 in FIGS. 47 and 48. First (49-1), the routine compares cpAtt[cpdb[1]] with sent[piece[CUR]+LENGTH] to see whether the CP length is equal to the phrase length. At 49-2, it compares cpAtt[cpdb[1]+1] with sent[piece[CUR]+RHYTHM] to see whether the CP harmonic rhythm matches the phrase rhythm. If the two conditions 49-1 and 49-2 are met, the attribute test routine returns with OK. Otherwise it returns with NG.

Figure 50:
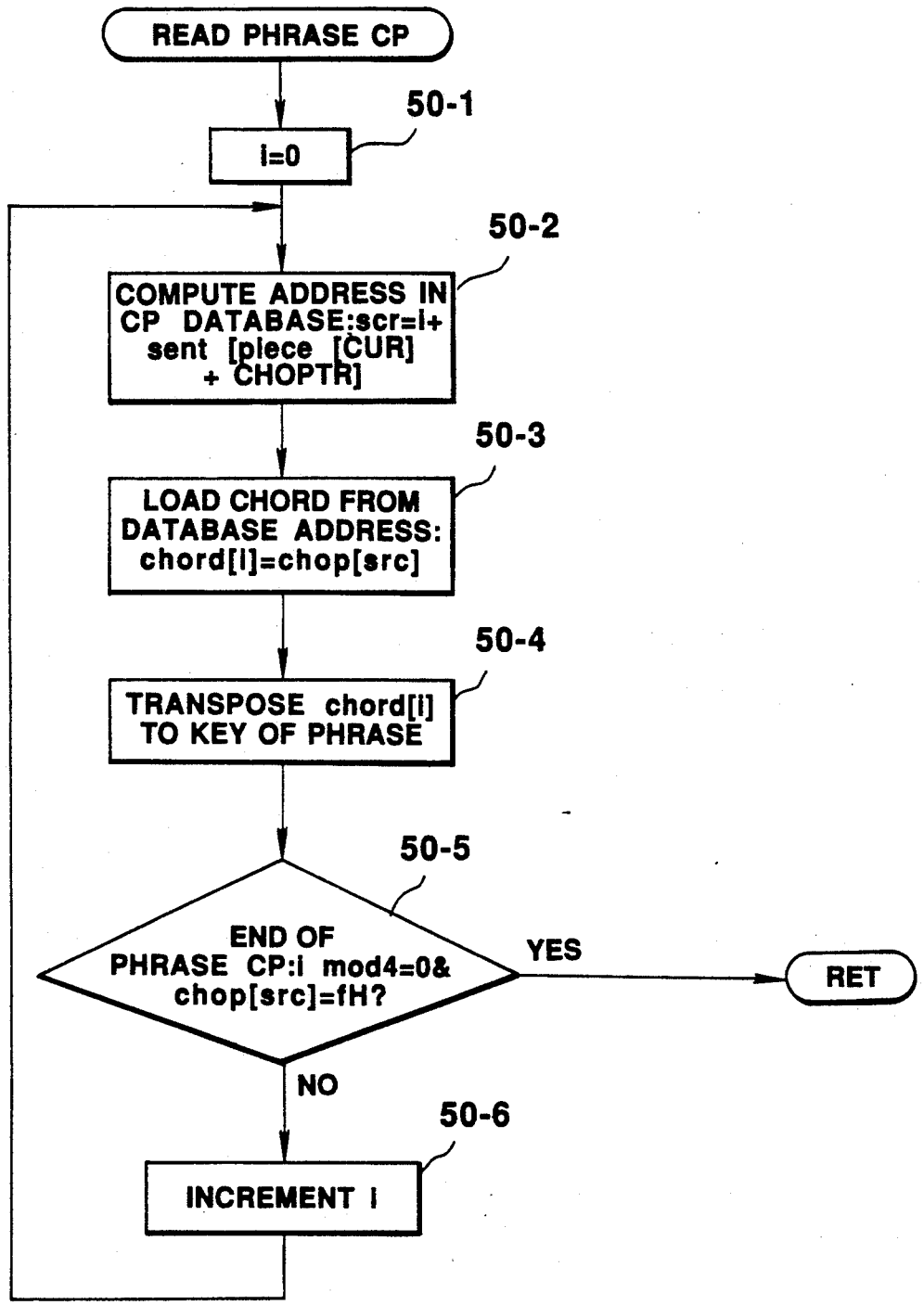
FIG. 50 is a flow chart of a read phrase CP routine.

FIG. 50 shows a read phrase CP routine which is called in the play phrase routine 24-26 in FIG. 24. In steps 50-1 to 50-6, the routine retrieves data of the current phrase chord progression from CPDB. Each chord in the retrieved chord progression is transposed to the current phrase key (50-4). The transposed chord progression data are stored into the array chord[ ]. The play phrase routine 24-26 plays (sounds) an accompaniment of the current phrase based on the chord progression array.

Figure 51:
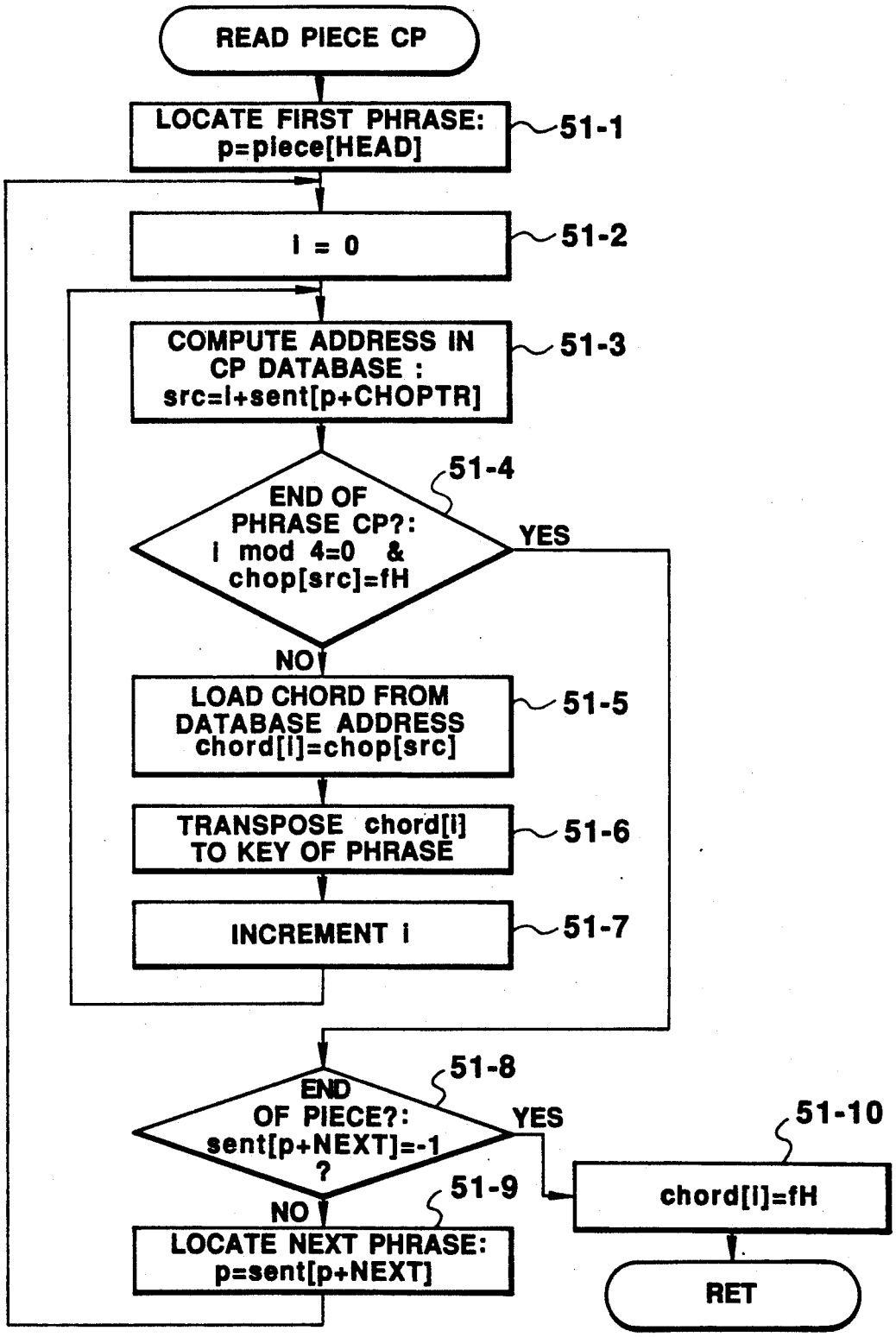
FIG. 51 is a flow chart of a read piece CP routine.

FIG. 51 shows a read piece CP routine which is called in the play piece routine 24-28 in FIG. 24. Through steps 51-1 to 51-10, the routine gets a complete chord progression of the music piece by successively reading chord progressions from CPDB in accordance with the chained CP indexes stored in the phrase chain memory sent[ ] while trasposing each chord to the associated phrase key. The data of the complete chord progression are loaded into the array chord[ ]. Using the complete music piece chord progression data, the play piece routine 24-28 plays a complete accompaniment together with the music piece melody for the user's sound test.

In this manner, the music apparatus described with respect to FIGS. 20 to 51 selects a plurality of chord progressions from CPDB 560 by means of the DB manager 570, and electronically edits the selected chord progressions in accordance with user's commands by means of the CP editor 590. Therefore, the user can easily get a desired music piece chord progression. The DB manager 570 allows the user to gain efficient access to a desired chord progression in CPDB 560 for each phrase of the music piece.

<Melody v.CP Suitability Evaluating Feature>

The description now takes up a technique of evaluating suitability between a melody and a chord progression.

Figure 52:
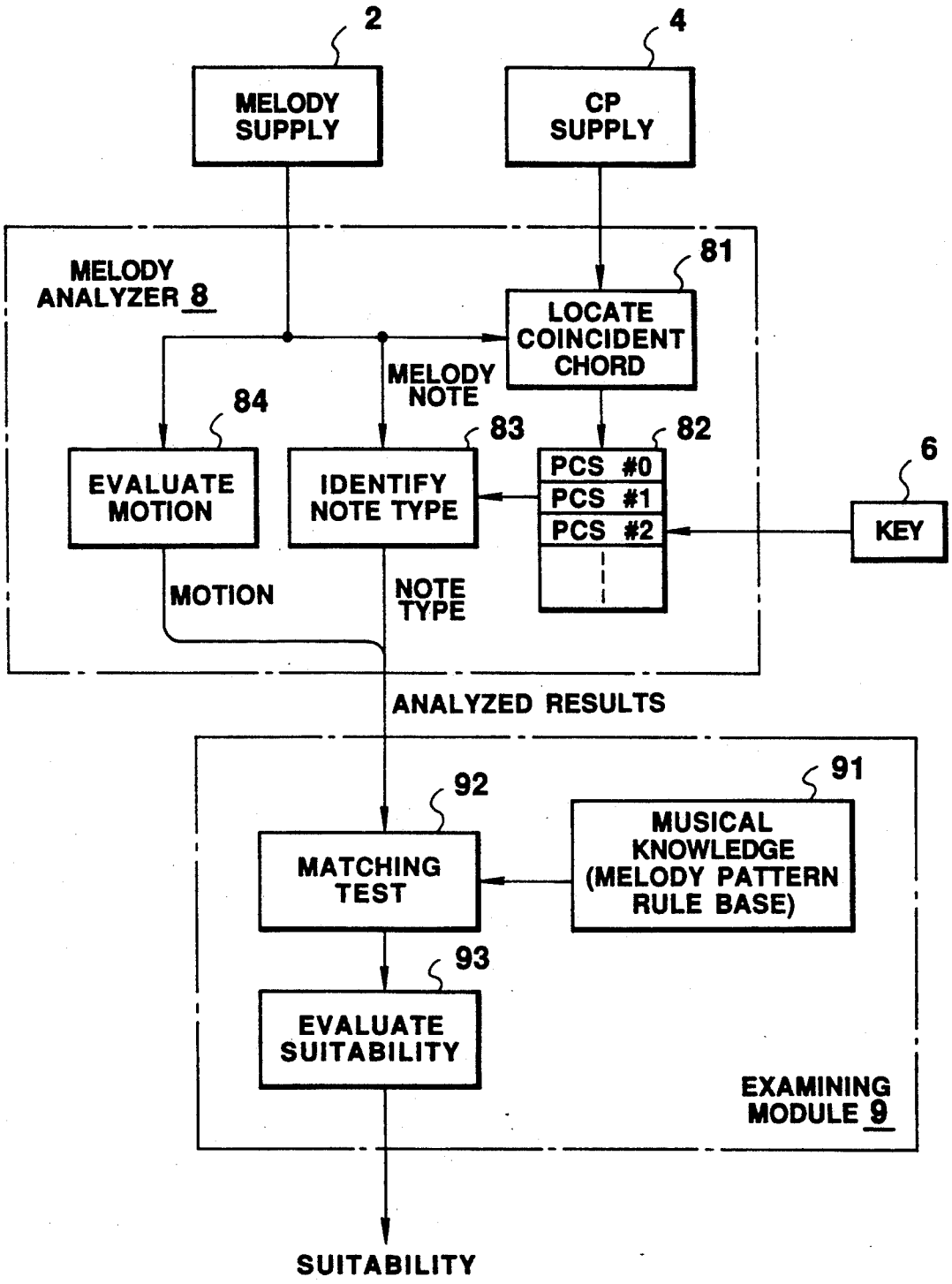
FIG. 52 is a functional block diagram of an apparatus for evaluating suitability between CP and a melody in accordance with the invention.

FIG. 52 shows a functional block diagram of an apparatus for evaluating suitability between a melody and a chord progression in accordance with the invention. The apparatus basically comprises a melody supply 2, chord progression (CP) supply 4, melody analyzer 8 and examining module 9. As a whole, the function of the apparatus is to evaluate suitability between a melody from the melody supply 2 and a chord progression from CP supply 4.

The melody analyzer 8 receives a melody from the supply 2, a chord progression from the CP supply 4 and a key from a key supply 6, and analyzes the melody based on the chord progression and the key. A coincident chord locater 81 locates a coincident chord in the chord progression which corresponds in time to each note of the supplied melody. The detected coincident chord information is supplied to a pitch class set (pcs) generator 82. A key from the key supply 6 is also received by to PCS generator 82. The PCS generator 82 generates a pitch class set of each note type based on the chord and the key. In FIG. 52, PCS#0 indicates a pitch class set of note type #0, PCS#1 indicates a pitch class set of note type#1, PCS#2 for note type#2 and so on. The note type #0 may be a "chord tone", note type#1 may be a "tension note", and note type #2 may be a "scale note." A note type identifying block 83 classifies each melody note according to PCS information of each note type supplied from the PCS generator 82. If a melody note has a pitch class included in PCS of a note type, the block 83 classifies the melody note into that note type. The classification of melody notes thus depends on the chord progression supplied from the CP supply 4. A motion evaluator 84 evaluates a motion (pitch interval) between each two adjacent notes in the supplied melody. The evaluated motions from the block 84 and the classified note types from the block 83 form the analyzed results of the melody.

The examining module 9 receives the analyzed results and examines suitability between the melody and the chord progression. The examining module 9 has a musical knowledge base of melodies (melody pattern rule base) 91. The musical knowledge base 91 may contain a set of melody patterns each allowable in music and represented by a pattern of note types and motions. A matching test submodule 92 matches the analyzed results (represented by a pattern of note types and motions) to rules in the musical knowledge base 91. A suitability evaluator 93 receives the matching test results from the block 92 and computes suitability between the melody and the chord progression. In an embodiment, the matching test block 92 separates the supplied melody into matched melody notes which have matched a melody pattern rule in the musical knowledge base 91, and mismatched melody notes which have failed to match any melody pattern rule in the musical knowledge base 91. The suitability evaluator 93 computes the proportion of the matched melody notes to the entire melody, as the suitability. In the alternative, the suitability evaluator 93 compares the proportion of the matched melody notes with a predetermined threshold. If the proportion has exceeded the threshold, the block 93 determines that the melody and the chord progression are suitable for each other.

The apparatus described above is useful particularly for a user of insufficient musical knowledge or experience since it automatically evaluates suitability between a melody and a chord progression based on stored musical knowledge.

In FIG. 52, the melody analyzer 8 is supplied with key information from an external key supply 8. If desired, however, the external key supply 8 may be omitted. The melody analyzer 8 may easily be modified such that it generates a key internally, and then determines a pitch class set of each note type from the key and a coincident chord from the coincident chord locater 81. All possible keys may be generated within the melody analyzer. In the alternative, a key extracting module may be provided which extracts a key from a supplied melody and/of chord progression.

Figure 53:
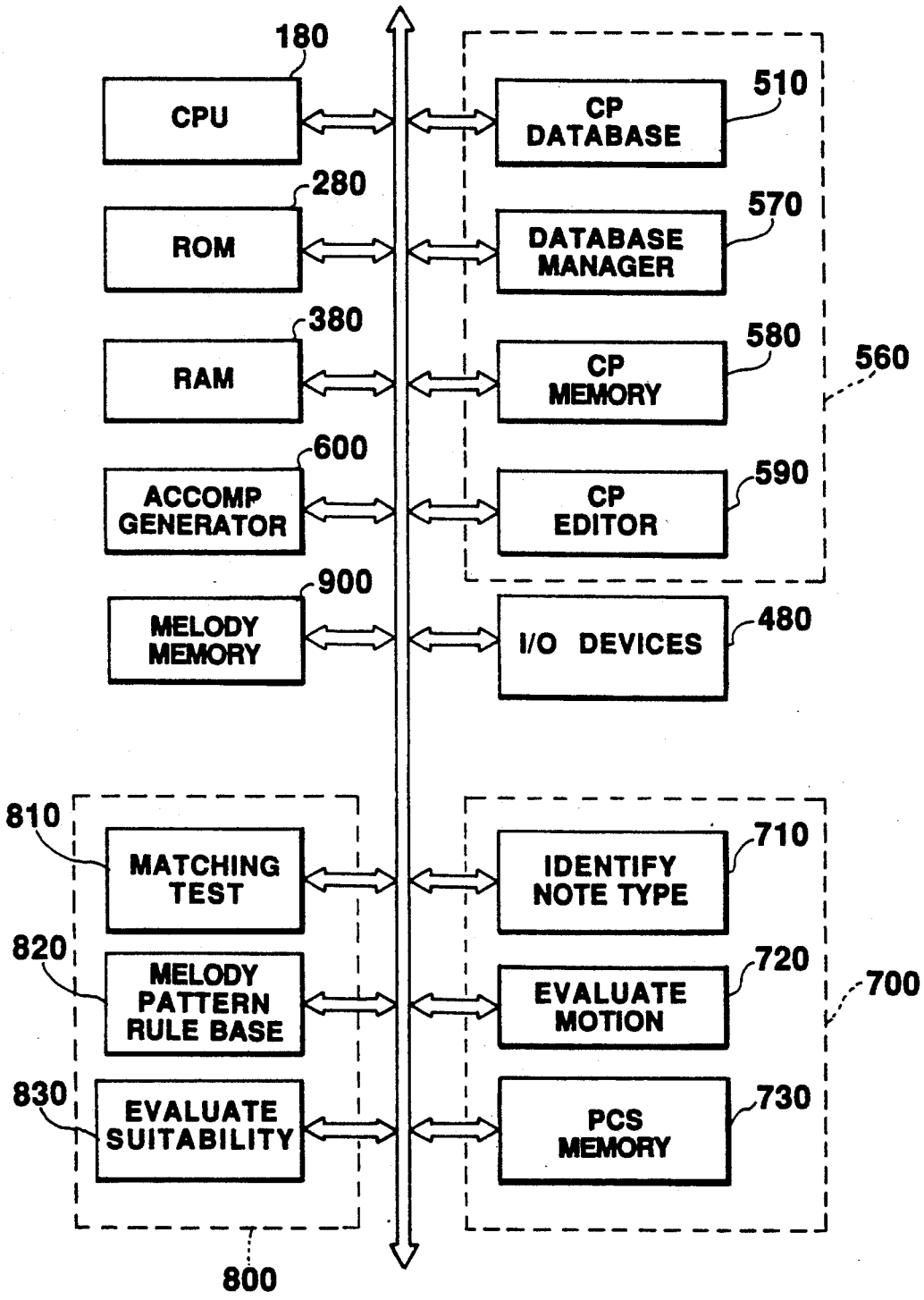
FIG. 53 is a block diagram of a computer-based music apparatus incorporating the suitability evaluating feature of the invention.

FIG. 53 shows a block diagram of a computer-based music apparatus incorporating the suitability evaluating feature. The music apparatus basically comprises, as its computer resources, a CPU180, ROM280 storing programs and permanent data, RAM380 as a working memory, and input and output (I/O) devices 480. To clarify features of the music apparatus, FIG. 53 also shows a music piece CP generator 560, a melody analyzer 700, a suitability examining module 800 an accompaniment generator 600, and a melody memory 900. Actually, these components are implemented by one or more of the computer resources mentioned above. The implementation will be obvious to those skilled in the art from the foregoing and following description, and the drawings.

The music piece CP generator 560 is identical with the corresponding component in FIG. 20, and comprises the chord progression database (CPDB) 510, DB manager 570, edited CP memory 580 and CP editor 590. A primary object of the music apparatus of FIG. 53 is to make a chord progression suitable for a melody stored in the melody memory 900. To this end, the music piece CP generator 560 selects from CPDB 510 chord progression candidates for a phrase by DB manager 570, and supplies then to the melody analyzer 700. The melody analyzer 700 in corporation with the examining module 800 finds out a chord progression suitable for each phrase melody in the memory 900. The CP editor 590 electronically edits a phrase chain of chord progressions each found suitable to produce a complete music piece chord progression which is then stored into the CP memory 580.

The melody analyzer 700 comprises a note type identifying module 710, a motion evaluator 720 and a standard PCS memory 730. The function of the melody analyzer 700 is essentially the same as that of the melody analyzer 8 in FIG. 52.

The examining section 800 comprises a matching test module 810, a melody pattern rule base (MPRB) 820 and a suitability evaluator 830. The function of the examining section 800 is essentially identical with the component 9 in FIG. 52.

The accompaniment subsystem 600, which is identical with the corresponding part of the music apparatus in FIG. 20, generates and plays a musical accompaniment according to a chord progression. With the accompaniment subsystem 600, by listening with his or her ears, a user can compare a melody with a chord progression for his or her music composition.

FIG. 54 illustrates ID data patNO of musical styles. The patNO value of "0" indicates pops, "1" indicates rock and "2" denotes jazz. The apparatus of FIG. 53 uses the style ID data to obtain bar length information. Though not employed in the embodiment, the style ID data may also be used to select from the melody pattern rule base, a rule set file associated with a particular musical style.

FIG. 55 shows a bar-length memory beat[ ]. According to the memory, pops, rock and jazz have bar-lengths of "16", "16" and "12", respectively.

FIG. 56 illustrates not type ID data. According to the illustrated data, chord tone is represented by "0", scale note by "1", tension note by "2", available note by "3", avoid note by "4" and any note by "5".

FIG. 57 illustrates ID data of motion direction. "+" motion (i.e., pitch rises in moving from one note to another) is numerically repesented by 0, "−" motion (i.e., pitch falls) is denoted by 1, "0" motion (i.e., no change of pitch) is denoted by 2, and motion in "any" direction is represented by 3.

FIG. 58 illustrates ID data of motion magnitude or distance. The same pitch of two successive notes is denoted by 0, "half tone motion" by 1, "stepwise or conjunct motion" by 2, "whole tone motion" by 3, "leap or disjunct motion" by 4, and "motion of any magnitude" by 5.

FIG. 59 shows a map of a tension note PCS memory. All PCS entries are standardized by (written in) key C. Each address of the tension note PCS memory denotes a different chord type with each other, and stores a corresponding PCS (pitch class set) of tension note.

FIG. 60 illustrates a map of a chord tone PCS memory. All PCS data entries are standardized by key C. Each address of the chord tone PCS memory denotes a different chord type and stores a corresponding PCS of chord tone.

FIG. 61 illustrates a list of main constants and variables. The combination of mpDB, melp[ ] and fNote[ ] constitutes the melody pattern rule base (MPRB) 820 in FIG. 53. The pointer mpDB locates the start address of the memory melp[ ]. The memory melp[ ] forms a MPRB header. An even-numbered element of the MPRB header, melp[i×2+0] points to i-th melody pattern rule while the next odd-numbered element melp[i×2+1] is a flag indicative of presence/absence of a next melody pattern rule. The array fNote[ ] forms MPRB main and stores a set of melody pattern rules. Each melody pattern rule describes a pattern of abstract notes fNotes. Each abstract note fNote has four elements. The first element fNote[4×i+NTYPE] indicates a note type. The second element fNote[4×i+ITYPED] indicates a direction of motion in going from one fNote to another. The third element fNote[4×i+ITYPEM] represents a magnitude of the motion. The fourth element fNote[4×i+NEXT] points to a next fNote.

The combination of Melody and Note[ ] constitutes the melody memory 900 in FIG. 53. The pointer Melody locates head of the array Note[ ] which stores a melody in the form of a note sequence. Each melody note Note in Note[ ] has eight data elements. Note[i×8+NTYPE] indicates a note type of i-th melody note. Note[i×8+ITYPED] indicates a direction of motion in going from i-th melody note to (i+1)-th note. Note[i×8+ITYPEM] represents a magnitude of the motion. Note[i×8+NEXT] points to a next note (if any). Note[i×8+PCLAS] indicates a pitch class of the i-th melody note. Note[i×8+OCT] indicates an octave of the i-th melody note. Thus, the combination of Note[i×8+PCLAS] and Note [i×8+OCT] defines the note pitch. Note[i×8+DUR] represents a duration of the i-th note. Note[i×8+DEC] is a test flag. In these eight elements, the next note pointer Note[i×8+NEXT], pitch class Note[i×8+PCLAS], octave Note[i×8+OCT] and duration Note[i×8+DUR] are determined when the melody memory 900 is loaded with a melody from the melody input device. Then, the note type Note[i×8+NTYPE], motion direction Note[i×8+ITYPED] and motion magnitude Note[i×8+ITYPEM] are determined by the melody analyzer 700 which it has analyzed the melody. Finally, the examining module 800 specifies the test flat Note[i×8+DEC] by matching the melody to MPRB rules.

A variable Rate indicates suitability between a melody and a chord progression. Rate is computed by the examining module 800.

A variable Th indicates a suitability threshold. Th is used to see whether a chord progression is suitable for a melody or not.

Variables ptrN, ptrS, ptrMP, ptrFN, pN and pFN represent various pointers.

FIG. 62 illustrates the melody pattern rule base (MPRB). Code of "−1" located at an odd address of melp[ ], here, 03H address, indicates the end of MPRB (i.e., no more melody pattern rule). According to the melody pattern rule #1 in the memory fNote[ ] in FIG. 62, a first melody pattern begins with a chord tone, then moving to a scale note by an upward (+) stepwise motion, and ending with another chord tone by an upward stepwise motion from the scale note. Code "−1" stored at 0bH of the memory fNote[ ] indicates the end of the melody pattern rule #1. In this manner, each melody pattern rule describes a pattern of note types and motions.

Figure 63:
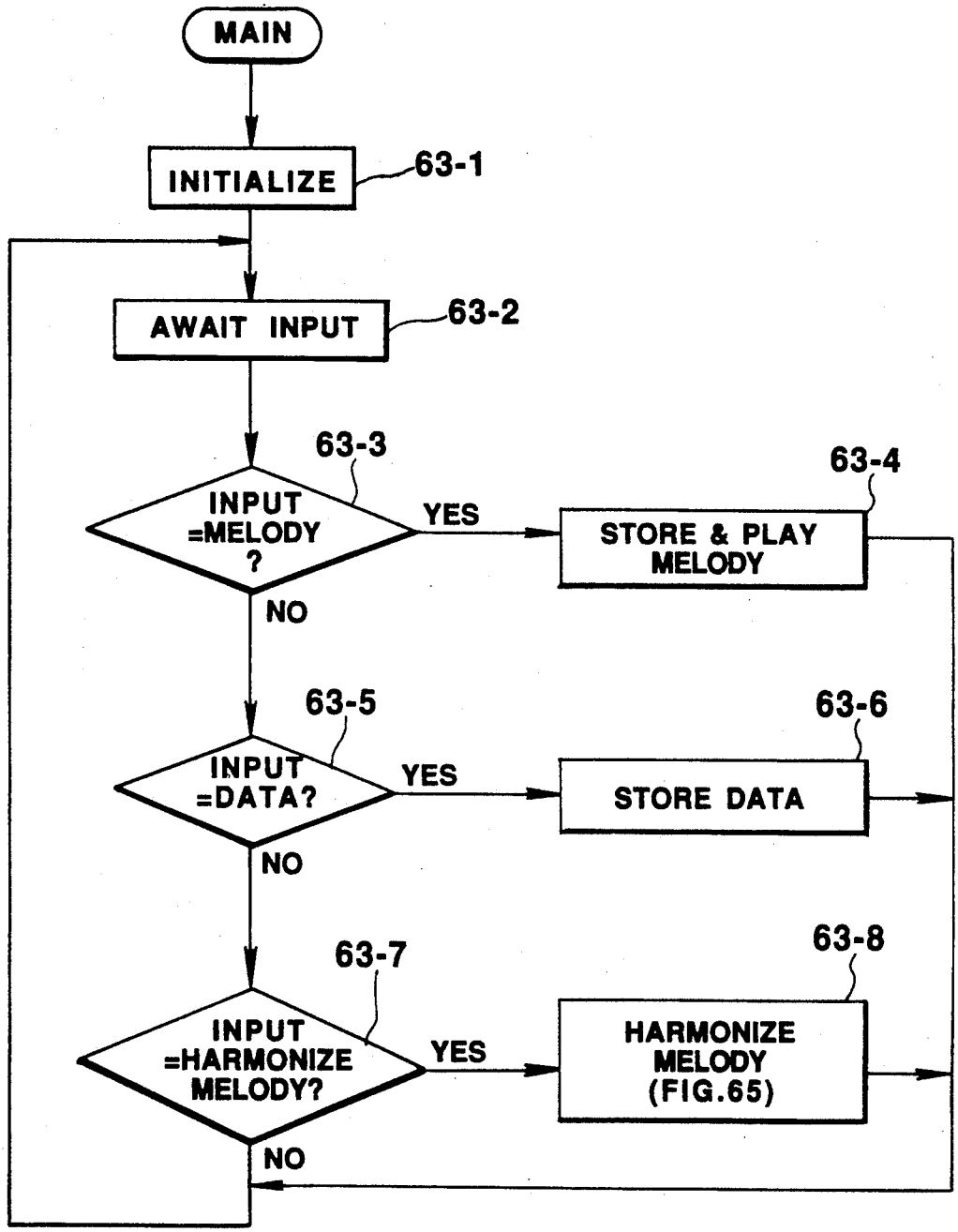
FIG. 63 shows a main flow chart of an the apparatus in FIG. 53.

FIG. 63 shows a flow chart of a main program of the music apparatus in FIG. 53, stored in ROM280 and executed by CPU180. At 63-1, the main program initializes the system. In the main loop, the program awaits an input from the input devices (63-2), and when an input is detected, a corresponding routine is executed. Specifically, when an melody is entered (63-3), a routine 63-4 is executed to store the melody into the melody memory 900. Also, in the routine 63-4, a melody play routine is called and executed to play (sound) the melody through a digital tone generator. When a melody harmonizatin request is entered (63-7), a harmonize melody routine 63-8 is executed, producing a chord progression suitable for the melody. When other data or commands are entered (63-5), corresponding routines are called and executed to store the data or handle the commands (63-6). The blocks 63-5 and 63-6 comprise steps 24-3 to 24-20 and 24-25 to 24-28 in FIG. 24.

FIG. 64 illustrates music piece structuring data, which are managed by the CP editor 590 in FIG. 53. An array piece[ ] includes a set of music piece management pointers; piece[HEAD] pointing to the first phrase of a music piece, piece[CUR] pointing to the current phrase of the music piece, piece[TAIL] pointing to the last phrase, piece[NEW] pointing to a new phrase to be added to the music piece, and piece]OBJ] pointing to the object phrase. A music piece form is defined by a chain of phrases. An array sent[ ] forms the phrase chain memory. Each phrase has seven data elements; sent[7×i+KEY] indicates a phrase key, sent[7×i+LENGTH] indicates a phrase length, sent[7×i+CHOPTR] indicates a phrase chord progression by indexing a chord progression entry in CPDB 510, sent[7×i+MELPTR] indicates a phrase melody by indexing a corresponding melody portion in the melody memory 900, sent[7×i+RHYTHM] indicates a phrase harmonic rhythm by indexing a rhythm entry in the rhythm table memory, sent[7×i+NEXT] points to a succeeding phrase, and sent[7×i+PREV] points to a preceding phrase.

Figure 65:
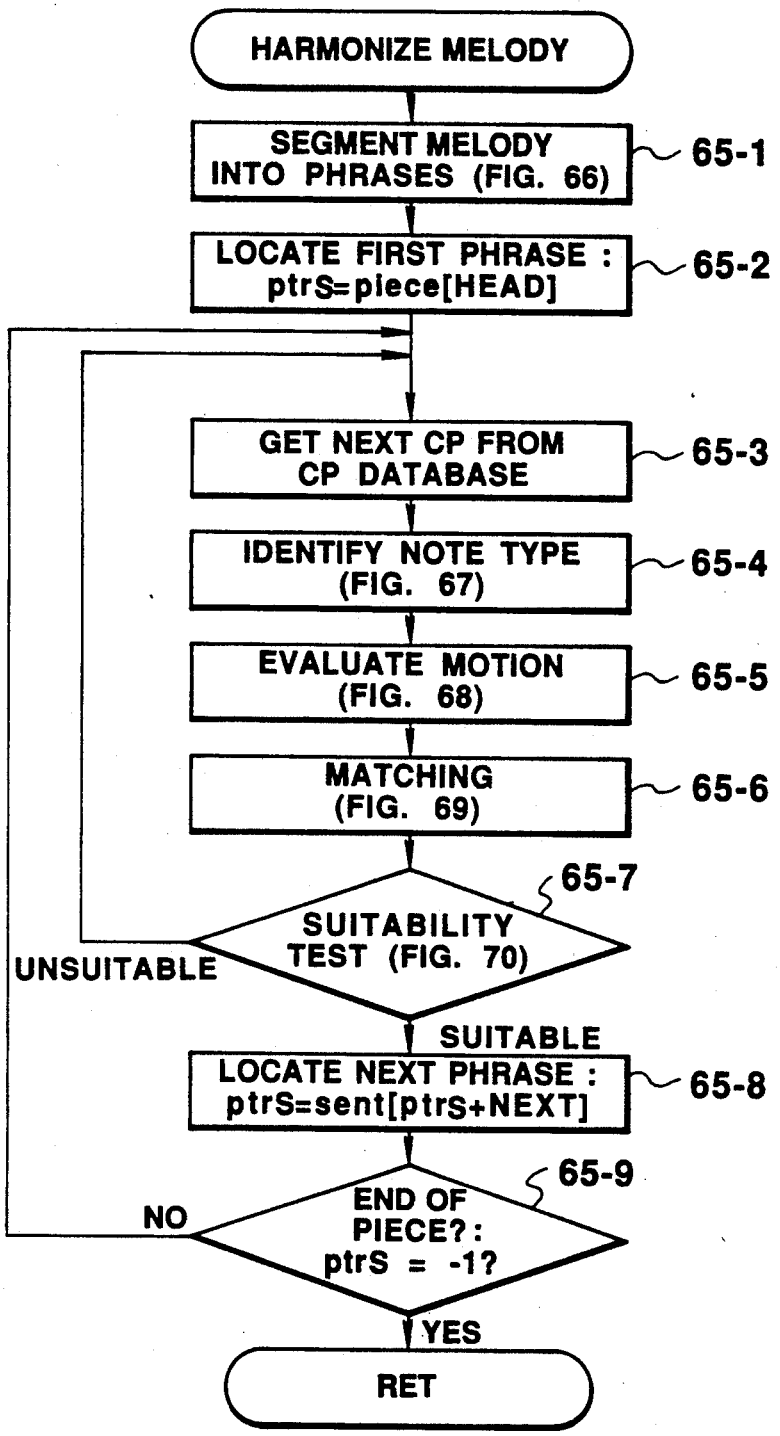
FIG. 65 is a flow chart of a harmonize melody routine.

FIG. 65 shows the harmonize melody routine 63-8 in FIG. 63. The object of this routine is to produce a chord progression suitable for the melody stored in the melody memory 900. At 65-1 the routine segments the melody into phrases. As a result, melody index sent[7×i+MELPTR] of each phrase in the phrase chain memory points to a corresponding melody segment in the melody memory 900. Step 65-2 locates the first phrase of the music piece (phrase chain) by ptrS=piece[HEAD]. In the loop of 65-3 to 65-7, the harmonize melody routine searches through CPDB 510 for a chord progression suitable for a phrase melody of interest. Step 65-3 gets from CPDB 510 a next chord progression which is consistent with the phrase attributes, i.e., having the selected phrase length and harmonic rhythm, and transposed to the phrase key. Step 65-4 identifies the note type of each melody note in the phrase. Step 65-5 evaluates motion between each two successive melody notes of the phrase. Step 65-6 matches the melody analyzed results (obtained from steps 65-4 and 65-5) to MPRB rules. These melody notes to which a melody pattern rule in MPRB 80 has successfully applied are recorded with "matched" by setting their test flag Note[i×8+DEC] to a matched value of 1. Step 65-7 tests suitability of the chord progression based on the matching test results. If the chord progression is found suitable, it remains in the phrase by the chord progression index sent[7×i+CHOPTR]. Then at 65-8, the routine locates the next phrase by ptrS=sent[ptrS+NEXT]. The process of 65-3 to 65-8 repeats until the piece end is detected at 65-9.

Figure 66:
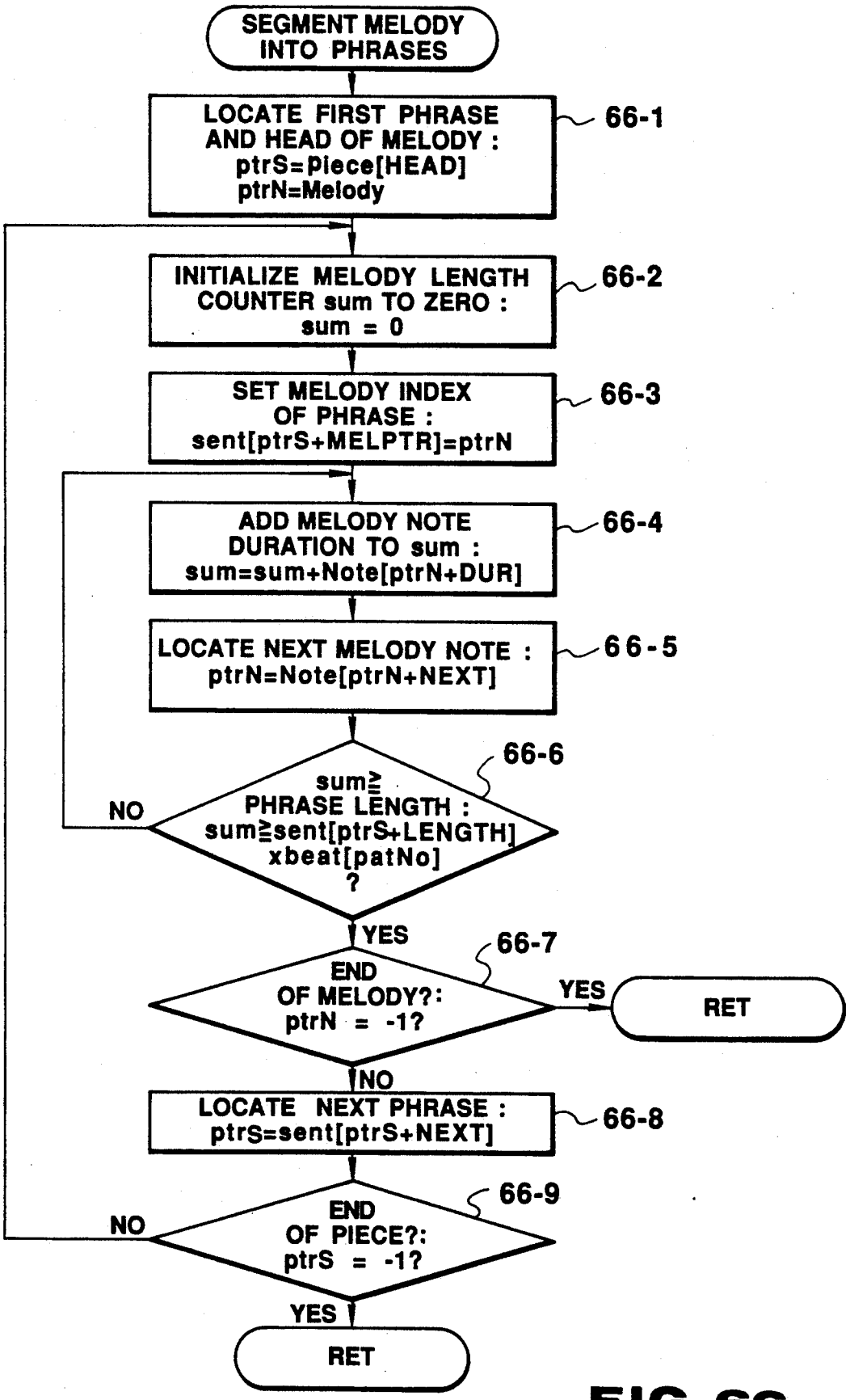
FIG. 66 is a flow chart of a segment melody into phrases routine.

FIG. 66 shows details of the segment melody into phrases routine 65-1 in FIG. 65. First (66-1), the routine locates the first phrase and the melody head by ptrS=piece[HEAD] and ptrN=Melody. The first step 66-2 of the loop 66-2 to 66-9 initializes a phrase melody length counter to zero by sum=0. Step 66-3 sets the melody index of the phrase by sent[ptrS+-MELPTR]=ptrN. An inner loop 66-4 to 66-6 accumulates durations of melody notes from the melody memory until the sum reaches the phrase length sent[ptrS+-LENGTH], while moving the melody note pointer ptrS. If the end of melody has not yet been reached (66-7), the routine proceeds to step 66-8 to locate the next phrase by ptrS=sent[ptrS+NEXT]. If the piece end (ptrS=−1) has not yet been reached, the routine returns to 66-2 to continue melody segmentations. The routine terminates either at the melody end (66-7) or at the piece end (66-9).

Figure 67:
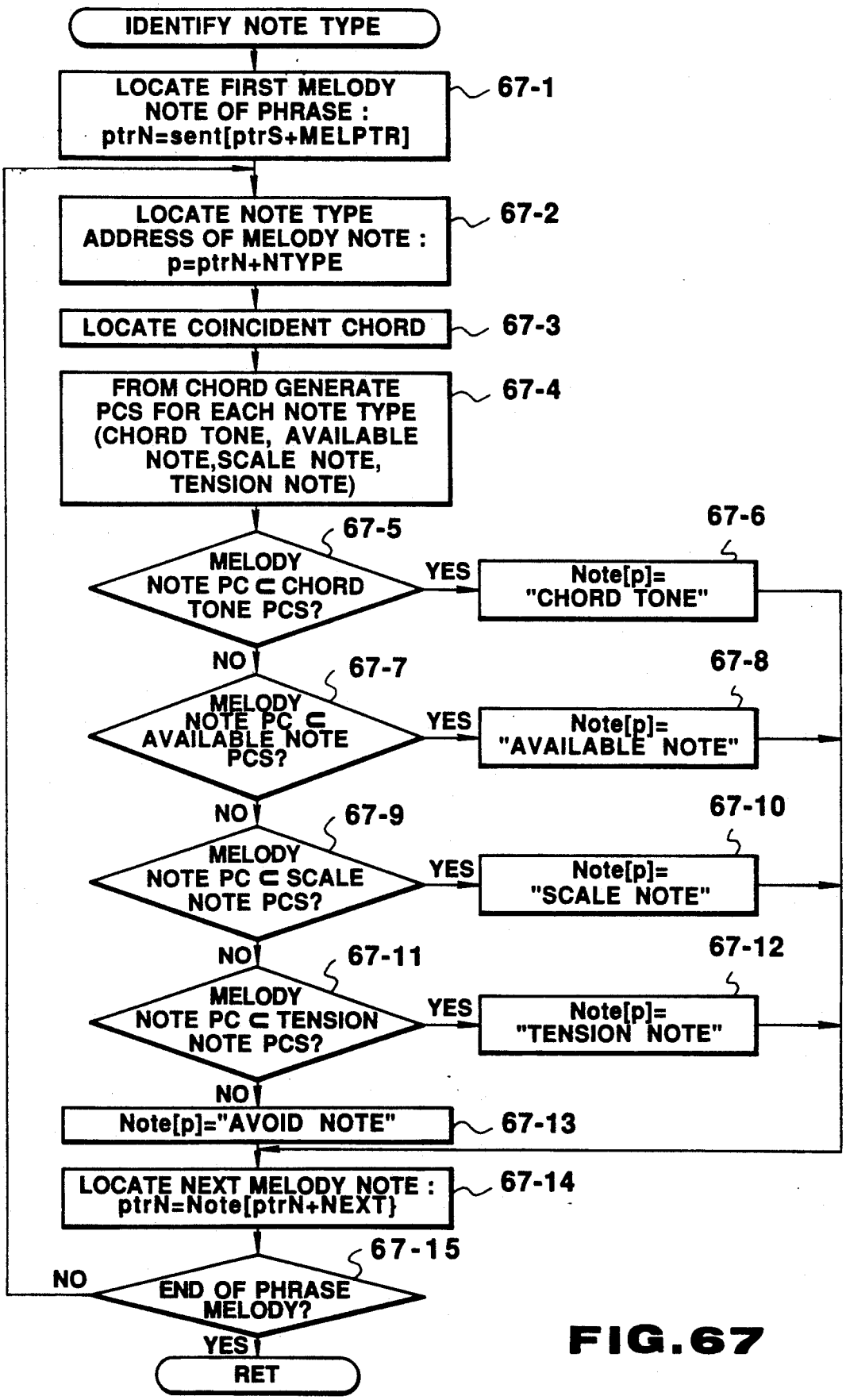
FIG. 67 is a flow chart of a identify note type routine.

FIG. 67 shows details of the identify note type routine 65-4. First (67-1), the routine locates the first melody note of a phrase of interest by ptrN=sent[ptrS+-MELPTR]. At the first step 67-2 in the loop 67-2 to 67-15, the routine locates the note type address of a melody note in question by p=ptrN+NTYPE. Then step 67-3 locates a coincident chord (in a chord progression obtained by step 65-3 from CPDB) which corresponds in time to the melody note. At step 67-4, the routine determines from the coincident chord a pitch class set (PCS) of each note type, i.e., chord tone PCS, available note PCS, scale note PCS and tension note PCS. The chord tone PCS is obtained by looking up the standardized chord tone PCS memory (FIG. 60), getting the standardized chord tone PCS for the type of the coincident chord, and transposing it to the root of the coincident chord. The tension note PCS is obtained by looking up the standardized tension note PCS memory (FIG. 59), getting the standardized tension note PCS for the coincident chord type, and transposing it to the coincident chord root. The scale note PCS is obtained from the phrase key. The available note PCS is specified by those pitch classes common to the scale note PCS, and the logical OR of the chord tone PCS and tension note PCS.

In steps 67-5 to 67-13, the routine identifies the note type of the melody note by comparing the melody note pitch class (PC) with each note type PCS. Specifically, if the melody note PC is included in the chord tone PCS (67-5), the melody note is classified as a chord tone (67-6). If the melody note PC is an element of the available note PCS (67-7), the melody note is identified an available note (67-8). If the melody note PC is included in the scale note PCS (67-9), the melody note is a scale note (67-10). The melody note is a tension note if its PC is an element of the tension note PCS (67-11, 67-12). If none of the chord tone PCS, available note PCS, scale noted PCS and tension note PCS includes the melody note PC, the melody note is classified as an avoid note (67-13).

At 67-14, the routine locates the next melody note by ptrN=Note[ptrN+NEXT]. The loop 67-2 to 67-15 repeats until the end of the phrase melody is detected at 67-15.

Figure 68:
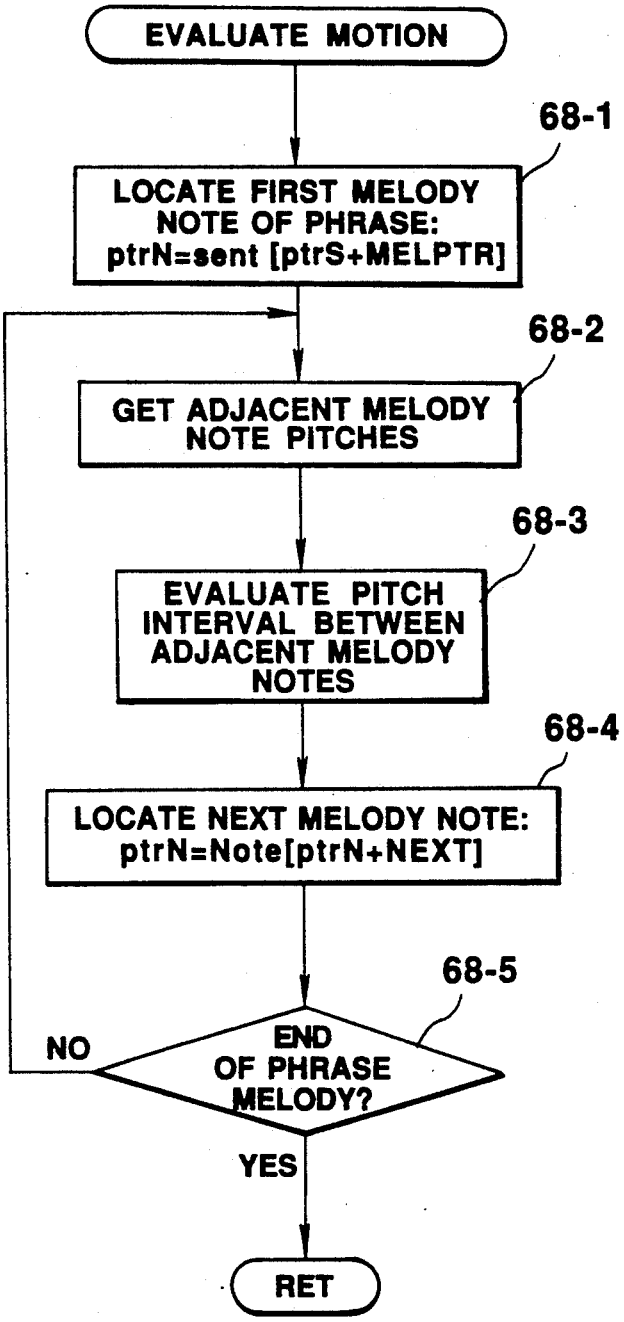
FIG. 68 is a flow chart of a evaluate motion routine.

FIG. 68 shows details of the evaluate motion routine 65-5. First (68-1), the routine locates the first note of the phrase melody by ptrN=sent[ptrS+MELPTR]. In the loop of 68-2 to 68-5, it evaluates a motion of each note to its next note. The step 68-2 gets two successive note pitches (specified by ptrN and its next note). The step 68-3 evaluates a motion (pitch interval) between the two notes with respect to its direction and magnitude. The evaluated motion direction is stored into Note-[i×8+ITYPED]. The evaluated motion magnitude is stored into Note[i×8+ITYPEM]. The step 68-4 locates the next melody note by ptrN=Note[ptrN-+NEXT]. The loop of 68-2 to 68-5 iterates until the end of the phrase melody is detected at 68-5.

Figure 69:
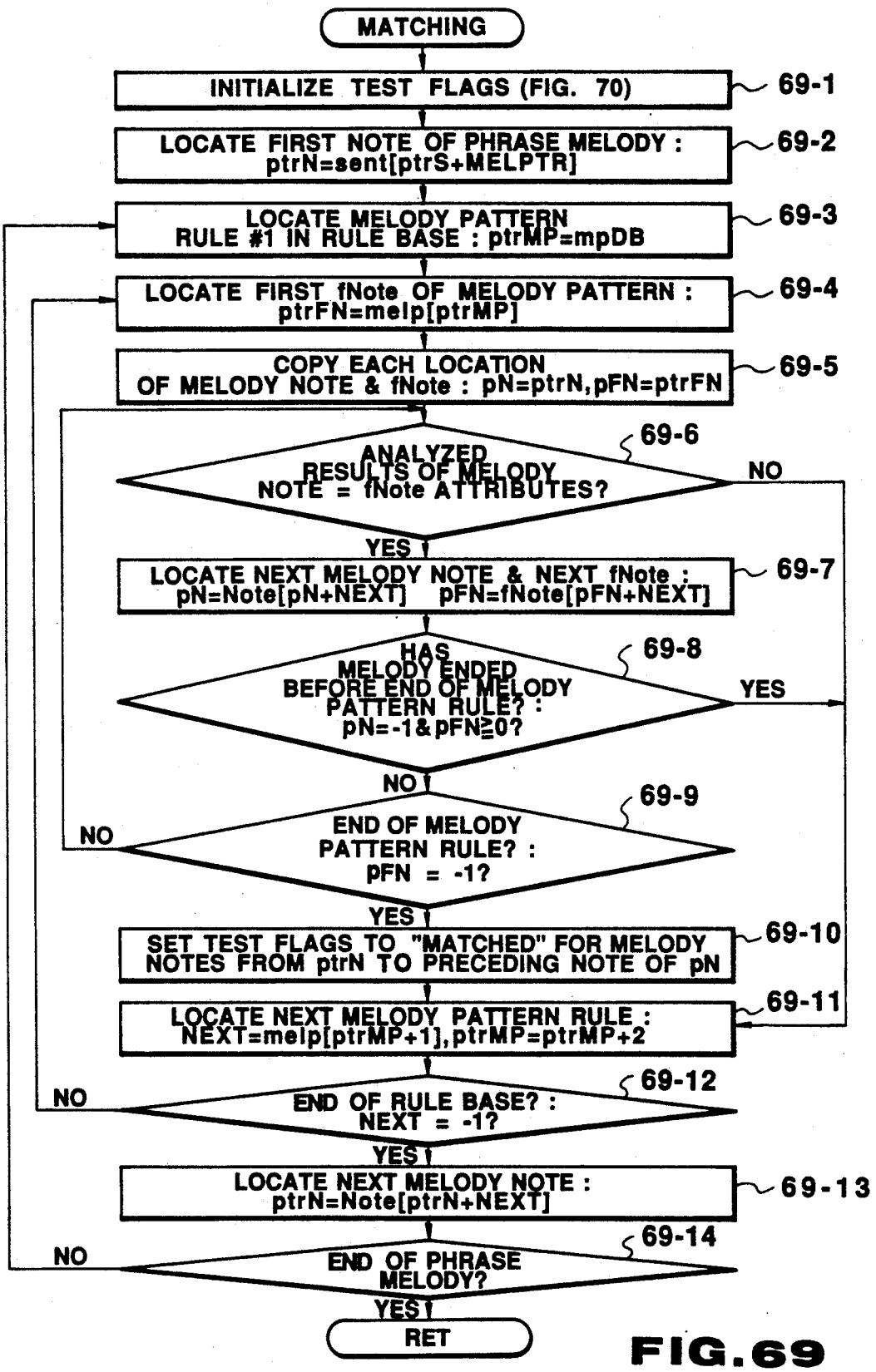
FIG. 69 is a flow chart of a matching routine.

FIG. 69 details the matching routine 65-6. First (69-1), the routine initializes matching test flags of the phrase melody notes. At 69-2, it locates the first note of the phrase melody by ptrN=sent[ptrS+MELPTR]. At the entry 69-3 of the outermost loop 69-3 to 69-14, the routine locates the first melody pattern rule in MPRB 820 by ptrMP=mpDB.

In the middle loop of 69-4 to 69-12, the routine matches a sequence of melody notes (starting from a melody note specified by ptrN) to the MPRB 820. At the entry 69-4 of the middle loop, the first fNote of a melody pattern rule is located by ptrFN=melp[ptrMP]. At 69-5, each location of the melody note and fNote is copied by pN=ptrN and pFN=ptrFN.

In the innermost loop of 69-6 to 69-9, the matching routine examines the melody note sequence to see whether it matches a melody pattern rule of interest. Step 69-6 checks whether the analyzed results (note type, motion direction, motion magnitude) of a melody note in question matches attributes (note type, motion direction and magnitude) of a fNote of the melody pattern rule. If matched, step 69-7 locates the next melody note and the next fNote by pN=Note[pN+NEXT] and pFN=fNote[pFN+NEXT]. If the melody has not ended before the melody pattern rule reaches its end (69-8), step 69-9 checks as to whether the melody pattern rule has ended. If a melody note sequence has matched a melody pattern rule, this causes the step 69-9 to detect the terminal of that melody pattern rule. Thus, the step 69-10 sets test flags to "matched" for melody notes from ptrN to the preceding note of pN. Then, step 69-11 locates the next pattern rule in MPRB 820 by NEXT=melp[ptrMP+1] and ptrMP=ptrMP+2. If the analized results of a melody note mismatch fNote attributes (69-6), or if the melody has ended within a melody pattern rule (69-8), this indicates that the melody pattern rule has failed to apply to the melody note sequence, so that the routine directly proceeds to the step 69-11 to locate the next melody pattern rule.

Step 69-12 checks NEXT to see whether the end of MPRB has been reached. If not, the routine returns to the step 69-3. If the entire MPRB has been scanned (NEXT=−1), the routine proceeds to step 69-13 to locate the next melody note by ptrN=Note [ptrN+NEXT]. If the phrase melody has not yet ended (16-14), the routine returns to the step 69-3. If ended, the matching routine terminates.

In this manner, those melody notes to which a melody pattern rule has successfully applied are marked by their "matched" test flags.

Figure 70:
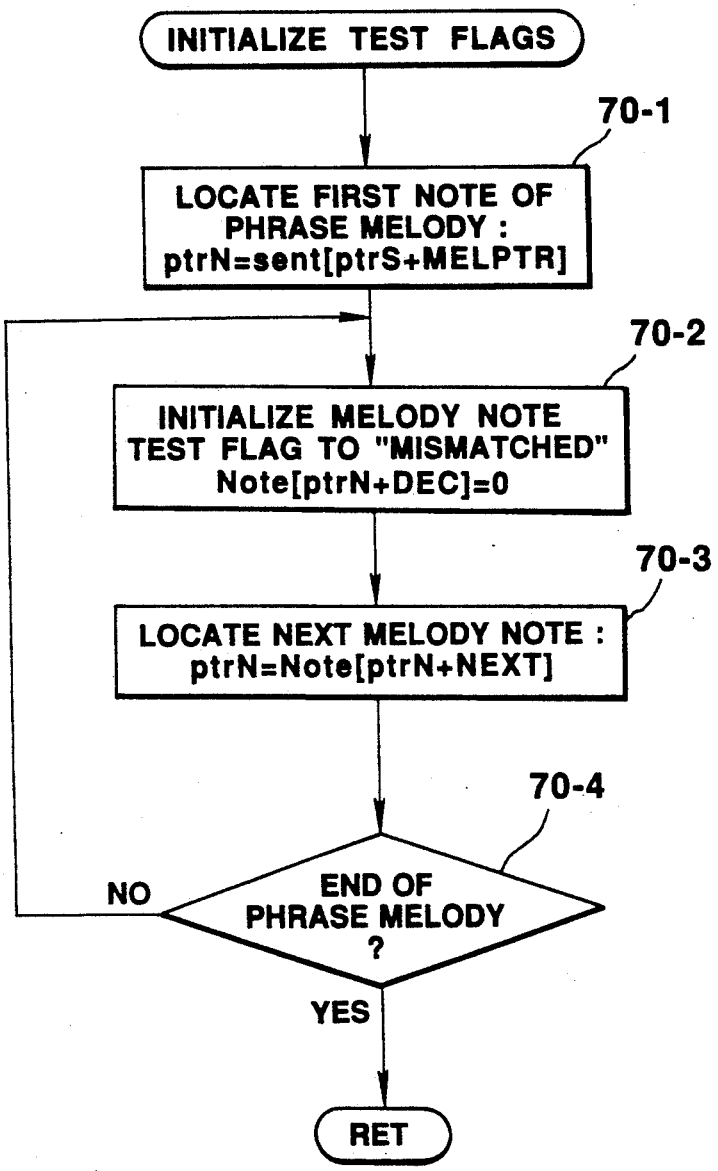
FIG. 70 is a flow chart of a initialize test flags routine.

FIG. 70 shows details of the initialize test flags routine 69-1. At step 70-1, the routine locates the first melody note of a phrase melody by ptrN=sent[ptrS+-MELPTR]. In the loop of 70-2 to 70-4, the routine initializes all test flags associated with the phrase melody to "mismatched."

Figure 71:
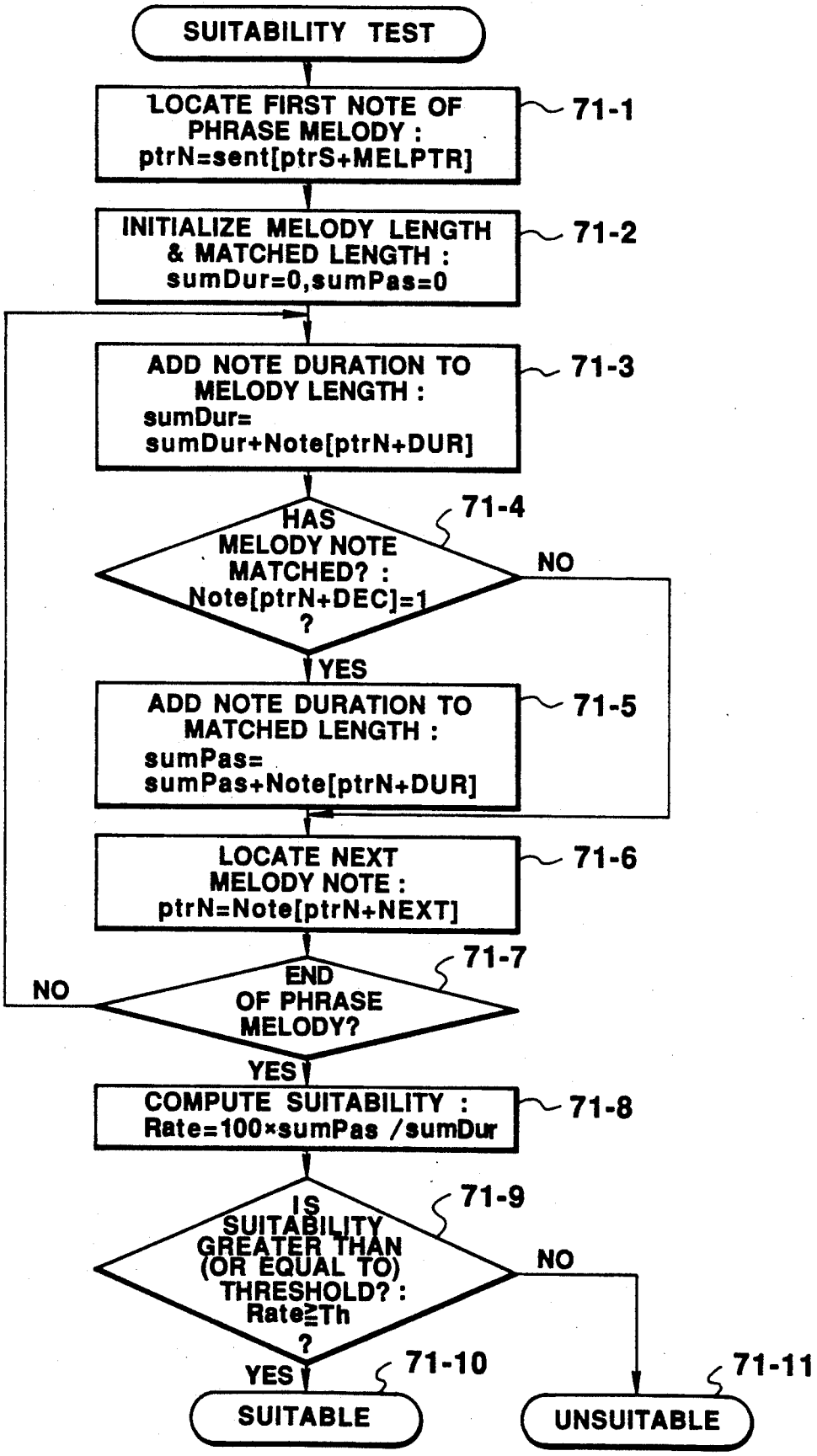
FIG. 71 is a flow chart of a suitability test routine.

FIG. 71 shows details of the suitability test routine 65-7 in FIG. 65. In brief, this routine evaluates suitability between a chord progression and a melody by computing the length proportion of the matched melody notes to the entire melody, and determines the chord progression suitable for the melody if the computed suitability exceeds a predetermined threshold.

Specifically, the first step 71-1 locates the first note of a phrase melody by ptrN=sent[ptrS+MELPTR]. The step 71-2 initializes phrase melody length and matched length accumulators by sumDur=0 and sumPas=0.

In the loop of 71-3 to 71-7, the routine accumulates the lengths. Step 71-3 adds a melody note duration to the phrase melody length accumulator by sumDur=-sumDur+Note]ptrN+DUR]. If the melody note has matched, as indicated by Note[ptrN+DEC]=1 (71-4), the step 71-5 adds it duration to the matched length accumulator by sumPas=sumPas+Note[ptrN+DUR]. Then step 71-6 locates the next melody note by ptrN=Note[ptrN+next]. If the phrase melody has not yet ended (71-7), the routine returns to the step 71-3. If ended, the step 71-8 computes stability between the phrase melody and the chord progression in question by computing the proportion of the matched length to the phrase length by Rate=100×sumPas/sumDur. The final step 71-9 checks Rate to see whether the suitability is greator than or equal to the threshold (Rate≧Th). If Rate≧Th, the routine returns "suitable" (71-10). Otherwise, it returns "unsuitable" (71-11).

In this manner, the musical apparatus described with respect to FIGS. 53 to 71 takes a chord progression as a coherent entity in order to determine its suitability for a melody. The apparatus automatically searches through CPDB 510 for a chord progression suitable for a melody. The suitability is examined based on the musical knowledge stored in MPRB 820. Therefore, the apparatus is very helpful to users of having insufficient musical knowledge or experience.

<CP Selecting Apparatus Modified>

Figure 72:
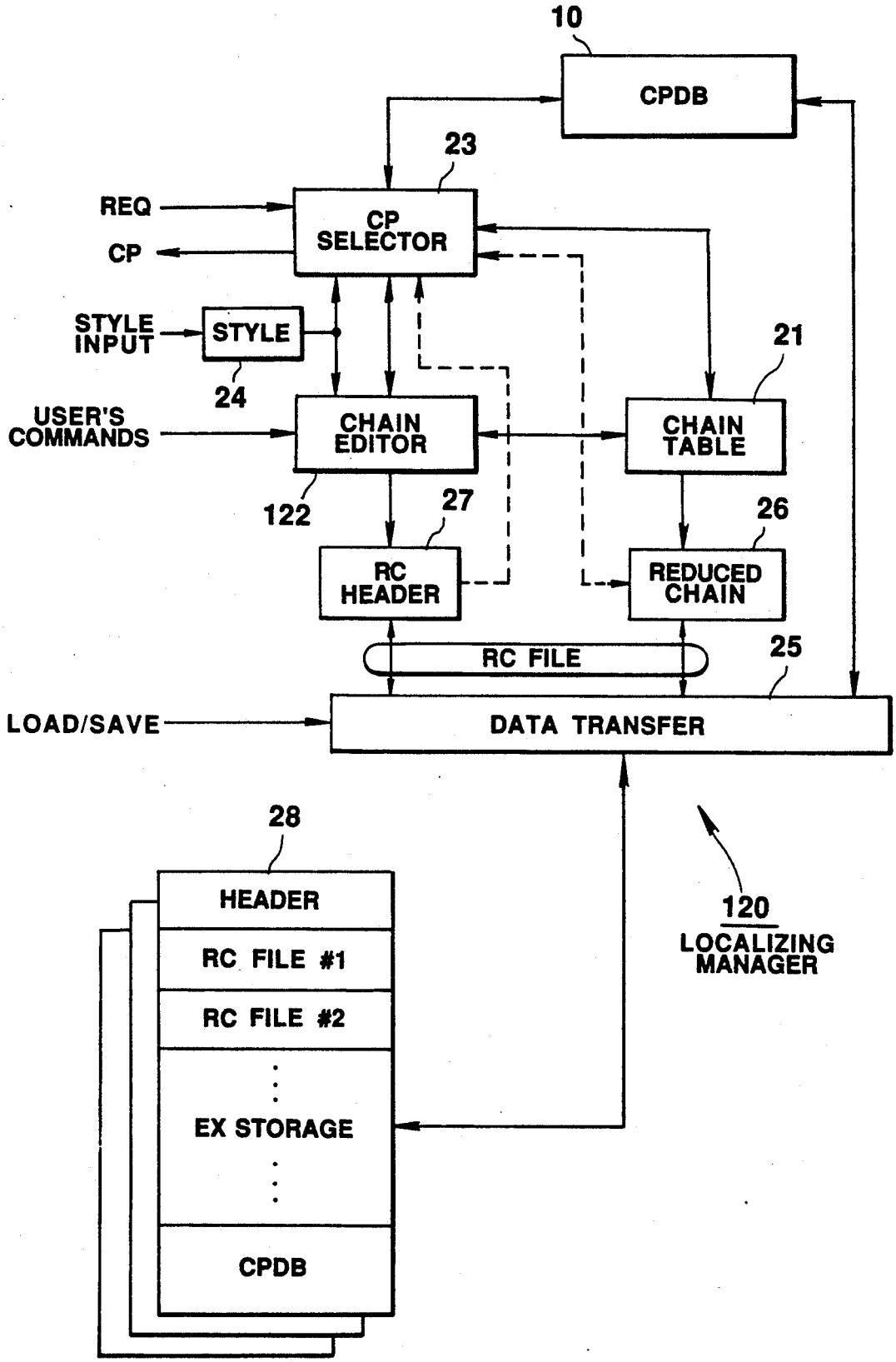
FIG. 72 is a functional block diagram of a modified CP selecting apparatus in accordance with the invention.

FIG. 72 shows a modified CP selecting apparatus in a functional diagram. The apparatus of FIG. 72 essentially includes all components or functions of the CP selecting apparatus shown in FIG. 1; CPDB 10, chain table 21, CP selector 23, style setting memory 24, and chain table modifying function 22 (included in chain editor 122). Furthermore, the modified CP selecting apparatus in FIG. 72 comprises additional components or features. These include additional features in the chain editor 122, reduced chain (RC) table 26, RC header 27, data transfer module 25, and external storage 28. These additional components in combination with the common functions 21 to 24 define a modified localizing manager (LM) 120.

The localizing manager 120 basically has two phases of operation. In the first phase (localizing phase), LM 120 creates a localized space of CPDB containing chord progressions of user's interest. This is done under the control of the chain editor 122 which operates to user's commands. Once the localized space has been established, its information is recorded into the reduced chain table 26 and RC header 27. A RC file is defined by the information. In the second phase (CP selecting phase), the localizing manager 120 uses the localized space (established in the reduced chain and RC header) to provide a desired chord progression to the user.

The external storage 28 may take the form of any conventional external storage medium such as magnetic card, magnetic disk (e.g., floppy or flexible disk cartridge) and optical disk (e.g., CD-ROM). An external storage of read-only type such as CD-ROM may be used as an external source of CPDBs. A CPDB from such CD-ROM 28 may be loaded into an internal RAM 10 via a suitable data transfer function 25 including a CD-ROM drive/reading system. An external storage of read-write type may be used as an archive storage of RC files. The illustrated external storage 28 is recorded with: a header containing file directory information; RC files #1, #2 etc., each containing a RC header and a reduced chain; and a CPDB containing a collection of chord progressions. In a floppy disk version of the external storage 28, a file directory located at particular sectors on a particular track of the disk may implement the header. Each file (e.g., RC file #1, CPDB) can occupy a number of sectors spread over the surface of the disk. The file directory or header comprises file control blocks (FCBs) each describing a list of all sectors (records) pertaining to a file for disk space management.

When the external storage 28 is in use, the data transfer module 25 retrieves the header or file directory, and manages it (creates FCBs for files to be processed, changes FCBs, terminates to free the disk space where a file has occupied) during the operation.

Using the file directory, the data transfer module 25 may present a user with a file name list of files recorded in the external storage via a suitable display (not shown). Then, the user may request loading of a RC file, say RC file #1. In response to this, the data transfer module 25 locates the RC file #1 and its associated CPDB in the external storage 28, and reads them into the internal memories 26, 27 and 10.

When the chain editor 24 has established a desired localized space of CPs, its information will be stored into reduced chain table 26 and RC header 27 in response to a user's command. The user may wish to save the localized data stored in the internal memories 26 and 27. To this end, the user gives a file name and inputs a save command. In response to this, the data transfer module 25 creates its FCB (including search of a free disk space and allocation of the file) or changes it if the file with the same file name is present on the external storage disk 28, transfers the data (of RC file #1, for example) to the external storage 28, and closes the file by copying the FCB back to the disk 28.

To create a desired CP localized space, a user may first enter a selected musical style into the style memory 24, and input a style compaction command. In response to this command, the chain editor 122 manipulates the chain table 21 to localize at its tip those chord progressions (in CPDB 10) belonging to the selected style. The style localization task is performed as follows. Assume that the chain editor 122 maintains chain managing pointers including a head pointer, denoted, here, cpdb[HEAD], a tail pointer, denoted cpdb[TAIL] and a current pointer cpdb[CUR]. These managing pointers cpdb[HEAD], cpdb[TAIL] and cpdb[CUR] correspond to cpdb[0], cpdb[2] and cpdb[1], shown in FIG. 5. Also assume that the chain table 21 is a bidirectional link list as chain [ ] shown in FIGS. 5 and 7, and that CPDB 10 comprises a CP pointer and style directory similar to cpAdr[ ] in FIG. 7 and a CPDB main which is similar to chop[ ] shown in FIGS. 7 and 11, and contains a collection of chord progressions with various styles.

First, the chain editor 122 places the current pointer on the head of the chain by cpdb[CUR]=cpdb[-HEAD]. Then, the chain editor 122 moves the current pointer along the chain, step by step, toward its tail, and at each step requests the CP selector to access a corresponding chord progression in CPDB 10, indexed by the current pointer, and test its style. For the style test, the CP selector 23 compares the style of the accessed chord progression with the selected style in the style memory 24. If a chord progression having the selected style is found, the chain editor 122 puts it on the head of the chain table 21 by executing a put it on top routine such as the one shown in FIGS. 14, 15 and 17 (see also FIG. 16). This topping operation occurs each time a chord progression having the selected musical style is found in CPDB during the scan of the chain table 21.

When cpdb[CUR] has reached the tail of the chain table (cpdb[CUR]=cpdb[TAIL]), the style localization is completed. That is, chord progressions (strictly, their pointers) belonging to the selected style are all compacted at the tip domain of the chain table. The number of such chord progressions is readily obtained by counting the topping operations. The first CP of the style-compacted chord progressions is pointed to be chain[HEAD]. The chain editor 122 creates a style end pointer, denoted chain[STAIL] which points to the last CP of the style-compacted chord progressions and points at the same time to an N-th node of the chain table in which N is the count of the topping operations.

Then, the current pointer chain[CUR] is made movable within the style-compacted space of the chord progressions between chain[HEAD] to chain[STAIL] for the second localization. In the second localization phase, the user searches the style-compacted chord progressions to find interesting chord progressions and localize them in accordance with his or her musical taste or intention. To this end, the user inputs chain edit commands. These including a succeeding CP request, a preceding CP request, an accept (top) command, a reject (tail) command and end-of-edit command. In response to a succeeding (or preceding) CP request, the localizing manager 120 causes the CP selector 23 to read the forward (backward) link of the current element in the chain table 21, update the current pointer cpdb[CUR] to the forward (backward) link, retrieve from CPDB a chord progression (CP) indexed by the updated current pointer, and play (sound) the CP via an appropriate play module (not shown). If the played chord progression is interesting, the user will enter a top (accept) command. In response to this command, the chain editor 122 executes the put it top routine to place the CP on head of the chain table. Further, the user may reject a chord progression even if it has once been accepted, by entering a reject command. In response to the reject command, the chain editor 122 executes a put it on tail routine to place the chord progression on the tail of the style-compacted chord progressions. (The tailing operation is essentially inversion of the topping operation).

By repeating the above operations, those chord progressions that have been accepted by the user are compacted (localized) at the tip portion of the style-compacted chain table.

During the second localization phrase, the chain editor 24 may use an acceptance counter (AC) and a location counter (LC). AC is initialized to zero, then incremented each time an accept command occurs outside of the accepted region (second localized space), and decremented each time a reject command occurs inside of the accepted region. The chain editor 122 ignores an accept command occured within the accepted region. For a reject command occurred outside of the accepted region, chain editor 122 executes the put it on tail routine but does not change AC. LC is initialized to zero when the current pointer cpdb[CUR] is initialized to cpdb[HEAD]. LC indicates a location number of cpdb[CUR]; LC is incremented each time cpdb[CUR] is stepped forward along the chain table, and it is decremented each time cpdb[CUR] is moved backward by one step along the chain. If an accept command occurs with $AC \leqq LC$, it is said that it occurs outside of the accepted region. If a reject command is entered when $AC > LC$, it occurs within the accepted (second localized) space.

Having completed the second localization, the user will enter an end-of-edit command. This shifts the localizing manager 120 into the CP selecting phrase. Specifically, in response to the end-of-edit command, the chain editor 122 creates a RC header 27 and a reduced or truncated chain 26. The reduced chain is created by truncating a leading segment of the chain table, associated with the accepted chord progressions; the forward link of the last node of the truncated segment chain is changed to a nil value indicating that nothing comes after it. The RC header 27 comprises a style index indicative of the selected style, a head pointer, denoted Rchain[HEAD] pointing to the head CP of the reduced chain; a tail pointer, denoted Rchain[TAIL] pointing to the tail CP of the reduced chain 26; and a current pointer, denoted Rchain[CUR] pointing to a current node of the reduced chain.

In the CP selecting phase, the CP selector 23 uses the reduced chain 26 and RC header 27, as indicated by dotted lines in FIG. 72. In response to a succeeding (or preceding) CP request from the user, the CP selector 23 reads the forward (backward) link of the current node in the reduced chain 26, updates the current pointer Rchain[CUR] to the forward (backward) link, and retrieves from CPDB 10 a chord progression indexed by the updated current pointer.

Therefore, the user can easily get a desired chord progression by simply glancing over the double localized, and very limited space of chord progressions.

<Music Composition Support System>

Figure 73:
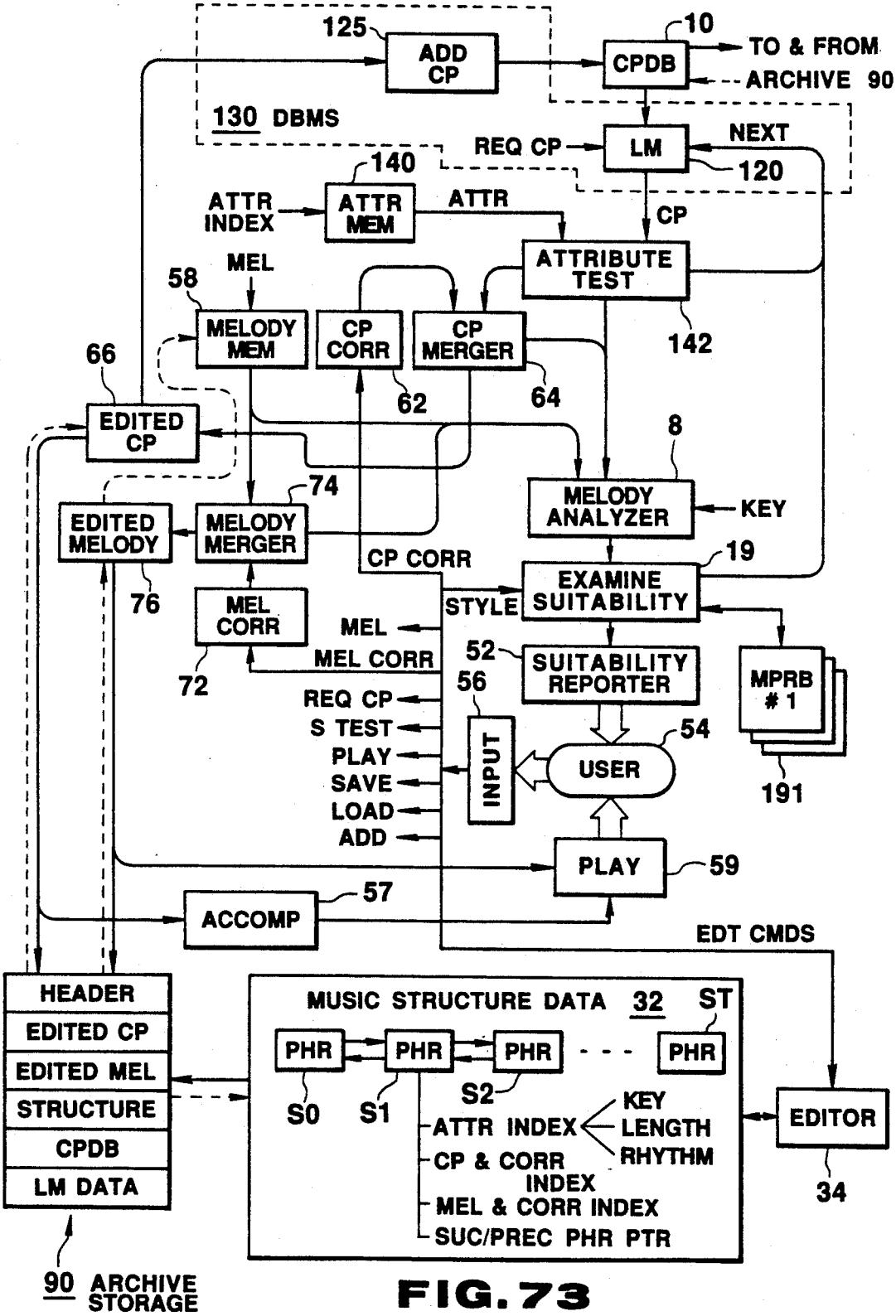
FIG. 73 is a functional block diagram of a music composition support apparatus incorporating the various features of the invention.

FIG. 73 shows a functional diagram of a computer-based music composition support system incorporating various features of the invention.

The apparatus provides a convenient environment in which a user 54 easily construct a desired music piece by an electronically compilable chain of phrases. To this end, the apparatus includes a music structure data memory 32 and an editor which electronically edits the music structure data 32 in accordance with user's edit commands (EDT CMDS) entered from an input device 56. The music structure data file (structure file) 32 is essentially identical with the component 30S in FIG. 19, and comprises a phrase chain memory similar to sent[ ] in FIG. 22, and piece management pointers (not shown in FIG. 73) similar to piece[ ] in FIG. 22. The editor 34 includes all editing functions 30E in FIG. 19. Further, the editor 34 has additional functions called larger musical block relocation features.

According to the structure file 32, a music piece is defined by an editable chain of phrases. Each phrase entry or data record in the phrase chain memory has a plurality of data items (comparable to those shown in FIG. 22): phrase key, length, harmonic rhythm index, chord progression index (and CP correction index which can be added temporarily in the music composition process), melody index (and melody correction index which can temporarily be added in the music composition process), succeeding phrase pointer, and preceding phrase pointer.

The phrase attributes are defined by the key, length and harmonic rhythm index items in combination with the attribute table memory 140. The user may set desired attributes of each phrase of a music piece by selecting appropriate attribute entries in the attribute table 140. Attribute input handlers (such as routines of FIGS. 44 to 46) determine the selected phrase attributes and set their index (ATTR INDEX) into an associated phrase of the phrase chain table in the structure file 32. If desired, some attributes may automatically be generated. For example, a phrase length may easily be determined from a phrase melody supplied from the user 54.

The phrase data item "melody index" locates a corresponding phrase melody in the melody memory 58. The user 54 may enter a complete melody of a music piece into the memory 58 at one time from a suitable input device. In this case, a melody segmentation routine (such as the one shown in FIG. 66) segments the complete music piece melody into phrases and records the melody index of each phrase into the phrase chain table of the structure file 32. In the alternative, the user may enter a melody of a phrase separately. In this case, no segmentation is required. A phrase melody input handler (not shown) stores the phrase melody into an area of the melody memory and records its entry point into the corresponding phrase of the phrase chain table, as the melody index. (Thereafter, the phrase length is automatically determined by measuring the length of the phrase melody.)

The phrase data item "melody correction index" locates the entry point to melody correction data of an associated phrase in the melody correction memory 72. Phrase melody correction data (MEL CORR) is entered from the user 54 when necessary in the music composition process.

The phrase data item "CP index" locates a chord progression in CPDB 10. The time "CP correction index" locates, in the chord progression correction memory 62, the entry point to chord progression correction data of an associated phrase. Phrase chord progression correct data (CP CORR) is entered from the user 54 as necessary in the music composition process.

Database management system (DBMS) 130 manages CPDB 10. DBMS 130 comprises the localizing manager (LM) 120 described in connection with FIG. 72. Thus, the system of FIG. 73 has the CP selecting feature of the invention which allows the user 54 to easily get a desired chord progression. The DB manager 20 described with respect to FIG. 1 may be substituted for LM 120. DBMS 130 further comprises an add CP module 125. The module 125 adds chord progressions to CPDB 10.

In the music composition support system of FIG. 73, CPDB 10 serves as a chord progression source for supplying chord progression candidates for each phrase of a melody piece. At the beginning of music composition, the user will decide a style of an intended music and tell the style information (STYLE) to the system. The system tests LM 120 to see whether it has a RC file associated with the selected style, by comparing a style index in its RC header with the entered style. If not, the system prompts the user to load such RC file from an appropriate external storage 28. The selected style information may be recorded in the structure file 32 as a music piece attribute.

To compose a music piece, the user must decide a melody and its harmonization (chord progression) of a phrase. To this end, the user 54 may enter a phrase melody (candidate) first, and then select a phrase chord progression (candidate) from CPDB 10, or vice versa. If the phrase melody is entered first, the user will input a CP request (REQ CP). If the chord progression has been selected and recorded in a phrase entry in the phrase chain table of the structure file 32, a suitability test(S TEST) command is internally (automatically) generated when a phrase melody is entered into the melody memory 74.

In response to a REQ CP, the localizing manager (LM) 120 retrieves a chord progression (CP) from CPDB 10 based on its RC file (associated with the selected style of an intended music piece), and records its index information (CP INDEX) into the structure file 32. An attribute test module 142 tests a CP from CPDB by LM 120 to see whether the attributes of the CP match the desired phrase attributes recorded in an associated phrase entry (e.g., S1 phrase) of the phrase chain table. To this end, the attribute test module uses the recorded phrase attribute index (ATTR INDEX) to read corresponding attribute data (ATTR) from the attribute memory 140, and compare them with the attributes of the CP looked up from CP attribute table (such as cpAtt[ ] in FIG. 23) in CPDB 10. If the CP attributes mismatch the phrase attributes, the attribute test module 142 requests LM 120 for a next CP. If a chord progression from LM 120 is found to have the desired phrase length and harmonic rhythm specified in the phrase entry of the phrase chain table, the module 142 transposes it to the desired phrase key, and supplies the transposed chord progression to the melody analyzer 8.

Then, the melody analyzer 8 reads a phrase melody from the melody memory 58, pointed to by the phrase melody index (contained in the phrase entry of the phrase chain table in the structure file 32), and analyzes the phrase melody based on the chord progression from the attribute test module 142 and the phrase key KEY (contained in the same phrase entry) in the manner as described in connection with FIG. 52. The melody analyzer 8 supplies the analyzed results (of the phrase melody) to a suitability examining module 19. The analyzed results are represented by a pattern of note types and pitch intervals (note-to-note motions).

The suitability examining module 19 receives the selected style (STYLE) of an intended music and uses it to select, from melody pattern rulebase (MPRB) 191, a rule file associated with the selected style. The entire MPRB 191 has a plurality of rule files classified according to musical styles. When receiving melody analyzed results from the analyzer 8, the suitability examining module 19 matches them to melody pattern rules in the selected rule file to evaluate suitability between the melody (here, a phrase melody, stored in the melody memory 58 and specified by a phrase melody index of interest) and the chord progression (here, a chord progression from CPDB 10, passed through LM 120 and the attribute test module 142). If the chord progression is found to be unsuitable for the phrase melody (the computed suitability has failed to exceed a predetermined suitability threshold), the suitability examining module 19 request LM 120 to get a next chord progression from CPDB 10. The operation of LM 120, attribute test module 142 and melody analyzer 8 repeats with respect to the next chord progression. As a result, a next chord progression meeting the condition of the phrase attributes is found, and melody analyzed results based on that chord progression are obtained and passed to the suitability examining module 19. Then, the module 19 repeats its operation to evaluate suitability of the next chord progression for the phrase melody.

If the evaluated suitability exceeds the predetermined threshold, the suitability examining module 19 decides that the associated chord progression is suitable for the phrase memory, and supplies the examined results to a suitability reporter 52.

Then, the suitability reporter 52 provides the suitability information to the user 54 through an appropriate display. The suitability information may contain the associated chord progression, phrase melody, and suitability distribution over their length: For example, a melody and a chord progression is visually presented in a music staff fashion. A portion of the melody and chord progression, which is found "mismatched" by the suitability examining module 19, is marked by "unsuitable", as indicated in part (1) of FIG. 74. (in the case of 100% match, there is no mismatched portion, of course.) If desired, the user requests the system to play (sound) the melody and chord progression by entering an appropriate play command (PLAY) of phrase. In the alternative, the suitability reporter 52 may call the phrase play routine.

In response to such suitability report, the user 54 can correct either of the melody and the chord progression, by inputting melody corrections (MEL CORR) or chord corrections (CP CORR). The entered melody corrections are stored into the melody correction memory 72 and its storage location index information (MEL CORR INDEX) is recorded into the associated phrase entry of the phrase chain table in the structure file 32. The entered chord progression corrections are written into the CP correction memory 62, and its index information is recorded into the phrase entry of the phrase chain table.

Then, the user will enter a request for suitability test (S TEST). In response to the S TEST command, the system causes CP merger 64 to merge the chord progression from CPDB 10 (involved in the previous suitability test and report) with the CP corrections (if any) from CP correction memory 62, and causes a melody merger 74 to merge the phrase melody from the melody memory 58 (associated with the previous suitability test and report) with the phrase melody correction data (if any) from the melody correction memory 72. Then, the system causes the melody analyzer 8 to analyze the merged melody (from the melody merger 74) based on the merged chord progression from the CP merger 64. The suitability examining module 19 then examines suitability between the merged phrase melody and the merged chord progression. At this time, the examined results are always reported by the suitability reporter 52 even if the chord progression is found unsuitable for the phrase melody.

Figure 74:
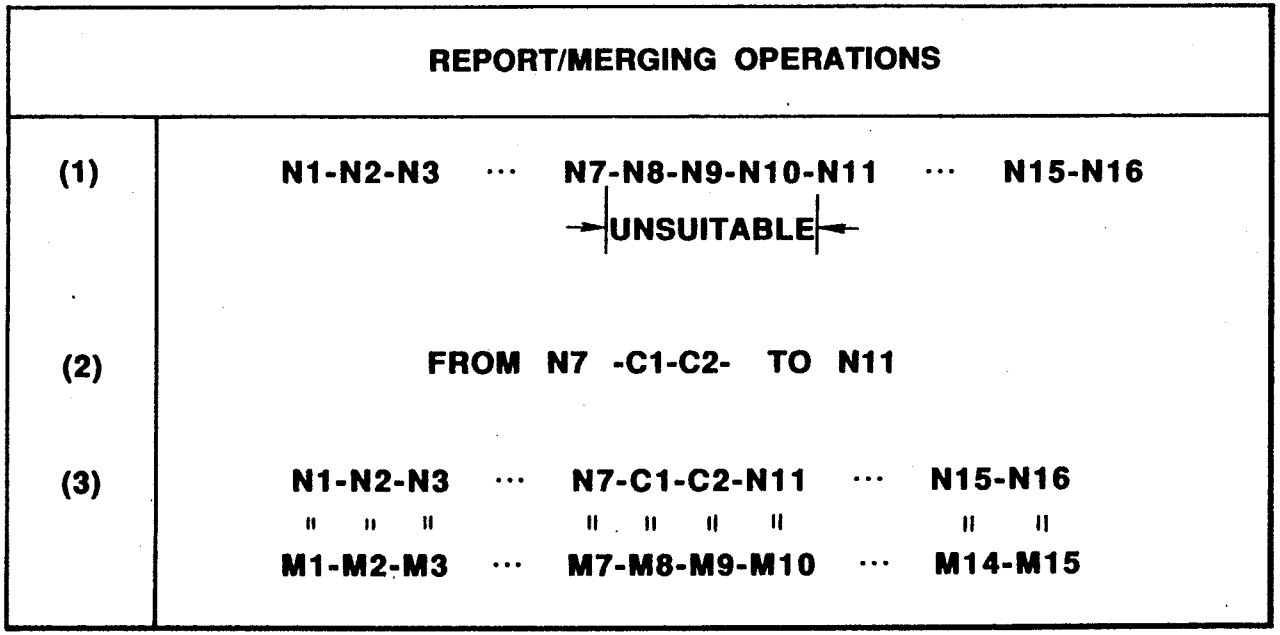
FIG. 74 illustrates suitability reporting and merging operations.

FIG. 74 illustrates a merging operation of CP merger 64 and melody merger 74. Part (1) symbolizes part of the suitability report. A sequence of N1 to N16 represents either a sequence of melody notes constituting a phrase melody (in melody memory 58) of a sequence of chords constituting a chord progression (selected from CPDB and tested by the suitability examining module 19). The suitability report says that a portion of N8 to N10 is unsuitable. Part (2) illustrates (CP or melody) corrections. According to the corrections, C1 comes after N7, C2 comes after C1, and before N11, thus indicating that N8 to N10 in the original chord progression (or melody) shown in part (1) should be changed to C1 and C2. Typical format of CP correction data contains chord number pair(s) in the associated chord progression, each indexing a portion to be corrected (e.g., N7 and N11 in part (1) example) and corrected chords (C1 and C2 in the part (2) example) containing root, type, bass and length information. Typical phrase melody correction data comprises melody note number pair(s) in the associated phrase melody, each delimiting a portion to be corrected, and corrected notes to be substituted.

Each merger 64, 74 merges the corrections into the original chord progression or melody by a replacement technique. In the example of FIG. 74, the original sequence N1 to N16 is merged with the correction sequence C1 and C2 by replacing its partial sequence of N8 to N10 by the correction sequence C1 and C2, as indicated in part (3). In FIG. 74, the resultant merged sequence elements are renumbered by M1 to M15, in which M1 to M7 correspond to N1 to N7, M8 and M9 to C1 and C2, and M10 to M15 correspond to N11 to N16. The renumbering is actually meant to write the merged data on a contiguous storage area (of edited melody memory 76, or edited CP memory 66).

Turning back to FIG. 73, the user 54 may listen to the phrase melody and the chord progression at least one of which has been corrected. To this end, the user 54 inputs a phrase play request. In response to this, the system causes the play module 59 to play (sound) the (merged) phrase melody from the edited melody memory 76. At the same time, the system causes the accompaniment module 57 to produce accompaniment data based on the (merged) chord progression from the edited CP memory 66, and causes the play module 59 to play the accompaniment.

Figure 75:
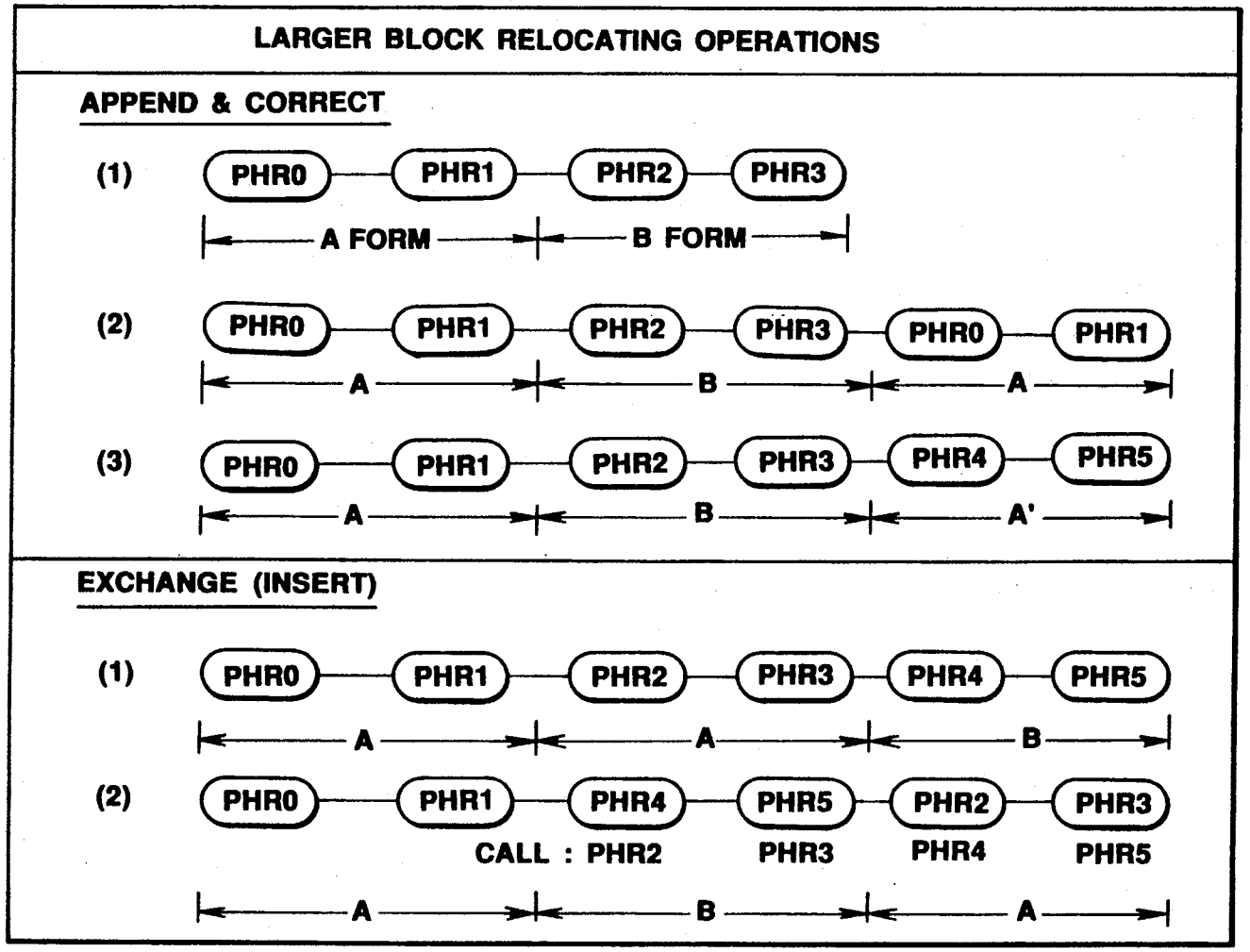
FIG. 75 illustrates large music block relocating operations.

In this manner, the user 54 can easily determine a desired melody and chord progression of a phrase of an intended music piece, aided by the music composition support system. The information on the determined phrase melody and chord progression is stored (maintained) in the structure file 32, by the compact form of index data items (MEL INDEX, or MEL LNDEX and MEL CORR INDEX; and CP INDEX, or CP INDEX and CP CORR INDEX), pointing to the phrase melody data in the melody memory 58 and its correction data (if any) in the melody correction memory 72, and pointing to the chord progression data in CPDB 10 and its correction data (if any) in the CP correction memory 62. The editor 34 has a capability of variably sequencing in accordance with user's phrase chaining commands (insert a phrase, append a phrase, delete a phrase) to provide a desired chain of phrases structuring a desired music piece. The editor 34 has an additional edit function, called larger musical block relocation feature. This is illustrated in FIG. 75. The larger musical block refers to a musical block larger than a phrase defined in the structure file 32. Thus, the larger musical block can be regarded as a large phrase.

In FIG. 75, APPEND & CORRECT block shows how a larger musical block is appended and corrected. In part (1), four phrases (PHR 0 RHR 3) are shown. Suppose that these four phrases have been completed. The first two phrases PHR 0 and PHR 1 have a musical form A, as a whole. The second two phrases PHR 2 and PHR 3 have a musical form B when considered as a single unit. Suppose that the user now wishes to append two phrases PHR 4 and PHR 5 having a musical form A' similar to form A. To this end, a large block append feature of the editor 34 appends a copy of the first two phrases to the end of the chained four phrases, as indicated in part (2). What the user should do is to simply designate large block to be copied and inputs a large append command. Then, the user may make small changes to the appended phrases so as to have the musical form A', as illustrated in part (3).

EXCHANGE (INSERT) block shows how large musical blocks are exchanged or inserted. Part (1) depicts six phrases in which the first two phrases RHR0 and RHR1 have a musical form A, the second two phrases PHR 2 and PHR 3 also have the form A (i.e., having the same melody and chord progression as PHR 0 and PHR 1), and the last two phrases PHR 4 and PHR 5 have a musical form B. Suppose now that the user wishes to exchange the second two phrases with the last two phrases. To this end, the user designates a large musical block (here, the last two phrases) to be inserted, and inputs a large insert command with an insert position designated here, between the second and third phrases. Then, the large insert feature of the editor 34 inserts the last two phrases PHR 4 and PHR 5 between phrases PHR 1 and PHR 2, as indicated in part (2). Then, PHR 4, PHR 5, PHR 2 and PHR 3 are called PHR 2, PHR 3, PHR 4 and PHR 5, respectively since the resultant six phrases are so chained in the phrase chain table of the structure file 32.

The large block relocating feature (large append and insert feature) allows the user to speed up his or her musical composition activity.

Turning back to FIG. 73, at the end of the musical composition process, the user may wish to listen to the complete music piece. The user enters a piece play request. The system responds by producing an edited complete melody and chord progression of the music piece based on the structure file 32 data (via mergers 64, 74) and causing the play module 59 to play the music piece including the completed melody and the accompaniment corresponding to the complete chord progression (via the accompaniment module 57).

The user may add merged chord progressions to CPDB 10. In response to an ADD command from the user, the ADD CP module in DBMS 130 to read, from the edited CP memory 66, merged chord progressions and adds them to CPDB 10. By the addition, the merged chord progressions become part of CPDM 10. Thus the system causes the editor 34 to change the structure file 32 in such a manner that two data items CP and CORR INDEX of each phrase are packed into a single item CP index pointing to a chord progression, merged and now residing in CPDB.

Having completed the music composition, the user may save the music piece information into an archive storage 90. To this end, the user enters a save command. Then, the system causes the editor 32 to rearrange the structure file. The editor 32 packs two data items of each phrase, MEL INDEX and MEL CORR INDEX into a single data item MEL INDEX in such a manner than the MEL INDEX points to an associated merged phrase melody (now residing in the edited melody memory 76).

The illustrated archive storage 90 contains a header (file directory), an edited complete CP file, edited complete melody file, structure file, CPDB and LM (local manager) data file. These files are selectively saved into the archive storage 90 in response to appropriate save commands (SAVE).

Further, the musical composition support system loads files from the archive storage 90 to memories (edited melody memory 76, melody memory 58, edited CP memory 66, structure file memory 32, RC header memory 27 and reduced chain memory 26 in LM 120, CPDB memory 10) in response to appropriate load commands (LOAD) from the user. Then the user may listen to the music piece loaded, or further improve it in the manner as described, aided by the music composition support system.

The computer-based music composition system of FIG. 73 is very helpful for unskilled users in doing their music composing activities. The system allows users to think of a melody and its harmonization in an integrated mental process. A desired chord progression is easily obtained from CPDB 10 by the localizing function of LM 120, attribute test function 142, melody analyzer 8, suitability examining function 19 combined with MPRB 191 containing melody pattern rule files of a plurality of musical styles, suitability reporter 52 and playing function 59.

This concludes the detailed description of the preferred embodiments. However, many variations and alternations will be obvious to a person of ordinal skill in the art. Therefore, the scope of the invention should be limited solely by the appended claims.

What is claimed is:

1. An apparatus for selecting a chord progression comprising:

chord progression database means for storing a database of chord progressions;

chain table means for storing a chain of pointers each indexing a different chord progression in said chord progression database means;

chain table modifying means for modifying said chain table means in accordance with user's commands to set up a desired chain of pointers in said chain table means; and chord progression selecting means for selecting a chord progression from said chord progression database means based on the desired chain of pointers set up in said chain table means.

2. The apparatus of claim 1 further comprising:

range storing means for storing a range of each chord progression in said chord progression database means; and range setting means for setting a desired range in accordance with a user's command; and in which said chord progression selecting means including means for selecting, from said chord progression database means, a chord progression within the desired range set by said range setting means.

3. The apparatus of claim 1 further comprising:

style attribute storing means for storing music style attributes each associated with a different one of the chord progressions in said chord progression database means; and style selecting means for selecting a desired music style in accordance with a user's command; and in which said chord progression selecting means includes search means for searching, from said chord progression database means, a chord progression with a stored music style attribute corresponding to the desired music style selected by said style selecting means.

4. An apparatus for producing a chord progression of a music piece comprising:

chord progression database means for storing a database of chord progressions;

selecting means for selecting a plurality of chord progressions from said chord progression database means; and editing means for electronically editing the selected plurality of chord progressions in accordance with user's commands to produce an edited chord progression of a music piece.

5. The apparatus of claim 4 wherein said the editing means comprises sequencing means for variably connecting chord progressions selected by said selecting means so that the selected chord progressions are put together in a desired sequence to form at least part of said edited chord progression of the music piece.

6. An apparatus for producing a chord progression of a music piece comprising:

chord progression database means for storing a database of chord progressions;

chain table means for storing a chain of pointers each indexing a different chord progression in said chord progression database means;

chain table modifying means for modifying said chain table means in accordance with user's commands to set up a desired chain of pointers in said chain table means;

chord progression selecting means responsive to user's commands for selecting a plurality of chord progressions from said chord progression database means based on the desired chain of pointers set up in said chain table means; and editing means for electronically editing the selected plurality of chord progressions in accordance with user's commands to produce an edited chord progression of a music piece.

7. An apparatus for producing a chord progression of a music piece comprising:

musical form defining means for defining a form of a music piece by a chain of phrases;

phrase attribute setting means for setting desired attribute of a phrase in said chain in such a manner that the desired attributes are determined independently of the musical form defined by said musical form defining means;

database means for storing a database of chord progressions;

candidate selecting means for selecting chord progressions from said database means, each as a chord progression candidate of said phrase in said chain;

candidate testing means responsive to said candidate selecting means for testing each chord progression candidate for its attributes to find a chord progression candidate, attributes of which are consistent with said desired attributes of said phrase in said chain, said found chord progression candidate defining a complete chord progression of said phrase in said chain; and repeating means for repeating operations of said phrase attribute setting means, said candidate selecting means and said candidate testing means with respect to each phrase in said chain to thereby produce a chord progression of the music piece.

8. The apparatus of claim 7 further comprising chain editing means for electronically editing said chain of phrases in accordance with user's commands to obtain a desired chain of phrases.

9. The apparatus of claim 7 wherein said phrase attribute setting means comprises means for setting a desired length of a phrase in said chain, and said candidate testing means includes means for finding a chord progression candidate that has said desired length.

10. The apparatus of claim 9 wherein said phrase attribute setting means further comprises means for setting a desired harmonic rhythm, defined by changes in harmony, of a phrase in said chain, and said candidate testing means further comprises means for finding a chord progression candidate that has said desired harmonic rhythm.

11. The apparatus of claim 10 wherein said phrase attribute setting means further comprises means for setting a desired key of a phrase in said chain, and said candidate testing means further comprises transposing means for transposing a chord progression candidate from said candidate selecting means in accordance with said desired key.

12. An apparatus for producing a chord progression of a music piece comprising:

musical form defining means for defining a form of a music piece by a chain of phrases;

phrase attribute setting means for setting desired attributes of a phrase in said chain in such a manner that the desired attributes are determined independently of the musical form defined by said musical form defining means;

database means for storing a database of chord progressions;

chain table means for storing a chain of pointers each indexing a different chord progression in said database means;

chain table modifying means for modifying said chain table means in accordance with user's commands to set up a desired chain of pointers in said chain table means;

candidate selecting means for selecting, as chord progression candidates of said phrase in said chain, chord progressions from said database means based on the desired chain of pointers set up in said chain table means;

candidate testing means responsive to said candidate selecting means for testing each chord progression candidate for its attributes to find a chord progression candidate, attributes of which are consistent with said desired attributes of said phrase in said chain, said found chord progression candidate defining a complete chord progression of said phrase in said chain; and repeating means for repeating operations of said phrase attribute setting means, said candidate selecting means and said candidate testing means with respect to each phrase in said chain to thereby produce a chord progression of the music piece.

13. An apparatus for evaluating suitability between a melody and a chord progression comprising:

melody providing means for providing a melody;

chord progression providing means for providing a chord progression;

melody analyzing means for analyzing said melody based on said chord progression to obtain analyzed results;

musical knowledge storage means for storing musical knowledge of melodies; and examining means for examining said analyzed results by using said musical knowledge to evaluate suitability between said melody and said chord progression.

14. An apparatus for evaluating suitability between a melody and a chord progression comprising:
melody providing means for providing a melody;
chord progression providing means for providing a chord progression;
key providing means for providing a key;
melody analyzing means for analyzing said melody based on said chord progression and said key to obtain analyzed results;
musical knowledge storage means for storing musical knowledge of melodies; and
examining means for examining said analyzed results by using said musical knowledge to evaluate suitability between said melody and said chord progression.

15. The apparatus of claim 14 wherein said melody analyzing means comprises the following means to obtain, from said melody, a pattern of note types and pitch intervals as said analyzed results:
coincident chord locating means for locating a coincident chord in said chord progression that corresponds in time to an individual note in said melody;
pitch class set determining means for determining, from said key and said coincident chord, a pitch class set for each note type;
note type identifying means for identifying a note type of notes in said melody according to said pitch class set for each note type; and
interval evaluating means for evaluating a pitch interval between adjacent notes in said melody;
wherein said musical knowledge storage means comprises rule base means for storing a set of melody pattern rules each describing a pattern of note types and pitch intervals; and
wherein said examining means comprises:
matching means for matching said analyzed results represented by a pattern of note types and pitch intervals to melody pattern rules in said set; and
suitability computing means for computing suitability between said melody and said chord progression from results from said matching means.

16. An apparatus for harmonizing a melody comprising:
melody input means for inputting a melody;
database means for storing a database of chord progressions; and
searching means for searching through said database means for a chord progression suitable for said melody; and
wherein said searching means comprises:
melody analyzing means for analyzing said melody based on a chord progression from said database means to obtain analyzed results;
musical knowledge storage means for storing musical knowledge of melodies to obtain analyzed results and
examining means for examining said analyzed results by using said musical knowledge to evaluate suitability between said melody and said chord progression.

17. The apparatus of claim 16 wherein said searching means further comprises means responsive to said examining means for passing another chord progression from said database means to said melody analyzing means when said chord progression has been found to be unsuitable for said melody.

18. An apparatus for evaluating suitability between a melody and a chord progression comprising:
melody providing means for providing a melody;
chord progression providing means for providing a chord progression;
melody analyzing means for analyzing said melody based on said chord progression to obtain analyzed results;
musical knowledge storage means for storing musical knowledge of melodies; and
examining means for examining said analyzed results by using said musical knowledge to evaluate suitability between said melody and said chord progression; and
wherein said chord progression providing means comprises:
chord progression database means for storing a database of chord progressions;
chain table means for storing a chain of pointers each indexing a different chord progression in said chord progression database means;
chain table modifying means for modifying said chain table means in accordance with user's commands to set up a desired chain of pointers in said chain table means; and
chord progression selecting means for selecting a chord progression from said chord progression database means based on the desired chain of pointers set up in said chain table means.

19. An apparatus for harmonizing a melody comprising:
melody input means for inputting a melody;
database means for storing a database of chord progressions; and
searching means for searching through said database means for a chord progression suitable for said melody;
wherein said searching means comprises:
database managing means for managing said database means and comprising chain table means for storing a chain of pointers each indexing a different chord progression in said database means, chain table modifying means for modifying said chain table means in accordance with user's commands to set up a desired chain of pointers in said chain table means, and chord progression selecting means for selecting a chord progression from said database means based on the desired chain of pointers set up in said chain table means;
melody analyzing means coupled to said database managing means for analyzing said melody based on said chord progression selected by said chord progression selecting means to obtain analyzed results;
musical knowledge storage means for storing musical knowledge of melodies; and
examining means for examining said analyzed results by using said musical knowledge to evaluate suitability between said melody and said chord progression.

20. An apparatus for harmonizing a melody comprising:
melody input means for inputting a melody having a plurality of segments;
chord progression database means for storing a database of chord progressions;
selecting means for selecting a plurality of chord progressions from said chord progression database means, each chord progression being suitable for a different segment of said melody; and editing means for electronically editing the selected plurality of chord progressions in accordance with user's commands to produce an edited chord progression of a music piece;

wherein said selecting means comprises searching means which searches through said chord progression database means for a chord progression suitable for each segment of said melody, and comprises:

melody analyzing means for analyzing a segment of said melody based on a chord progression from said chord progression database means to obtain analyzed results;

musical knowledge storage means for storing musical knowledge of melodies; and examining means for examining said analyzed results by using said musical knowledge to evaluate suitability between said melody and said chord progression.

21. An apparatus for harmonizing a melody comprising:

melody input means for inputting a melody having a plurality of segments;

chord progression database means for storing a database of chord progressions;

selecting means for selecting a plurality of chord progressions from said chord progression database means, each chord progression being suitable for a different segment of said melody; and editing means for electronically editing the selected plurality of chord progressions in accordance with user's commands to produce an edited chord progression of a music piece;

wherein said selecting means comprises searching means which searches through said chord progression database means for a chord progression suitable for each segment of said melody, and said searching means comprises:

database managing means for managing said chord progression database means and comprising chain table means for storing a chain of pointers each indexing a different chord progression in said chord progression database means, chain table modifying means for modifying said chain table means in accordance with user's commands to set up a desired chain of pointers in said chain table means, and chord progression selecting means for selecting a chord progression from said chord progression database means based on the desired chain of pointers set up in said chain table means;

melody analyzing means for analyzing a segment of said melody based on a chord progression selected by said chord progression selecting means to obtain analyzed results;

musical knowledge storage means for storing musical knowledge of melodies; and examining means for examining said analyzed results by using said musical knowledge to evaluate suitability between said melody and said chord progression.

22. An apparatus for harmonizing a melody comprising:

musical form defining means for defining a form of a music piece by a chain of phrases;

melody input means for inputting a melody of a phrase in said chain;

chord progression database means for storing a database of chord progressions; and searching means for searching through said database means for a chord progression suitable for said melody of said phrase in said chain;

wherein said searching means comprises:

phrase attribute setting means for setting desired attributes of said phrase in said chain;

candidate selecting means for selecting chord progressions from said database means, each as a chord progression candidate of said phrase in said chain;

candidate testing means responsive to said candidate selecting means for testing each chord progression candidate for its attributes to find a chord progression candidate, attributes of which are consistent with said desired attributes of said phrase in said chain;

melody analyzing means responsive to said candidate testing means for analyzing said melody based on said found chord progression candidate to obtained analyzed results;

musical knowledge storage means for storing musical knowledge of melodies; and examining means for examining said analyzed results by using said musical knowledge to evaluate suitability between said melody and said found chord progression candidate.

23. An apparatus for harmonizing a melody comprising:

musical form defining means for defining a form of a music piece by a chain of phrases;

melody input means for inputting a melody of a phrase in said chain;

chord progression database means for storing a database of chord progressions; and searching means for searching through said database means for a chord progression suitable for said melody of said phrase in said chain;

wherein said searching means comprises:

phrase attribute setting means for setting desired attributes of said phrase in said chain;

candidate selecting means for selecting chord progressions from said database means, each as a chord progression candidate of said phrase in said chain;

candidate testing means responsive to said candidate selecting means for testing each chord progression candidate for its attributes to find a chord progression candidate, attributes of which are consistent with said desired attributes of said phrase in said chain;

melody analyzing means responsive to said candidate testing means for analyzing said melody based on said found chord progression candidate to obtain analyzed results;

musical knowledge storage means for storing musical knowledge of melodies; and examining means for examining said analyzed results by using said musical knowledge to evaluate suitability between said melody and said found chord progression candidate; and wherein said candidate selecting means comprises:

chain table means for storing a chain of pointers each indexing a different chord progression in said chord progression database means;

chain table modifying means for modifying said chain table means in accordance with user's commands to set up a desired chain of pointers in said chain table means; and means for selecting chord progressions, each as a chord progression candidate, from said chord progression database means based on the desired chain of pointers set up in said chain table means.

24. An apparatus for selecting a chord progression comprising:

chord progression database means for storing a database of chord progressions;

localizing means responsive to user's commands for localizing those chord progressions of said chord progression database means that are favored by the user;

chord progression selecting means responsive to a user's command for selecting a chord progression from said chord progression database means based on localization by said localizing means, whereby the apparatus allows the user to gain efficient access to a desired chord progression.

25. The apparatus of claim 24 wherein said localizing means comprises:

chain table means for storing a chain of pointers each indexing a different chord progression in said chord progression database means;

chain table modifying means for modifying said chain table means in accordance with user's commands to set up a desired chain of pointers in said chain table means; and wherein said chord progression selecting means selects a chord progression from said chord progression database means based on the desired chain of pointers set up in said chain table means.

* * * * *